US007407740B2

(12) United States Patent
Kariya et al.

(10) Patent No.: US 7,407,740 B2
(45) Date of Patent: Aug. 5, 2008

(54) SILVER HALIDE COLOR PHOTOGRAPHIC LIGHT-SENSITIVE MATERIAL

(75) Inventors: Toshihiro Kariya, Minami-ashigara (JP); Hiroyuki Suzuki, Minami-ashigara (JP)

(73) Assignee: FUJIFILM Corporation, Tokyo (JP)

( * ) Notice: Subject to any disclaimer, the term of this patent is extended or adjusted under 35 U.S.C. 154(b) by 0 days.

(21) Appl. No.: 11/664,089

(22) PCT Filed: Sep. 30, 2005

(86) PCT No.: PCT/JP2005/018578

§ 371 (c)(1),
(2), (4) Date: Mar. 29, 2007

(87) PCT Pub. No.: WO2006/036028

PCT Pub. Date: Apr. 6, 2006

(65) Prior Publication Data

US 2007/0254248 A1 Nov. 1, 2007

(30) Foreign Application Priority Data

Sep. 30, 2004 (JP) ..... 2004-288299

(51) Int. Cl.

| | |
|---|---|
| ***G03C 1/46*** | (2006.01) |
| ***G03C 1/08*** | (2006.01) |
| ***G03C 1/06*** | (2006.01) |
| ***G03C 7/26*** | (2006.01) |
| ***G03C 7/32*** | (2006.01) |

(52) U.S. Cl. ..... 430/502; 430/503; 430/504; 430/505; 430/506; 430/543; 430/552; 430/553; 430/567; 430/599; 430/600; 430/603

(58) Field of Classification Search ..... 430/502–506, 430/543, 552–553, 567, 599–600, 603
See application file for complete search history.

(56) References Cited

U.S. PATENT DOCUMENTS

| | | | | |
|---|---|---|---|---|
| 3,297,446 | A | 1/1967 | Dunn | |
| 3,297,447 | A | 1/1967 | McVeigh | |
| 5,853,951 | A * | 12/1998 | Yasuda et al. | 430/264 |
| 2004/0002026 | A1 | 1/2004 | Sasaki et al. | |
| 2004/0157176 | A1 | 8/2004 | Kondo et al. | |
| 2005/0019710 | A1 * | 1/2005 | Sasaki et al. | 430/502 |

FOREIGN PATENT DOCUMENTS

| | | | |
|---|---|---|---|
| EP | 0 528 389 | A1 | 2/1993 |
| EP | 1 024 402 | A2 | 8/2000 |
| EP | 1 562 071 | A1 | 8/2005 |
| EP | 1 726 990 | A1 | 11/2006 |
| JP | 57-22090 | B2 | 5/1982 |
| JP | 2004-4144 | A | 1/2004 |
| JP | 2005-181806 | A | 7/2005 |
| JP | 2005-221815 | A | 8/2005 |
| WO | WO 2004/072730 | A1 | 8/2004 |

* cited by examiner

*Primary Examiner*—Geraldina Visconti
(74) *Attorney, Agent, or Firm*—Sughrue Mion, PLLC

(57) ABSTRACT

A silver halide color photographic light-sensitive material, having, on a support, at least one silver halide emulsion layer containing a cyan dye forming coupler, at least one silver halide emulsion layer containing a magenta dye forming coupler, and at least one silver halide emulsion layer containing a yellow dye forming coupler,
wherein at least one layer of said at least one silver halide emulsion layer containing a cyan dye forming coupler contains high-silver chloride emulsion grains, which are selenium-sensitized and have a silver chloride content of 90 mol % or more, and contains at least one coupler of formula (I):

Formula (I)

wherein R' and R" each independently are a substituent; and Z is a hydrogen atom, or a group capable of being split-off upon coupling reaction with an oxidized aromatic primary amine color-developing agent.

15 Claims, No Drawings

SILVER HALIDE COLOR PHOTOGRAPHIC LIGHT-SENSITIVE MATERIAL

TECHNICAL FIELD

The present invention relates to a silver halide color photographic light-sensitive material.

BACKGROUND ART

In recent years, there has been a strong increase in demand for shortening and accelerating the development processing in the fields of silver halide photographic light-sensitive materials, such as color printing paper. At the same time, there is also demand for reduced cost, and enhanced performance, such as higher-quality image.

As a silver halide emulsion that is to be used for color printing paper, silver halide emulsions with high-silver chloride content have been used, to cope primarily with the aforementioned demand for acceleration. However, light-sensitive materials having high-silver chloride content have the drawbacks that they are low in sensitivity and that they are apt to cause fogging.

Various improvements in, for example, chemical sensitizing methods and silver halide emulsion grain formation methods have been made for high sensitization of high-silver chloride emulsions. As typical methods of chemical sensitization of silver halide emulsions, various sensitization methods, such as sulfur sensitization, selenium sensitization, tellurium sensitization; noble metal sensitization using, for example, gold; reduction sensitization, and combinations of these sensitization methods, are known. As a selenium sensitizer used in a selenium sensitization method, among the above sensitization methods, use of a selenocarboxylate, i.e. seleno ester, is known (see, for example, U.S. Pat. Nos. 3,297,446, 3,297,447, and JP-B-57-22090 ("JP-B" means examined Japanese patent publication)).

In the case of color printing paper, it is preferable to use a silver halide emulsion that is reduced in fogging to the lowest extent, in order to express white color attractively. Selenium sensitization sometimes produces a larger sensitizing effect than sulfur sensitization used in the fields concerned. However, this selenium sensitization conspicuously increases occurrence of fogging, and also is apt to result in increase in gradation softness, and therefore it is unsuitable to color printing paper. Also, when selenium sensitization is utilized together with gold sensitization, a significant sensitivity increase is attained. However, fogging is largely increased at the same time, and also the resultant prints are apt to result in increase in gradation softness. As such, there has been a strong need for development of a selenium sensitization method that is reduced in generation of fogging and that provides a high-contrast or hard-gradation print.

Further, in a production process, silver halide emulsions, various emulsified dispersions, various additives, and the like are mixed and dissolved, and then applied. With a large production scale, and due to coating problems, or the like, these emulsions, dispersions, and additives are required to be left in a solution state for several hours. A large factor in production stability is to reduce the change in performance with the lapse of time after these materials are mixed and dissolved.

DISCLOSURE OF INVENTION

According to the present invention, there is provided the following means:

(1) A silver halide color photographic light-sensitive material, comprising, on a support, at least one silver halide emulsion layer containing a cyan dye forming coupler, at least one silver halide emulsion layer containing a magenta dye forming coupler, and at least one silver halide emulsion layer containing a yellow dye forming coupler, wherein at least one layer of said at least one silver halide emulsion layer containing a cyan dye forming coupler contains high-silver chloride emulsion grains, which are selenium-sensitized and have a silver chloride content of 90 mol % or more, and contains at least one coupler represented by the following formula (I):

Formula (I)

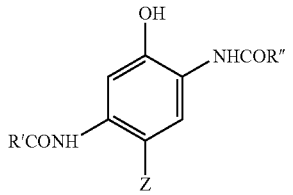

wherein R' and R" each independently represent a substituent; and Z represents a hydrogen atom, or a group capable of being split-off upon a coupling reaction with an oxidized product of an aromatic primary amine color-developing agent;

(2) The silver halide color photographic light-sensitive material according to the above (1), wherein the high-silver chloride emulsion grains are chemically sensitized by a selenium sensitizer represented by the following formula (SE1):

Formula (SE1)

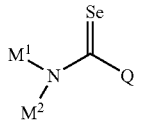

wherein $M^1$ and $M^2$ each independently represent a hydrogen atom, an alkyl group, an alkenyl group, an alkynyl group, an aryl group, a heterocyclic group, an acyl group, an amino group, an alkoxy group, a hydroxy group, or a carbamoyl group; Q represents an alkyl group, an alkenyl group, an alkynyl group, an aryl group, a heterocyclic group, —$OM^3$, or —$NM^4M^5$, in which $M^3$, $M^4$, and $M^5$ each independently represent a hydrogen atom, an alkyl group, an alkenyl group, an alkynyl group, an aryl group, or a heterocyclic group; and any two groups of $M^1$, $M^2$, and Q may bond together, to form a ring structure;

(3) The silver halide color photographic light-sensitive material according to the above (1), wherein the high-silver chloride emulsion grains are chemically sensitized by a selenium sensitizer represented by the following formula (SE2):

Formula (SE2)

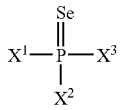

wherein $X^1$, $X^2$, and $X^3$ each independently represent an alkyl group, an alkenyl group, an alkynyl group, an aryl group, a heterocyclic group, —$OJ^1$, or —$NJ^2J^3$, in which $J^1$, $J^2$, and $J^3$ each independently represent a hydrogen atom, an alkyl group, an alkenyl group, an alkynyl group, an aryl group, or a heterocyclic group;

(4) The silver halide color photographic light-sensitive material according to the above (1), wherein the high-silver chloride emulsion grains are chemically sensitized by a selenium sensitizer represented by the following formula (SE3):

$$E^1\text{-Se-}E^2 \qquad \text{Formula (SE3)}$$

wherein $E^1$ and $E^2$, which are the same or different from each other, each independently represent an alkyl group, an alkenyl group, an alkynyl group, an aryl group, a heterocyclic group, an acyl group, an alkoxycarbonyl group, an aryloxycarbonyl group, or a carbamoyl group;

(5) The silver halide color photographic light-sensitive material according to the above (1), wherein the high-silver chloride emulsion grains are chemically sensitized by at least one selenium sensitizer represented by any of the following formulae (PF1) to (PF6):

Formula (PF1)

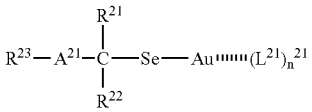

Formula (PF2)

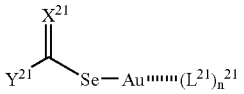

Formula (PF3)

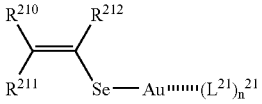

Formula (PF4)

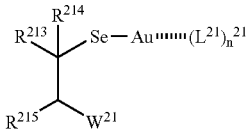

Formula (PF5)

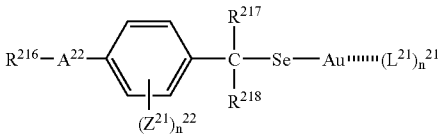

Formula (PF6)

$$[Q^{21}\text{—}Au\text{—}(Q^{22})_{n^{23}}]\ J^{21}$$

wherein $L^{21}$ represents a compound capable of coordinating with gold via an N atom, an S atom, an Se atom, a Te atom, or a P atom; $n^{21}$ represents 0 or 1; $A^{21}$ represents —O—, —S—, or —$NR^{24}$—; $R^{21}$, $R^{22}$, $R^{23}$, and $R^{24}$ each independently represent a hydrogen atom or a substituent; $R^{23}$ may form a 5- to 7-membered ring together with $R^{21}$ or $R^{22}$; $X^{21}$ represents =O, =S; or =$NR^{25}$; $Y^{21}$ represents an alkyl group, an alkenyl group, an alkynyl group, an aryl group, a heterocyclic group, —$OR^{26}$, —$SR^{27}$, or —$N(R^{28})R^{29}$; $R^{25}$, $R^{26}$, $R^{27}$, $R^{28}$, and $R^{29}$ each independently represent a hydrogen atom, an alkyl group, an alkenyl group, an alkynyl group, an aryl group, or a heterocyclic group; $X^{21}$ and $Y^{21}$ may bond together, to form a ring; $R^{210}$, $R^{211}$ and $R^{212}$ each independently represent a hydrogen atom or a substituent, and at least one of $R^{210}$ and $R^{211}$ represents an electron attractive group; $W^{21}$ represents an electron attractive group; $R^{213}$, $R^{214}$, and $R^{215}$ each independently represent a hydrogen atom or a substituent; $W^{21}$ and $R^{213}$ may bond together, to form a cyclic structure; $A^{22}$ represents —O—, —S—, —Se—, —Te—, or —$NR^{219}$—; $R^{216}$ represents a hydrogen atom, an alkyl group, an alkenyl group, an alkynyl group, an aryl group, a heterocyclic group, or an acyl group; $R^{217}$, $R^{218}$, and $R^{219}$ each independently represent a hydrogen atom, an alkyl group, an alkenyl group, an alkynyl group, an aryl group, or a heterocyclic group; $Z^{21}$ represents a substituent; $n^{22}$ represents an integer of from 0 to 4; when $n^{22}$ is 2 or more, $Z^{21}$s may be the same or different, or may bond together to form a ring; $Q^{21}$ and $Q^{22}$ each represent a compound selected from those represented by any of formulae (SE1) to (SE3); the Se atoms in $Q^{21}$ and $Q^{22}$ each are coordinated with the Au; $n^{23}$ represents 0 or 1; $J^{21}$ represents a counter anion; when $n^{23}$ is 1, $Q^{21}$ and $Q^{22}$ may be the same or different; and the compound represented by formula (PF6) does not include the compounds represented by any of formulae (PF1) to (PF5);

(6) The silver halide color photographic light-sensitive material according to any one of the above (1) to (5), wherein the average side length of the high-silver chloride emulsion grains is 0.1 μm or more and 0.35 μm or less;

(7) The silver halide color photographic light-sensitive material according to any one of the above (1) to (6), wherein the high-silver chloride emulsion grains have a silver iodide content of 0.1 mol % or more and 1 mol % or less, and a silver iodide-containing phase is formed at a part or all of the position ranging from 80% or outer of the grain volume measured from the inside;

(8) The silver halide color photographic light-sensitive material according to any one of the above (1) to (7), wherein an amount of said coupler contained in the red-sensitive silver halide emulsion layer, which is chemically synthesized by a selenium sensitizer, is 0.6 equivalents to 1 equivalent, to 1 mol of silver;

(9) The silver halide color photographic light-sensitive material according to any one of the above (1) to (8), which is a silver halide color photographic light-sensitive material for rapid processing, in which a color development processing is started within 9 seconds after imagewise exposure, and said color development processing is finished in a period time within 28 seconds, to form an image; and

(10) The silver halide color photographic light-sensitive material according to any one of the above (1) to (9), which is a silver halide color photographic light-sensitive material for digital exposure, in which the exposure is imagewise exposure carried out by laser scanning.

According to the present invention, a silver halide emulsion that has high sensitivity, that is reduced in fogging, and that imparts contrasty gradation, can be obtained. The present invention can also provide a silver halide photographic light-sensitive material that is reduced in the change in performance with the lapse of time after materials to be used in said light-sensitive material are mixed and dissolved in a production process.

The silver halide color photographic light-sensitive material of the present invention is high in sensitivity, low in fogging, excellent in gradation characteristics, and reduced in the change in performance with the lapse of time after materials to be used in said light-sensitive material are mixed and dissolved in a production process.

Other and further features and advantages of the invention will appear more fully from the following description.

BEST MODE FOR CARRYING OUT INVENTION

The method for carrying out the present invention, and preferable embodiments of the present invention will be explained in detail.

In at least one layer of the silver halide emulsion layer(s) containing a cyan dye forming coupler, the silver halide emulsion that can be used in the present invention comprises high-silver chloride emulsion grains, which are sensitized by selenium and have a silver chloride content of 90 mol % or more, and said at least one layer contains at least one coupler represented by formula (I).

First, the compound represented by formula (I) is described below.

Formula (I)

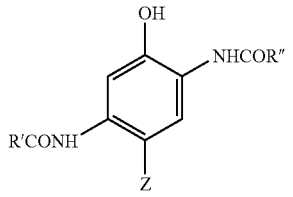

In formula (I), R' and R" each independently represent a substituent; and Z represents a hydrogen atom, or a group capable of being split-off upon a coupling reaction with an oxidized product of an aromatic primary amine color-developing agent.

As used herein throughout the present specification and claims, unless otherwise specified, the term "alkyl" refers to an unsaturated or saturated, straight-chain or branched-chain alkyl group (including a alkenyl and aralkyl), including a cyclic alkyl group having 3 to 8 carbon atoms (including a cycloalkyl group and a cycloalkenyl group), and the term "aryl" specifically includes a condensed aryl.

With respect to formula (I), R' and R" each are preferably selected independently from an unsubstituted or substituted alkyl group, aryl group, amino group or alkoxy group, or a 5- to 10-membered heterocycle containing at least one heteroatom selected from nitrogen, oxygen and sulfur, which ring may be unsubstituted or substituted.

In formula (I), when R' and/or R" is an amino group or an alkoxy group, R' and/or R" may have a substituent (e.g., a halogen atom, an aryloxy group, or an alkyl- or aryl-sulfonyl group). Preferably, R' and R" are independently selected from unsubstituted or substituted, alkyl or aryl groups having 1 to 50 carbon atoms (e.g., hexyl, phenyl, and tolyl), or five to ten-membered heterocyclic groups, such as a pyridyl, morpholino, imidazolyl, or pyridazolyl group.

In formula (I), R' is more preferably an alkyl group substituted with a substituent; and examples of the substituent include a halogen atom, an alkyl group, an aryloxy group, and an alkyl- or aryl-sulfonyl group, each of which may be further substituted, and these are preferable. When R" is an alkyl group, it may be likewise substituted in the same manner as described above.

However, R" is preferably an unsubstituted aryl group, or an aryl group that is substituted with a substituent. Examples of the substituent on said substituted aryl group include a cyano group, a halogen atom (chlorine, fluorine, bromine, or iodine), an alkyl- or aryl-carbonyl group, an alkyl- or aryl-oxycarbonyl group, an acyloxy group, a carbonamido group, an alkyl- or aryl-carbonamido group, an alkyl- or aryl-oxycarbonamido group, an alkyl- or aryl-sulfonyl group, an alkyl- or aryl-sulfonyloxy group, an alkyl- or aryl-oxysulfonyl group, an alkyl- or aryl-sulfoxido group, an alkyl- or aryl-sulfamoyl group, an alkyl- or aryl-sulfamoylamino group, an alkyl- or aryl-sulfonamido group, an aryl group, an alkyl group, an alkoxy group, an aryloxy group, a nitro group, an alkyl- or aryl-ureido group, or an alkyl- or aryl-carbamoyl group, each of which may be further substituted. Among these, a preferred substituent is a halogen atom, a cyano group, an alkoxycarbonyl group, an alkylsulfamoyl group, a sulfonamido group, an alkyl-sulfonamido group, an alkylsulfonyl group, a carbamoyl group, an alkylcarbamoyl group, or an alkylcarbonamido group. When R" is an aryl group or a heterocyclic group, it may also be substituted in the same manner as described above.

Preferably, R" is a 4-chlorophenyl group, a 3,4-dichlorophenyl group, a 3,4-difluorophenyl group, a 4-cyanophenyl group, 3-chloro-4-cyano-phenyl group, a pentafluorophenyl group, or a 3- or 4-sulfonamido-phenyl group.

In formula (I), Z represents a hydrogen atom, or a group that can split off upon a coupling reaction with an oxidized product of an aromatic primary amine color-developing agent. Z is preferably a hydrogen atom, a chlorine atom, a fluorine atom, or a substituted aryloxy group, more preferably a hydrogen atom or a chlorine atom.

In this case, it is preferable that Z in formula (I) is not one which reacts with an oxidized color developing agent, to convert into a diffusible development inhibitor or a precursor thereof, and/or which reacts with an oxidized color developing agent, to form a cleft compound that can react with another one molecule of the oxidized color developing agent, to convert into a development inhibitor or a precursor thereof, i.e. a so-called DIR compound.

Examples of the development inhibitor include development inhibitors as described in Research Disclosure, vol. 76, No. 17643, (December, 1978), U.S. Pat. Nos. 4,477,563, 5,021,332, 5,026,628, 3,227,554, 3,384,657, 3,615,506, 3,617,291, 3,733,201, 3,933,500, 3,958,993, 3,961,959, 4,149,886, 4,259,437, 4,095,984 and 4,782,012, and GB Patent Nos. 1450479 or 5034311.

Typical examples of the development inhibitor or its precursor include heterocyclic thio groups, heterocyclic seleno groups, or triazolyl groups (monocyclic or condensed cyclic 1,2,3-triazolyl or 1,2,4-triazolyl), and particularly preferable examples include tetrazolylthio, tetrazolylseleno, 1,3,4-oxadiazolylthio, 1,3,4-thiadiazolylthio, 1-(or 2-)benzotriazolyl, 1,2,4-triazole-1-(or 4-)yl, 1,2,3-triazole-1-yl, 2-benzothiazolylthio, 2-benzooxazolylthio, 2-benzimidazolylthio, and derivatives of these.

Z determines the chemical equivalent of the coupler, that is, whether it is a two-equivalent coupler or a four-equivalent coupler, and the reactivity of the coupler can be changed depending on the kind of Z. Such a group can give advantageous effects on the layers on which the coupler is coated or other layers in a photographic recording material, by exhibiting a function, for example, of dye formation, dye hue adjustment, acceleration of development or inhibition of development, acceleration of bleaching or inhibition of bleaching, facilitation of electron mobilization, color correction, or the like, after said group is released from the coupler.

Examples of representative class of such a coupling split-off group include a halogen atom, an alkoxy, aryloxy, heterocyclic oxy, sulfonyloxy, acyloxy, acyl, heterocyclic, sulfonamido, heterocyclic thio, benzothiazolyl, phosphonyloxy, alkylthio, arylthio, or arylazo group. These coupling split-off groups are described, for example, in the following publications: U.S. Pat. Nos. 2,455,169, 3,227,551, 3,432,521, 3,467,563, 3,617,291, 3,880,661, 4,052,212, and 4,134,766, as well as GB Patent No. 1,466,728, GB Patent No. 1,531,927, and GB Patent No. 1,533,039, and GB Patent Application Publication Nos. 2,066,755A and 2,017,704A, the disclosures of which are incorporated herein by reference. Most preferred are a halogen atom, an alkoxy group, and an aryloxy group.

The coupling split-off group is particularly preferably a chlorine atom, a hydrogen atom, or a p-methoxyphenoxy group.
Specific examples of the compound represented by formula (I) are shown below, but the present invention is not limited to these compounds.
IC-1
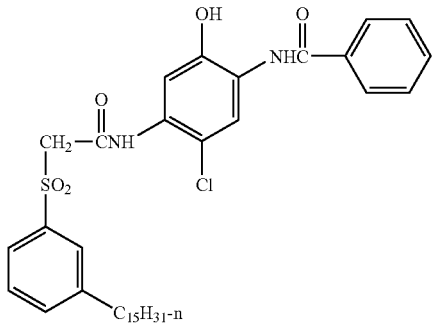
IC-2
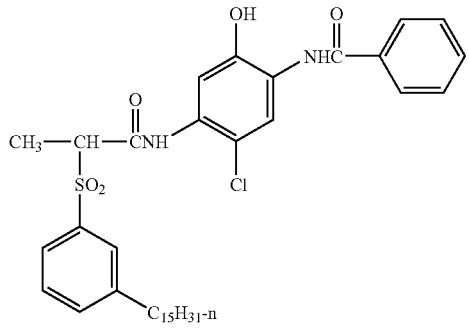
IC-3
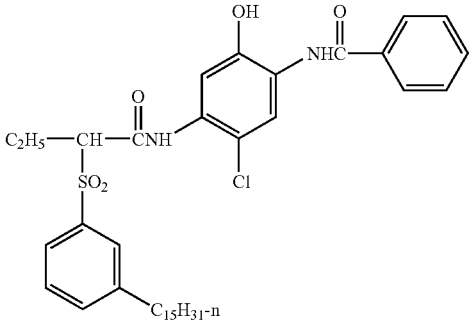
IC-4
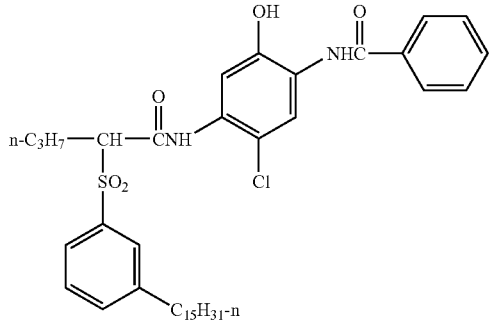
IC-5
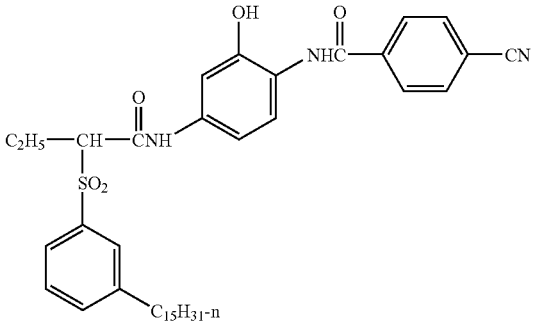
IC-6
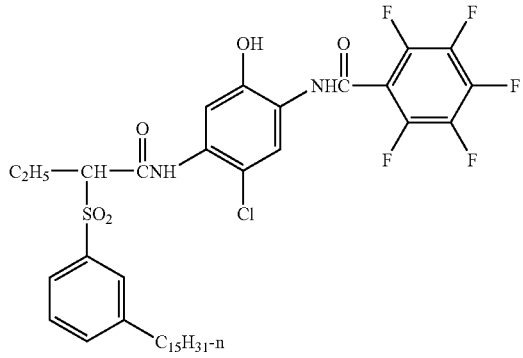
IC-7
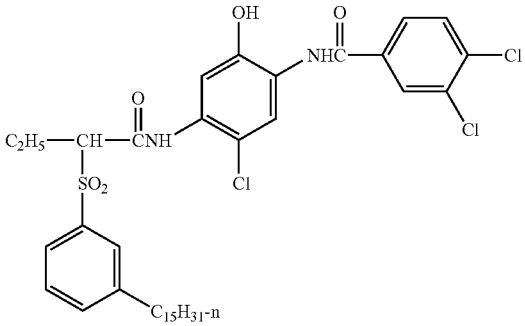
IC-8
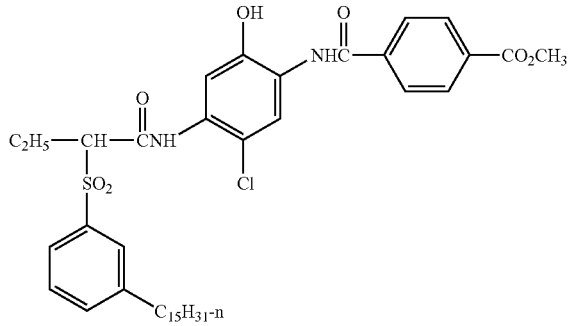

-continued
IC-9
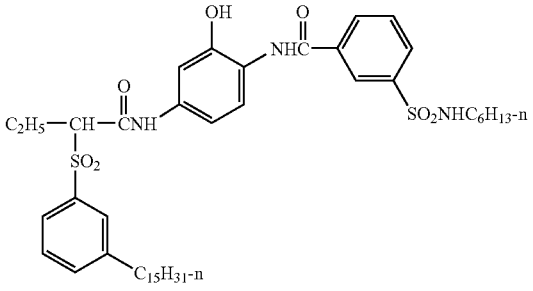
IC-10
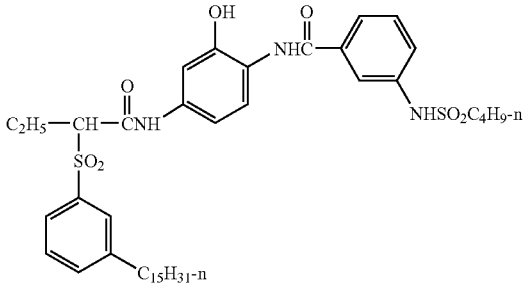
IC-11
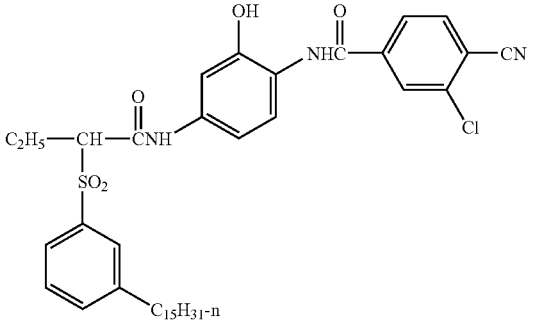
IC-12
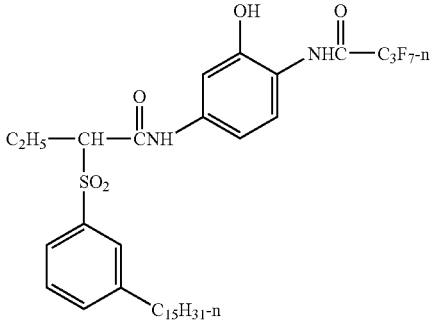
IC-13
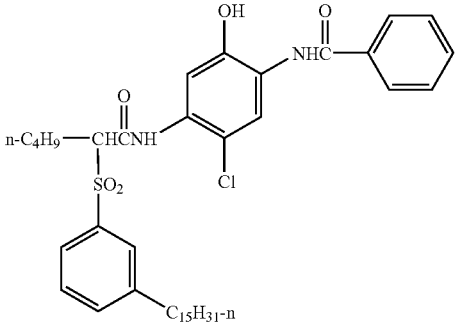
IC-14
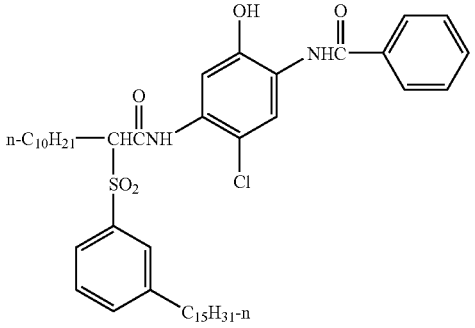
IC-15
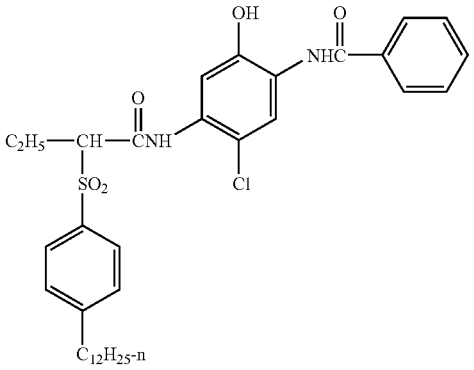
IC-16
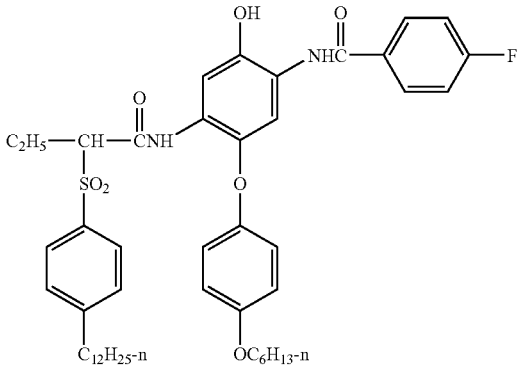

-continued
IC-17
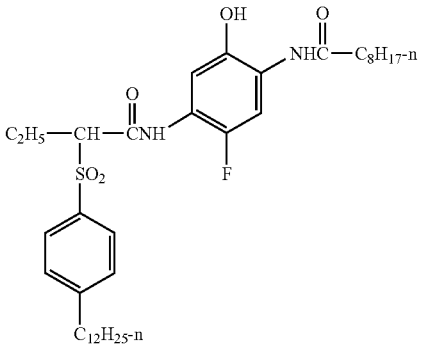
IC-18
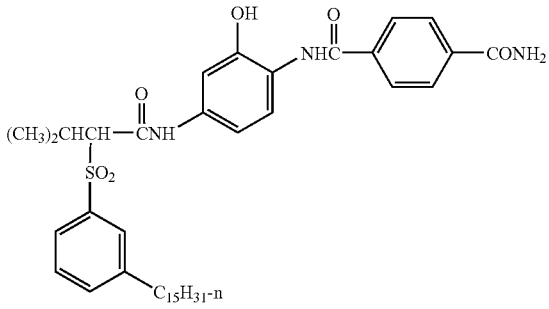
IC-19
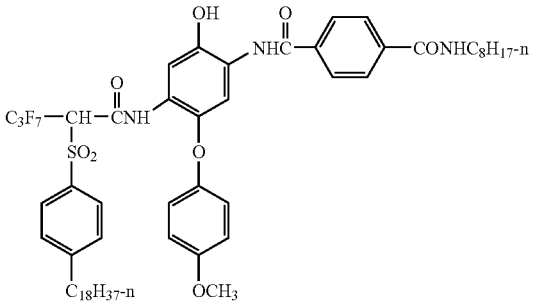
IC-20
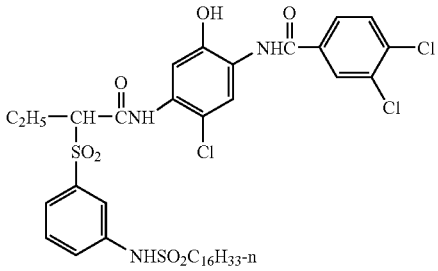
IC-21
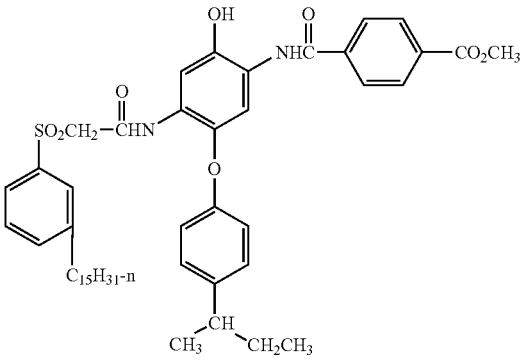
IC-22
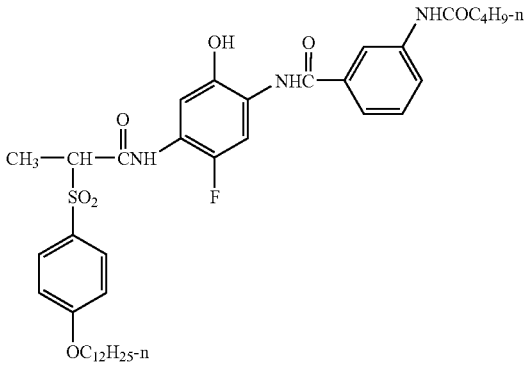
IC-23
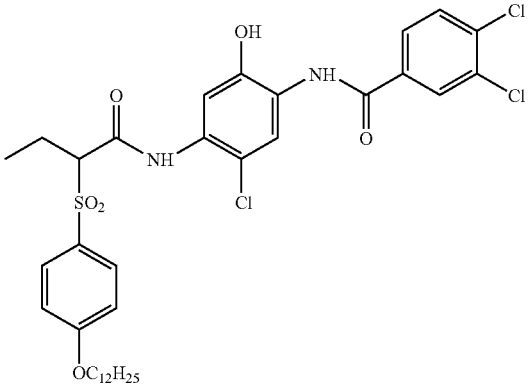
IC-24
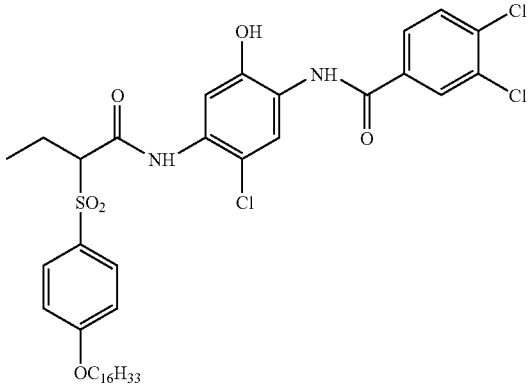

-continued
IC-25
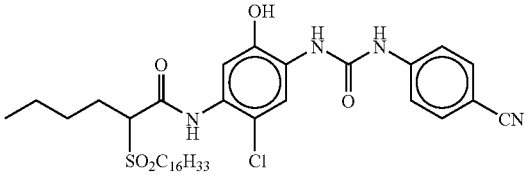
IC-26
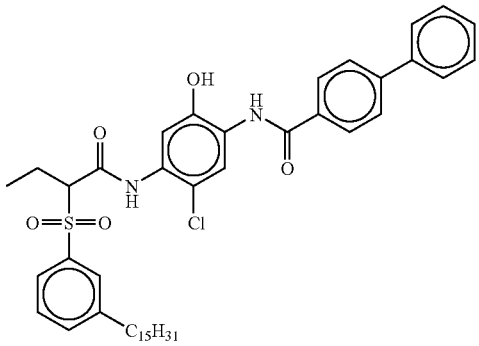
IC-27
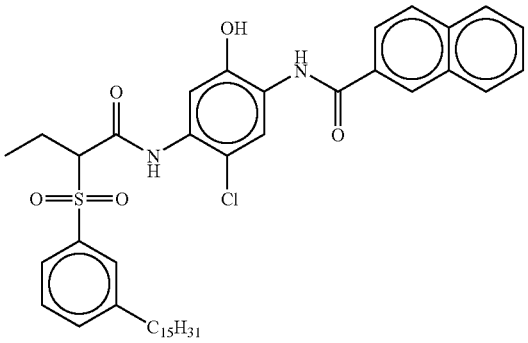
IC-28
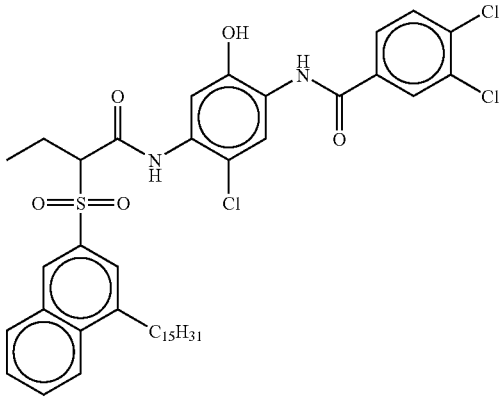
IC-29
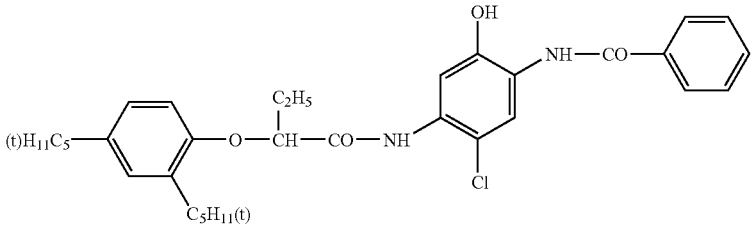
IC-30
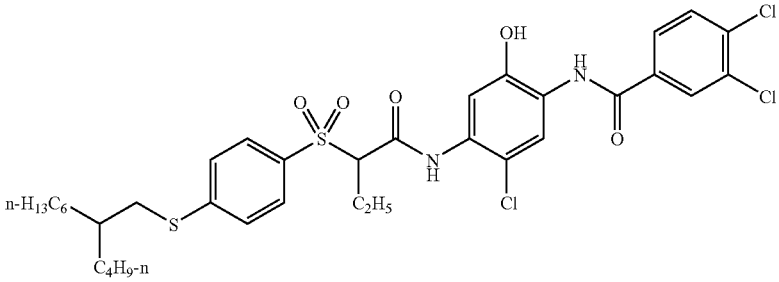
IC-31
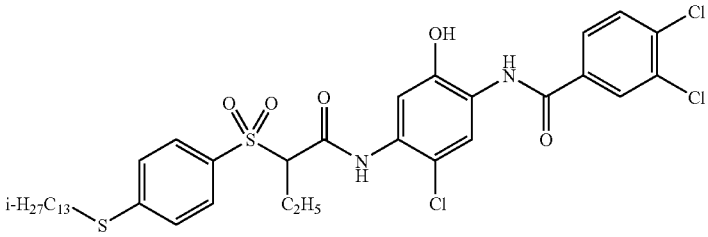

-continued
IC-32
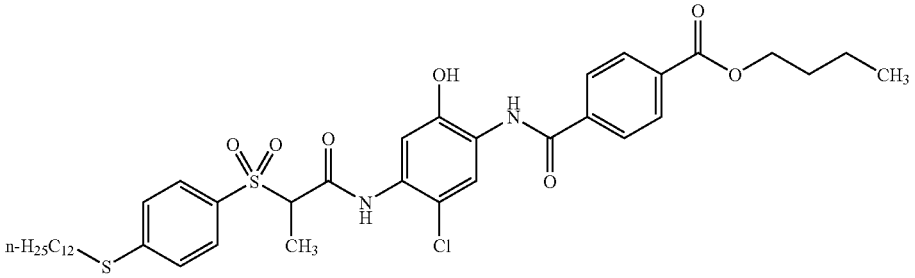
IC-33
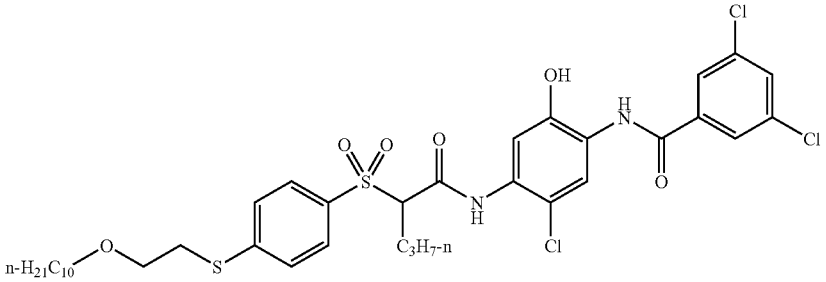
IC-34
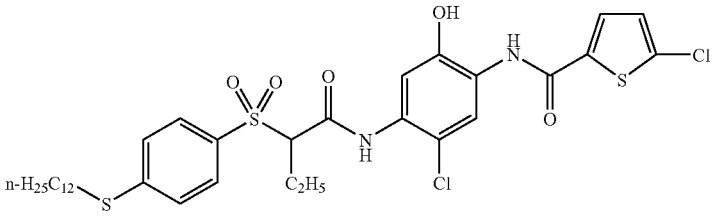
IC-35
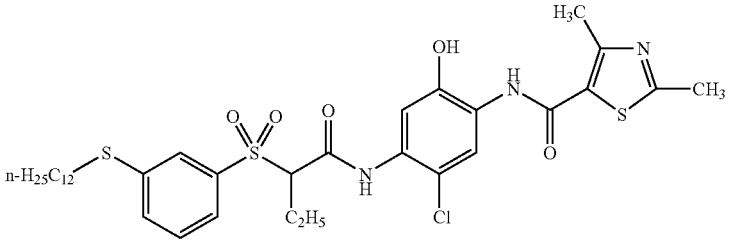
IC-36
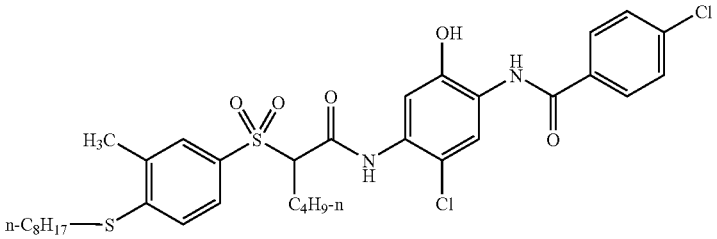
IC-37
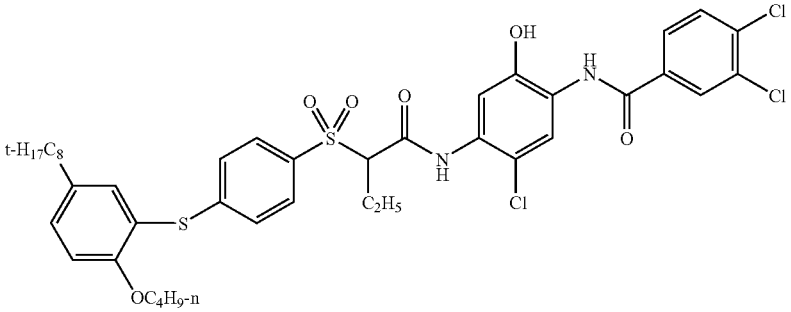

-continued
IC-38
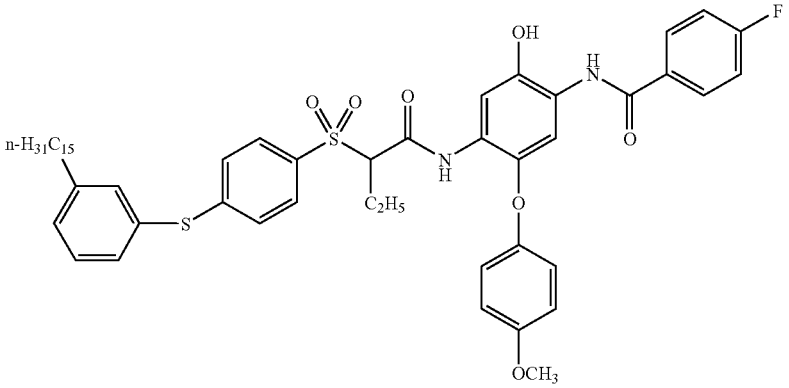
IC-39
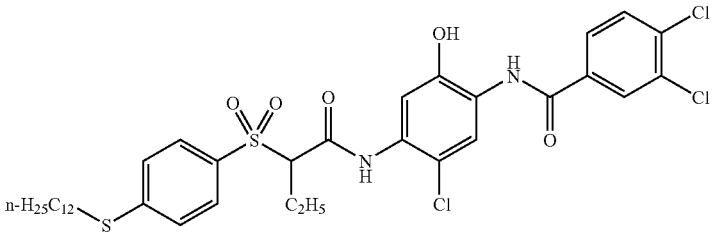
IC-40
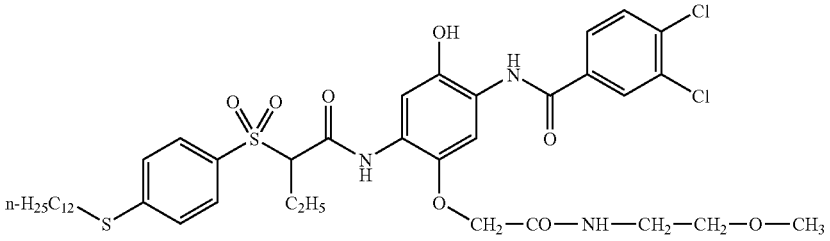
IC-41
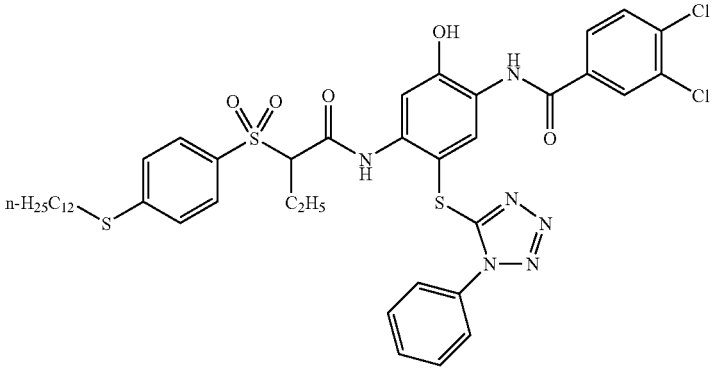
IC-42
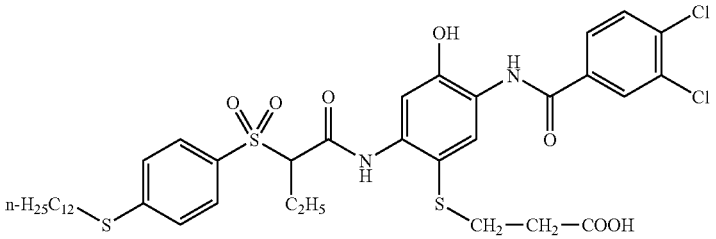

-continued
IC-43
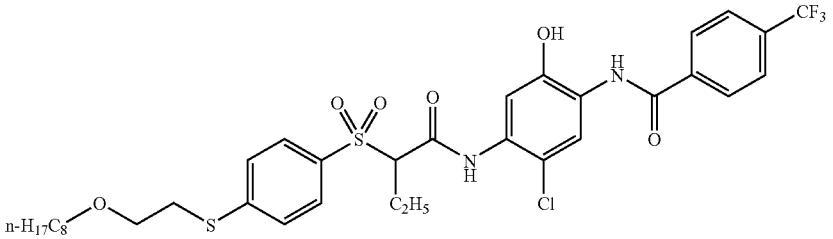
IC-44
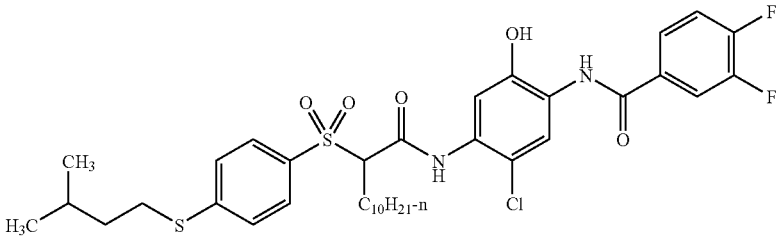
IC-45
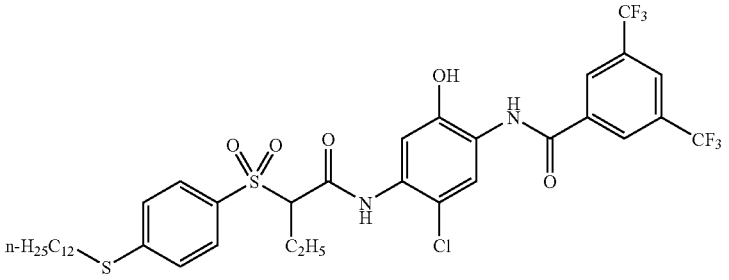
IC-46
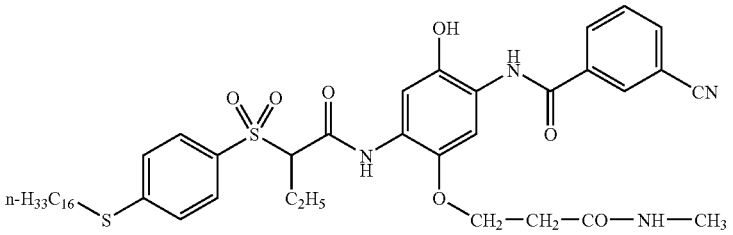
IC-47
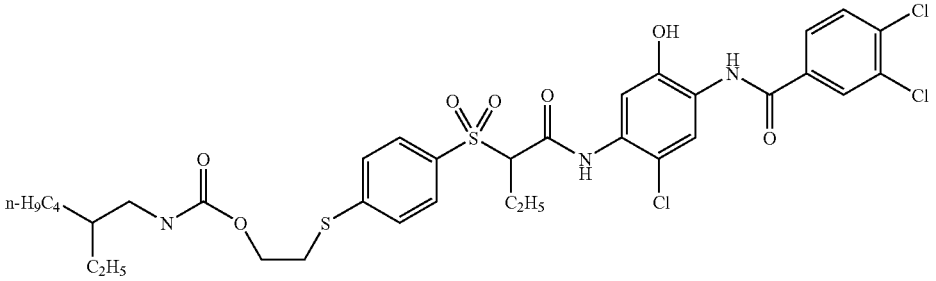
IC-48
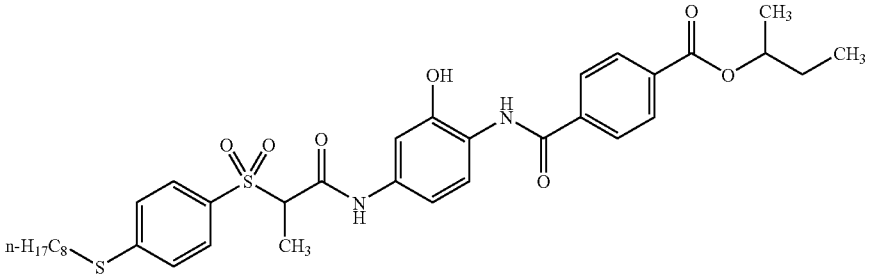

-continued
IC-49
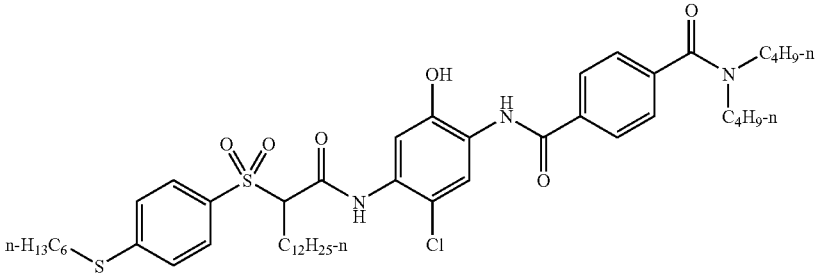
IC-50
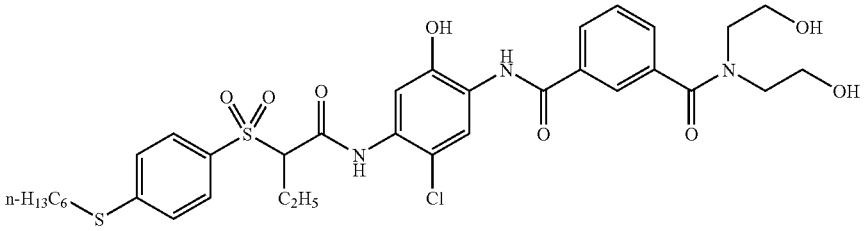
IC-51
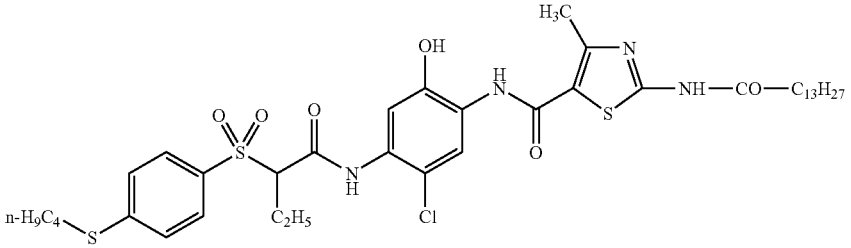
IC-52
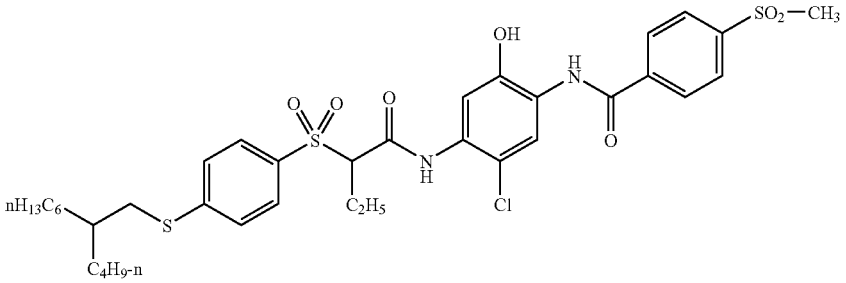
IC-53
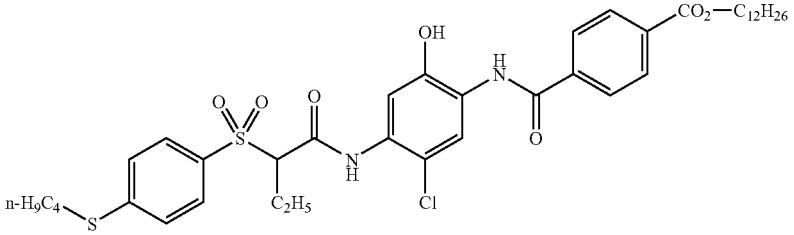
IC-54
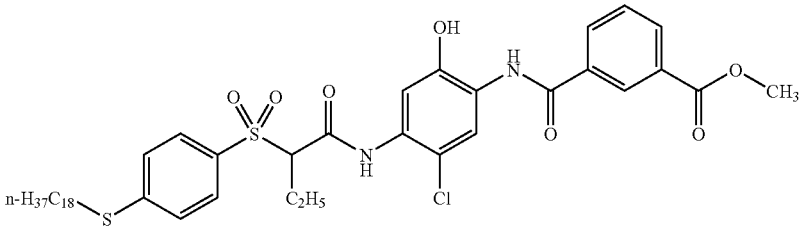

-continued
IC-55
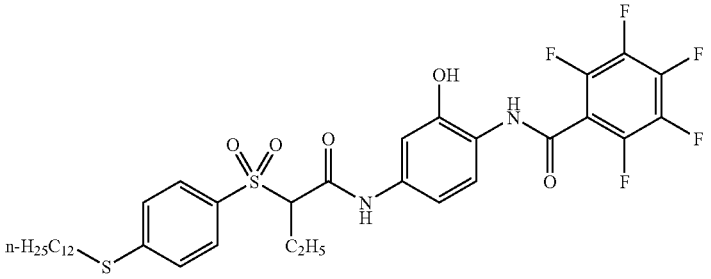
IC-56
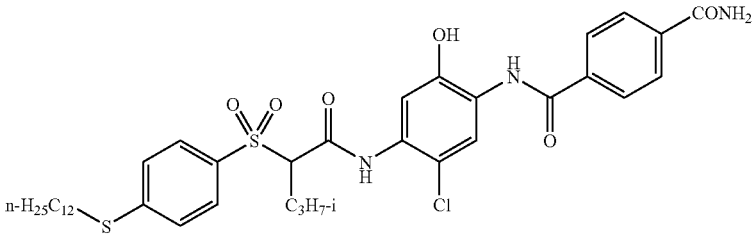
IC-57
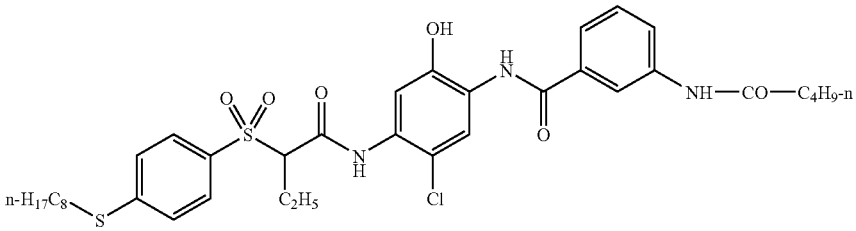
IC-58
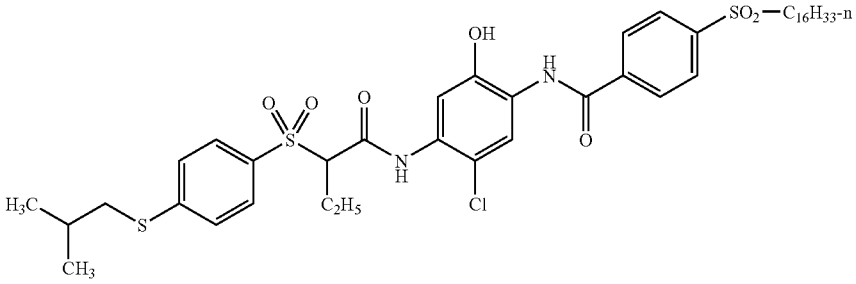
IC-59
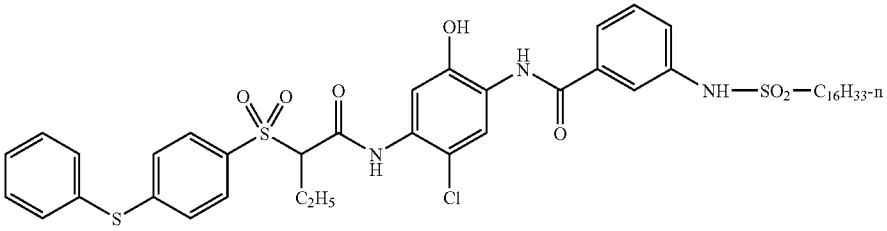
IC-60
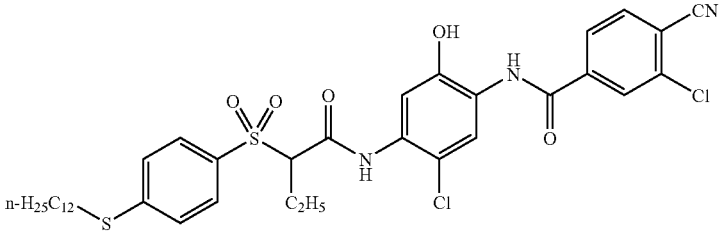

-continued
IC-61
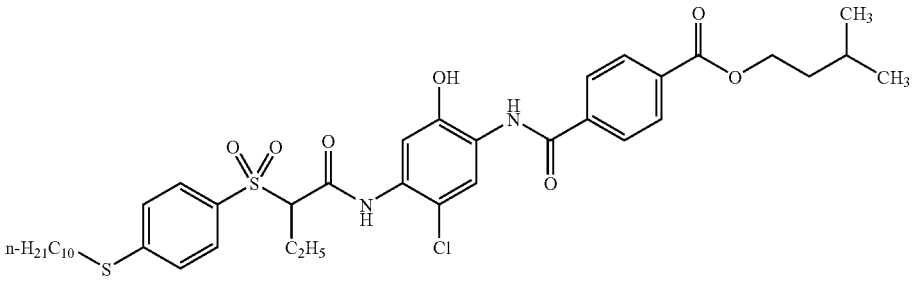
IC-62
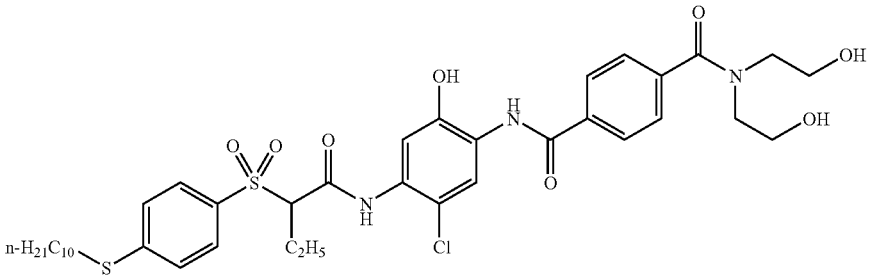
IC-63
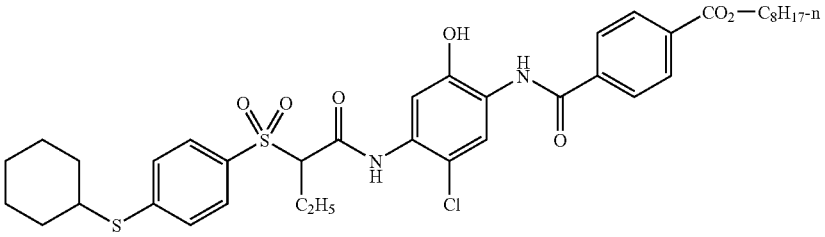
IC-64
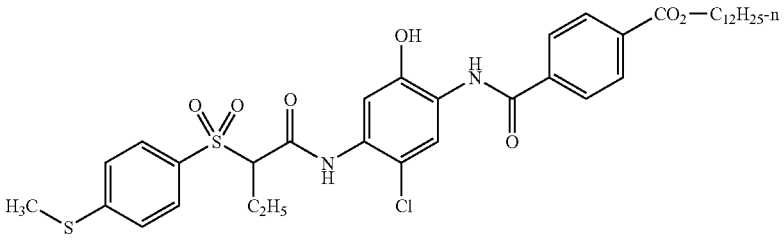
IC-65
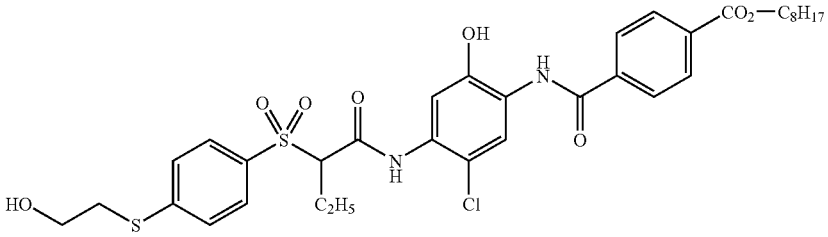
IC-66
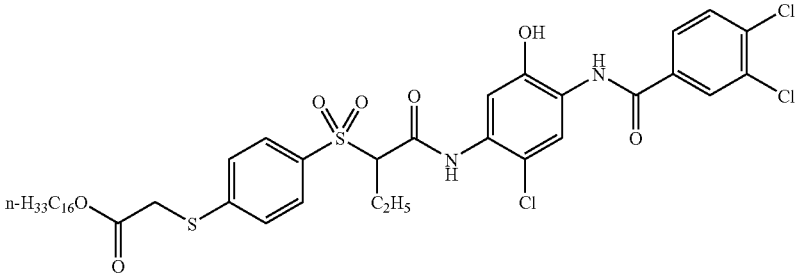

-continued

IC-67

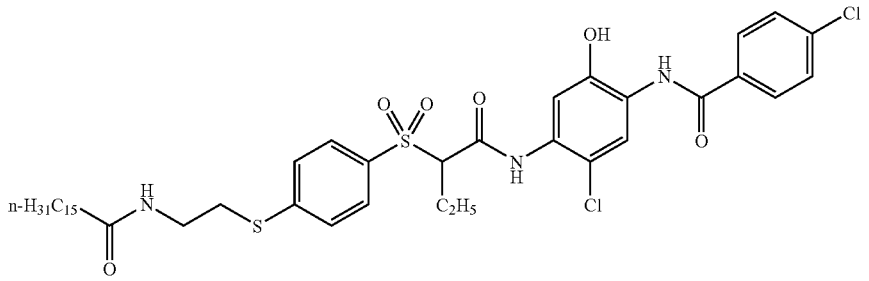

IC-68

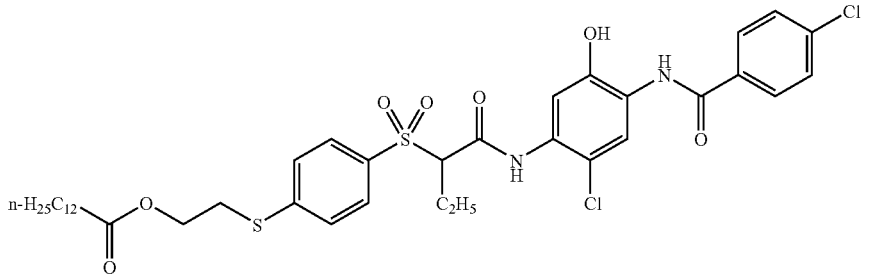

IC-69

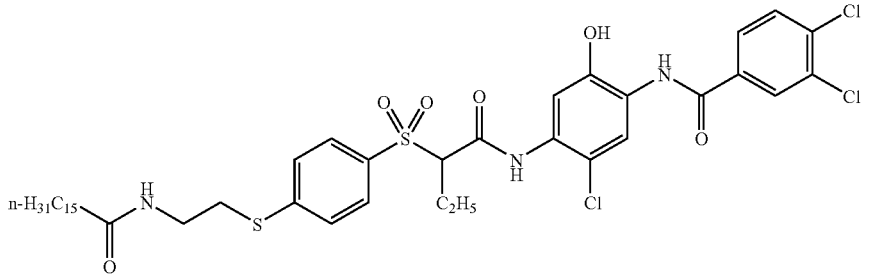

As the cyan coupler that can be used in the present invention, the aforementioned exemplified compounds IC-22 to IC-24, IC-30, and IC-31 are particularly preferable.

Next, a selenium compound that can be used in the present invention will be explained.

As the selenium compound, any of compounds represented by formula (SE1), (SE2), or (SE3) is preferable.

Formula (SE1)

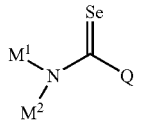

Formula (SE2)

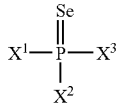

Formula (SE3)

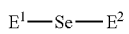

In the above formulae, $M^1$ and $M^2$ each independently represent a hydrogen atom, an alkyl group, an alkenyl group, an alkynyl group, an aryl group, a heterocyclic group, an acyl group, an amino group, an alkoxy group, a hydroxy group, or a carbamoyl group; Q represents an alkyl group, an alkenyl group, an alkynyl group, an aryl group, a heterocyclic group, —$OM^3$, or —$NM^4M^5$, in which $M^3$, $M^4$, and $M^5$ each independently represent a hydrogen atom, an alkyl group, an alkenyl group, an alkynyl group, an aryl group, or a heterocyclic group; and any two groups of $M^1$, $M^2$, and Q may bond together, to form a ring structure; $X^1$, $X^2$, and $X^3$ each independently represent an alkyl group, an alkenyl group, an alkynyl group, an aryl group, a heterocyclic group, —$OJ^1$, or —$NJ^2J^3$, in which $J^1$, $J^2$, and $J^3$ each independently represent a hydrogen atom, an alkyl group, an alkenyl group, an alkynyl group, an aryl group, or a heterocyclic group; $E^1$ and $E^2$ each independently represent an alkyl group, an alkenyl group, an alkynyl group, an aryl group, a heterocyclic group, an acyl group, an alkoxycarbonyl group, an aryloxycarbonyl group, or a carbamoyl group, in which $E^1$ and $E^2$ may be the same or different.

In the following, the selenium compound represented by formula (SE1) will be explained in detail.

The term "alkyl group" as represented by any of $M^1$ to $M^5$ and Q means a straight-chain, branched or cyclic, substituted or unsubstituted alkyl group. Preferred examples thereof include a straight-chain or branched, substituted or unsubstituted alkyl group having 1 to 30 carbon atoms (e.g., a methyl group, an ethyl group, an isopropyl group, an n-propyl group, an n-butyl group, a t-butyl group, a 2-pentyl group, an n-hexyl group, an n-octyl group, a t-octyl group, a 2-ethylhexyl group, a 1,5-dimethylhexyl group, an n-decyl group, an n-dodecyl group, an n-tetradecyl group, an n-hexadecyl group, a hydroxyethyl group, a hydroxypropyl group, a 2,3-dihydroxypropyl group, a carboxymethyl group, a carboxyethyl group, a sodium-sulfoethyl group, a diethylaminoethyl group, a diethylaminopropyl group, a butoxypropyl group, an ethoxyethoxyethyl group, and an n-hexyloxypropyl group); a substituted or unsubstituted cycloalkyl group having 3 to 18 carbon atoms (e.g., a cyclopropyl group, a cyclopentyl group, a cyclohexyl group, a cyclooctyl group, an adamanthyl group, and a cyclododecyl group); a substituted or unsubstituted bicycloalkyl group having 5 to 30 carbon atoms (that is, a monovalent group formed by removing one hydrogen atom from a bicycloalkane having 5 to 30 carbon atoms, e.g., a bicyclo[1,2,2]heptane-2-yl group, a bicyclo[2,2,2]octane-3-yl group); and a tricycloalkyl group and the like, which may have more ring structures. Examples of the alkenyl group represented by any of $M^1$ to $M^5$ and Q include an alkenyl group having 2 to 16 carbon atoms (e.g., an allyl group, a 2-butenyl group, and a 3-pentenyl group). Examples of the alkynyl group represented by any of $M^1$ to $M^5$ and Q include an alkynyl group having 2 to 10 carbon atoms (e.g., a propargyl group, and a 3-pentynyl group).

Examples of the aryl group represented by any of $M^1$ to $M^5$ and Q include a substituted or unsubstituted aryl group having 6 to 20 carbon atoms, including a phenyl group and a naphthyl group (e.g. unsubstituted phenyl, unsubstituted naphthyl, 3,5-dimethylphenyl, 4-butoxyphenyl, and 4-dimethylaminophenyl). Examples of the heterocyclic group include pyridyl, furyl, imidazolyl, piperidyl and morpholyl.

Examples of the acyl group represented by $M^1$ and $M^2$ include an acetyl group, a formyl group, a benzoyl group, a pivaloyl group, a caproyl group, and an n-nonanoyl group; examples of the amino group include an unsubstituted amino group, a methylamino group, a hydroxyethylamino group, an n-octylamino group, a dibenzylamino group, a dimethylamino group, and a diethylamino group; examples of the alkoxy group include a methoxy group, an ethoxy group, an n-butyloxy group, a cyclohexyloxy group, an n-octyloxy group, and an n-decyloxy group; and examples of the carbamoyl group include an unsubstituted carbamoyl group, an N,N-diethylcarbamoyl group, and an N-phenylcarbamoyl group.

$M^1$ and $M^2$, Q and $M^1$, or Q and $M^2$ may bond together, to form a ring structure. Moreover, when Q represents —$NM^4M^5$, $M^4$ and $M^5$ may bond together to form a ring structure.

$M^1$ to $M^5$ and Q may have a substituent(s) as many as possible. Examples of the substituent include a halogen atom (fluorine, chlorine, bromine, or iodine), an alkyl group (any of linear, branched, or cyclic alkyl groups including a bicycloalkyl group and an active methine group), an alkenyl group, an alkynyl group, an aryl group, a heterocyclic group (any substitution position is permitted), an acyl group, an alkoxycarbonyl group, an aryloxycarbonyl group, a heterocyclic oxycarbonyl group, a carbamoyl group, an N-hydroxycarbamoyl group, an N-acylcarbamoyl group, an N-sulfonylcarbamoyl group, an N-carbamoylcarbamoyl group, a thiocarbamoyl group, an N-sulfamoylcarbamoyl group, a carbazoyl group, a carboxyl group or a salt thereof, an oxalyl group, an oxamoyl group, a cyano group, a carbonimidoyl group, a formyl group, a hydroxyl group, an alkoxy group (including a group containing ethyleneoxy or propyleneoxy units as repeating units), an aryloxy group, a heterocyclic oxy group, an acyloxy group, an alkoxy- or aryloxy-carbonyloxy group, a carbamoyloxy group, a sulfonyloxy group, an amino group, an alkyl-, aryl- or heterocyclic-amino group, an acylamino group, a sulfonamido group, a ureido group, a thioureido group, an N-hydroxyureido group, an imido group, an alkoxy- or aryloxy-carbonylamino group, a sulfamoylamino group, a semicarbazido group, a thiosemicarbazido group, a hydrazino group, an ammonio group, an oxamoylamino group, an N-alkyl- or N-aryl-sulfonylureido group, an N-acylureido group, an N-acylsulfamoylamino group, a hydroxylamino group, a nitro group, a heterocyclic group containing a quaternary nitrogen atom (e.g., pyridinio, imidazolio, quinolinio, or isoquinolinio), an isocyano group, an imino group, a mercapto group, an alkyl-, aryl-, or heterocyclic-thio group, an alkyl-, aryl-, or heterocyclic-dithio group, an alkyl- or aryl-sulfonyl group, an alkyl- or aryl-sulfinyl group, a sulfo group or a salt thereof, a sulfamoyl group, an N-acylsulfamoyl group, an N-sulfonylsulfamoyl group or a salt thereof, a phosphino group, a phosphinyl group, a phosphinyloxy group, a phosphinylamino group, and a silyl group. Herein, the active methine group refers to a methine group substituted by two electron-withdrawing groups. Herein, the electron-withdrawing group, which is explained in detail below, means to include, for example, an acyl group, an alkoxycarbonyl group, an aryloxycarbonyl group, a carbamoyl group, an alkylsulfonyl group, an arylsulfonyl group, a sulfamoyl group, a trifluoromethyl group, a cyano group, a nitro group, and a carbonimidoyl group. These two electron-withdrawing groups may bond together, to form a ring structure. Additionally, the term "salt" as used herein is intended to include cations of alkali metals, alkali earth metals, and heavy metals; and organic cations, such as ammonium ions, and phosphonium ions. Those substituents may further be substituted with any of those substituents.

In a preferable compound represented by formula (SE1), $M^1$ and $M^2$ each are a hydrogen atom, an alkyl group, an alkenyl group, an aryl group, a heterocyclic group, or an acyl group; Q is an alkyl group, an alkenyl group, an aryl group, or —$NM^4M^5$; and $M^4$ and $M^5$ each represent a hydrogen atom, an alkyl group, an alkenyl group, an aryl group, or a heterocyclic group. In a more preferable compound represented by formula (SE1), $M^1$ and $M^2$ each are a hydrogen atom, an alkyl group, an alkenyl group, or an aryl group; Q is an alkyl group, an aryl group, or —$NM^4M^5$; and $M^4$ and $M^5$ each represent a hydrogen atom, an alkyl group, an alkenyl group, or an aryl group. In a still more preferable compound represented by formula (SE1), $M^1$ and $M^2$ each are a hydrogen atom, an alkyl group, an alkenyl group, or an aryl group; Q is —$NM^4M^5$; and $M^4$ and $M^5$ each represent a hydrogen atom, an alkyl group, an alkenyl group, or an aryl group.

The compound represented by formula (SE1) can be synthesized, according to known methods, for example, the methods described in Chem. Rev., 55, 181-228 (1955); J. Org. Chem., 24, 470-473 (1959); J. Heterocycl. Chem., 4, 605-609 (1967); J. Drug (Yakushi), 82, 36-45 (1962); JP-B-39-26203, J-A-63-229449 ("JP-A" means unexamined published Japanese patent application), and German Patent Publication (OLS) No. 2,043,944.

Next, the compound represented by formula (SE2) will be described in detail.

The alkyl group, alkenyl group, alkynyl group, aryl group and heterocyclic group as represented by any of $X^1$ to $X^3$ and $J^1$ to $J^3$ have the same meanings as those represented by $M^1$ to $M^5$ and Q in formula (SE1). $X^1$ to $X^3$ and $J^1$ to $J^3$ each may have a substituent(s) up to its possible limit, and examples of the substituent include the same specific examples of the substituent as mentioned above.

As the compound represented by formula (SE2), the following case is preferable: $X^1$ to $X^3$ each independently are an alkyl group, an aryl group, or a heterocyclic group. As the compound represented by formula (SE2), the following case is more preferable: $X^1$ to $X^3$ each independently are an aryl group.

The compound represented by formula (SE2) can be synthesized, according to known methods, for example, the methods described in Organic Phosphorus Compounds, vol.

4, pp. 1-73; J. Chem. Soc. B, p. 1416 (1968); J. Org. Chem., vol. 32, p. 1717 (1967); J. Org. Chem., vol. 32, p. 2999 (1967); Tetrahedron, vol. 20, p. 449 (1964); and J. Am. Chem. Soc., vol. 91, p. 2915 (1969).

Next, the compound represented by formula (SE3) will be explained in detail.

The alkyl, alkenyl, alkynyl, aryl, and heterocyclic groups represented by $E^1$ and $E^2$ have the same meanings as those represented by $M^1$ to $M^5$ and Q in formula (SE1). Examples of the acyl group represented by $E^1$ and $E^2$ include an acetyl group, a formyl group, a benzoyl group, a pivaloyl group, a caproyl group, and an n-nonanoyl group; examples of the alkoxycarbonyl group include a methoxycarbonyl group, an ethoxycarbonyl group, an n-butyloxycarbonyl group, a cyclohexyloxycarbonyl group, an n-octyloxycarbonyl group, and an n-decyloxycarbonyl group; examples of the aryloxycarbonyl group include a phenoxycarbonyl group, and a napthoxycarbonyl group; and examples of the carbamoyl group include an unsubstituted carbamoyl group, an N,N-diethylcarbamoyl group, and an N-phenylcarbamoyl group. $E^1$ and $E^2$ each may further have a substituent(s) as far as possible. Such substituents have the same meaning as the substituents that $M^1$ to $M^5$ and Q in formula (SE1) may have, and examples of the substituent include the same specific examples of the substituent as mentioned above.

In preferred compounds among those represented by formula (SE3) in the present invention, either $E^1$ or $E^2$ is a group selected from the groups represented by any of the following formulae (T1) to (T4). In these cases, $E^1$ and $E^2$ may be the same or different.

Formula (t1)

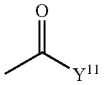

Formula (T2)

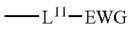

Formula (T3)

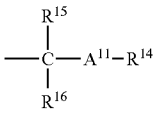

Formula (T4)

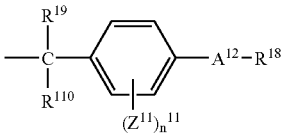

In formula (T1), $Y^{11}$ represents an alkyl group, an alkenyl group, an alkynyl group, an aryl group, a heterocyclic group, —$OR^{11}$, or —$NR^{12}R^{13}$, in which $R^{11}$, $R^{12}$, and $R^{13}$ each independently represent an alkyl group, an alkenyl group, an alkynyl group, an aryl group, or a heterocyclic group.

In formula (T2), $L^{11}$ represents a divalent linking group, and EWG represents an electron-withdrawing group.

In formula (T3), $A^{11}$ represents an oxygen atom, a sulfur atom, or —$NR^{17}$; and $R^{14}$, $R^{15}$, $R^{16}$, and $R^{17}$ each independently represent a hydrogen atom, an alkyl group, an alkenyl group, an alkynyl group, an aryl group, or a heterocyclic group.

In formula (T4), $A^{12}$ represents an oxygen atom, a sulfur atom, or —$NR^{111}$; $R^{18}$ represents a hydrogen atom, an alkyl group, an alkenyl group, an alkynyl group, an aryl group, a heterocyclic group, or an acyl group; $R^{19}$, $R^{110}$, and $R^{111}$ each independently represent a hydrogen atom, an alkyl group, an alkenyl group, an alkynyl group, an aryl group, or a heterocyclic group. $Z^{11}$ represents a substituent; $n^{11}$ is an integer from 0 to 4. When $n^{11}$ is 2 or more, plural $Z^{11}$s may be the same or different.

In formula (T1), $Y^{11}$ represents an alkyl group, an alkenyl group, an alkynyl group, an aryl group, a heterocyclic group, —$OR^{11}$, or —$NR^{12}R^{13}$, in which $R^{11}$, $R^{12}$, and $R^{13}$ each independently represent an alkyl group, an alkenyl group, an alkynyl group, an aryl group, or a heterocyclic group. The "alkyl group" as mentioned has the same meaning as one represented by $M^1$ to $M^5$ and Q in formula (SE1), and they are identical in the range of preferred one. Likewise, the alkenyl group, the alkynyl group, the aryl group, and the heterocyclic group have the same meanings as the alkenyl group, the alkynyl group, the aryl group, and the heterocyclic group represented by $M^1$ to $M^5$ and Q, and the ranges of preferred ones in regard to each of these groups are also identical.

In formula (T1), $Y^{11}$ is preferably an alkyl group, an alkenyl group, an alkynyl group, an aryl group, or a heterocyclic group; and more preferably an alkyl group or an aryl group.

In formula (T2), the divalent linking group represented by $L^{11}$ preferably represents an alkylene, alkenylene, or alkynylene group having 2 to 20 carbon atoms; more preferably represents a straight-chain, branched or cyclic alkylene group having 2 to 10 carbon atoms (e.g., ethylene, propylene, cyclopentylene, and cyclohexylene), an alkenylene group (e.g., vinylene), or an alkynylene group (e.g., propynylene). $L^{11}$ is more preferably a group represented by formula (L1) or (L2).

Formula (L1)

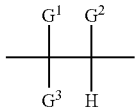

Formula (L2)

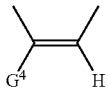

In formulae (L1) and (L2), $G^1$, $G^2$, $G^3$, and $G^4$ each independently represent a hydrogen atom, an alkyl group having 1 to 10 carbon atoms, an aryl group having 6 to 20 carbon atoms, or a heterocyclic group having 1 to 10 carbon atoms. Any two of $G^1$, $G^2$, and $G^3$ may bond together, to form a ring. $G^1$, $G^2$, $G^3$, and $G^4$ each are preferably a hydrogen atom, an alkyl group, or an aryl group, and more preferably a hydrogen atom or an alkyl group.

In formula (T2), EWG represents an electron-withdrawing group. The term "electron-withdrawing group" so-called herein means a group having a positive value of Hammett's substituent constant $\sigma_m$ value, and preferably a $\sigma_m$ value of 0.12 or more, with its upper limit being 1.0 or less. Specific examples of the electron-withdrawing group having a positive $\sigma_m$ value, include an alkoxy group, an aryloxy group, an alkylthio group, an arylthio group, an acyl group, a formyl group, an acyloxy group, an acylthio group, a carbamoyl group, an alkoxycarbonyl group, an aryloxycarbonyl group, a cyano group, a nitro group, a dialkylphosphono group, a diarylphosphono group, a dialkylphosphinyl group, a diarylphosphinyl group, a phosphoryl group, an alkylsulfinyl group, an arylsulfinyl group, an alkylsulfonyl group, an arylsulfonyl group, a sulfonyloxy group, an acylthio group, a sulfamoyl group, a thiocyanato group, a thiocarbonyl group, an imino group, an imino group substituted with an N atom, a carboxy group (or its salt), an alkyl group substituted with at least two or more halogen atoms; an acylamino group; an alkylamino group substituted with at least two or more halogen atoms; an aryl group substituted with other electron-withdrawing group having a positive $\sigma_m$ value; a heterocyclic group, a halogen atom, an azo group, and a selenocyanato group. In the present invention, EWG is preferably an alkoxy group, an acyl group, a formyl group, a carbamoyl group, an alkoxycarbonyl group, an aryloxycarbonyl group, a cyano group, a nitro group, a dialkylphosphono group, a diarylphosphono group, a dialkylphosphinyl group, a diarylphosphinyl group, an alkylsulfinyl group, an arylsulfinyl group, an alkylsulfonyl group, an arylsulfonyl group, a sulfamoyl group, a thiocarbonyl group, an imino group, an imino group substituted with an N atom; a phosphoryl group, a carboxy group (or its salt), an alkyl group substituted with at least two or more halogen atoms; an aryl group substituted with other electron-withdrawing group having a positive $\sigma_m$ value; a heterocyclic group, or a halogen atom; more preferably an alkoxy group, an acyl group, a formyl group, a carbamoyl group, an alkoxycarbonyl group, an aryloxycarbonyl group, a cyano group, a nitro group, an alkylsulfonyl group, an arylsulfonyl group, a carboxy group, or an alkyl group substituted with at least two or more halogen atoms; and further preferably an alkoxy group, an acyl group, a formyl group, a cyano group, a nitro group, an alkylsulfonyl group, an arylsulfonyl group, or an alkyl group substituted with at least two or more halogen atoms.

In formula (T2), it is preferable that $L^{11}$ is represented by formula (L1); $G^1$ to $G^3$ each are a hydrogen atom or an alkyl group; and EWG is an alkoxy group, an acyl group, a formyl group, a carbamoyl group, an alkoxycarbonyl group, an aryloxycarbonyl group, a cyano group, a nitro group, an alkylsulfonyl group, an arylsulfonyl group, a carboxy group, or an alkyl group substituted with at least two or more halogen atoms. It is more preferable that $L^{11}$ is represented by formula (L1); $G^1$ to $G^3$ each are a hydrogen atom or an alkyl group; and EWG is an alkoxy group, an acyl group, a formyl group, a cyano group, a nitro group, an alkylsulfonyl group, an arylsulfonyl group, or an alkyl group substituted with at least two or more halogen atoms.

In formula (T3), $R^{14}$ to $R^{17}$ each independently represent a hydrogen atom, an alkyl group, an alkenyl group, an alkynyl group, an aryl group, or a heterocyclic group. The alkyl group so-called herein has the same meaning as the aforementioned alkyl group represented by any of $M^1$ to $M^5$ and Q in formula (SE1), and the preferable range is also the same. Likewise, the alkenyl group, alkynyl group, aryl group, and heterocyclic group have the same meanings as the aforementioned alkenyl group, alkynyl group, aryl group, and heterocyclic group, represented by any of $M^1$ to $M^5$ and Q, and the preferable ranges are also the same.

In the present invention, $R^{14}$ is preferably an alkyl group; $R^{15}$ and $R^{16}$ each are preferably a hydrogen atom, an alkyl group, or an aryl group, more preferably a hydrogen atom or an alkyl group, and most preferably one of $R^{15}$ and $R^{16}$ is a hydrogen atom and the other is a hydrogen atom or an alkyl group. $R^{17}$ is preferably a hydrogen atom, an alkyl group, or an aryl group, more preferably a hydrogen atom or an alkyl group, and most preferably an alkyl group.

In formula (T3), $A^{11}$ represents an oxygen atom, a sulfur atom, or —$NR^7$. In the present invention, $A^{11}$ is preferably an oxygen atom or a sulfur atom, and more preferably an oxygen atom.

In formula (T3), it is preferable that $A^{11}$ represents an oxygen atom or a sulfur atom; $R^{14}$ represents an alkyl group; and $R^{15}$ and $R^{16}$ each represent a hydrogen atom, an alkyl group or an aryl group. It is more preferable that $A^{11}$ represents an oxygen atom; $R^{14}$ is an alkyl group; and $R^{15}$ and $R^{16}$ each are a hydrogen atom or an alkyl group.

In formula (T4), the alkyl group represented by $R^{18}$, $R^{19}$, $R^{110}$, and $R^{111}$ has the same meaning as the aforementioned alkyl group represented by any of $M^1$ to $M^5$ and Q in formula (SE1), and the preferable range is also the same. Likewise, the alkenyl group, alkynyl group, aryl group, and heterocyclic group have the same meanings as the aforementioned alkenyl group, alkynyl group, aryl group, and heterocyclic group represented by any of $M^1$ to $M^5$ and Q, respectively, and the preferable ranges are also the same. Examples of the acyl group represented by $R^{18}$ include an acetyl group, a formyl group; a benzoyl group, a pivaloyl group, a caproyl group, and an n-nonanoyl group.

$Z^{11}$ in formula (T4) represents a substituent, and examples thereof include the same ones as the substituent described in the above.

In the present invention, preferable examples of $Z^{11}$ include a halogen atom, an alkyl group, an aryl group, a heterocyclic group, an acyl group, an alkoxycarbonyl group, an aryloxycarbonyl group, a carbamoyl group, an N-acylcarbamoyl group, an N-sulfonylcarbamoyl group, an N-carbamoylcarbamoyl group, a thiocarbamoyl group, N-sulfamoylcarbamoyl group, a carbazoyl group, a carboxy group (including a salt thereof), a cyano group, a formyl group, a hydroxy group, an alkoxy group, an aryloxy group, a heterocyclic oxy group, an acyloxy group, a nitro group, an amino group, an alkyl-, aryl- or heterocyclic-amino group, an acylamino group, a sulfonamido group, a ureido group, a thioureido group, an alkylthio group, an arylthio group, a heterocyclic thio group, an alkyl- or aryl-sulfonyl group, an alkyl- or aryl-sulfinyl group, a sulfo group (including a salt thereof), and a sulfamoyl group. More preferable examples thereof include a halogen atom, an alkyl group, an aryl group, a heterocyclic group, a carboxy group (including a salt thereof), a hydroxy group, an alkoxy group, an aryloxy group, a heterocyclic oxy group, an acyloxy group, an amino group, an alkyl-, aryl-, or heterocyclic-amino group, an acylamino group, a ureido group, a thioureido group, an alkylthio group, an arylthio group, a heterocyclic thio group, and a sulfo group (including a salt thereof). Further more preferred examples thereof include an alkyl group, an aryl group, a carboxy group (including a salt thereof), a hydroxy group, an alkoxy group, an aryloxy group, an alkyl-, aryl-, or heterocyclic-amino group, a ureido group, an alkylthio group, an arylthio group, and a sulfo group (including a salt thereof).

In formula (T4), $n^{11}$ represents an integer of from 0 to 4. In the present invention, $n^{11}$ is preferably an integer of from 0 to 2, and more preferably 0 or 1.

In formula (T4), $A^{12}$ represents an oxygen atom, a sulfur atom, or —$NR^{111}$. In the present invention, $A^{12}$ preferably represents an oxygen atom or a sulfur atom, and more preferably an oxygen atom.

In formula (T4), it is preferable that $A^{12}$ is an oxygen atom or a sulfur atom; $R^{18}$ is a hydrogen atom, an alkyl group or an acyl group; $R^{19}$ and $R^{110}$ each are a hydrogen atom, an alkyl group or an aryl group; $n^{11}$ is an integer of 0 to 2; and $Z^{11}$ is an alkyl group, an aryl group, a carboxy group (including its salt), a hydroxy group, an alkoxy group, an aryloxy group, an alkyl-, aryl- or heterocyclic-amino group, a ureido group, an alkylthio group, an arylthio group, or a sulfo group (including its salt). It is more preferable that $A^{12}$ is an oxygen atom; $R^{11}$ is a hydrogen atom or an alkyl group; $R^{19}$ and $R^{110}$ each are a hydrogen atom or an alkyl group; $n^{11}$ is an integer of 0 to 2; and $Z^{11}$ is an alkyl group, an aryl group, a carboxy group (including its salt), an alkoxy group, a ureido group or a sulfo group (including its salt). It is further preferable that $A^{12}$ is an oxygen atom; $R^{18}$ is an alkyl group; $R^{19}$ and $R^{110}$ each are a hydrogen atom; $n^{11}$ is an integer of 0 to 2; and $Z^{11}$ is an alkyl group, a carboxy group (including its salt), an alkoxy group or a sulfo group (including its salt).

In the present invention, among the compounds represented by formula (SE3), in a preferable compound, at least one of $E^1$ and $E^2$ is selected from the groups represented by any of formula (T1) or (T4). In a more preferable compound, at least one of $E^1$ and $E^2$ is selected from the groups represented by formula (T1) and the other is selected from the groups represented by any of formulae (T1), (T2) and (T4), or alternatively at least one of $E^1$ and $E^2$ is selected from the groups represented by formula (T4) and the other is selected from the groups represented by formula (T3) or (T4). In a still more preferable compound, at least one of $E^1$ and $E^2$ is selected from the groups represented by formula (T1) and the other is selected from the groups represented by formula (T2) or (T4), or alternatively $E^1$ and $E^2$ each are selected from the groups represented by formula (T4). In the most preferable compound, at least one of $E^1$ and $E^2$ is selected from the groups represented by formula (T1) and the other is selected from the groups represented by formula (T2), or alternatively $E^1$ and $E^2$ each are selected from the groups represented by formula (T4).

The compound represented by formula (SE3) can be synthesized, according to the methods described, for example, in the following documents: The Chemistry of Organic Selenium and Tellurium Compounds, Vol. 1 (1986), and ibid. Vol. 2 (1987), edited by S. Patai and Z. Rappoport; and Organoselenium Chemistry (1987) by D. Liotta.

Specific examples of the compound represented by formula (SE1), (SE2) or (SE3) will be shown below, but the present invention is not limited to these. Further, with respect to the compounds that may have a plurality of stereoisomers, their stereostructure is not limited to those.

SE1-1

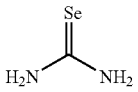

SE1-2

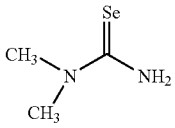

SE1-3

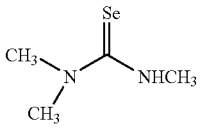

SE1-4

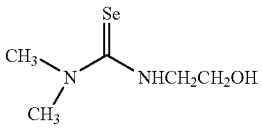

SE1-5

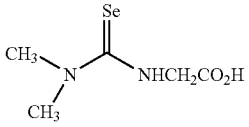

-continued

SE1-6

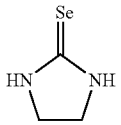

SE1-7

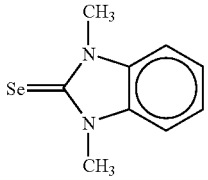

SE1-8

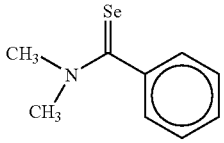

SE1-9

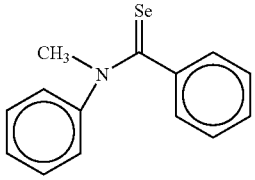

SE1-10

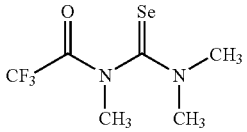

SE1-11

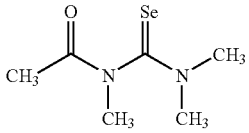

SE1-12

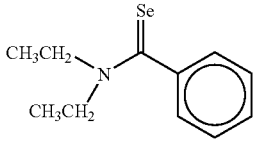

SE1-13

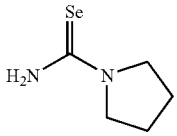

SE1-14

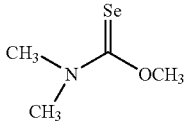

SE1-15

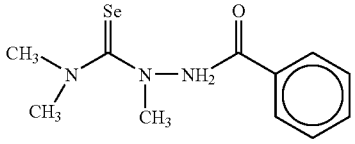

-continued
SE1-16
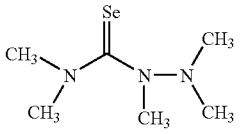
SE1-17
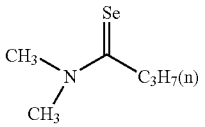
SE2-1
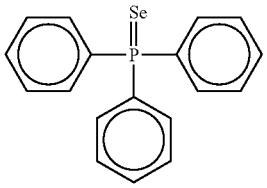
SE2-2
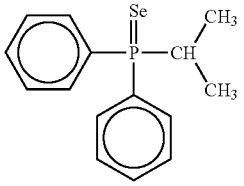
SE2-3
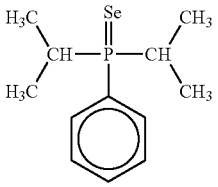
SE2-4
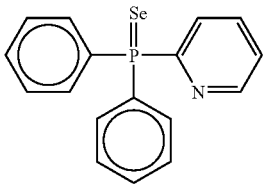
SE2-5
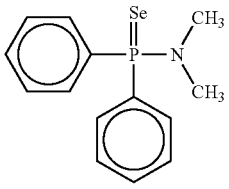
-continued
SE2-6
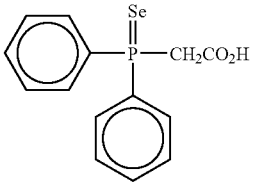
SE2-7
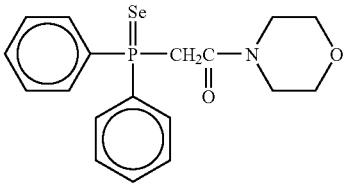
SE2-8
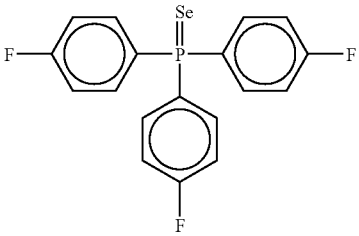
SE2-9
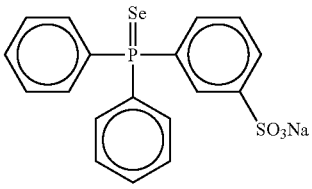
SE2-10
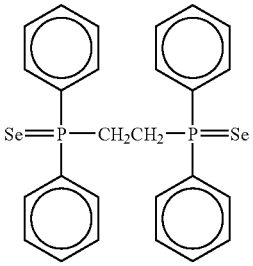
SE2-11
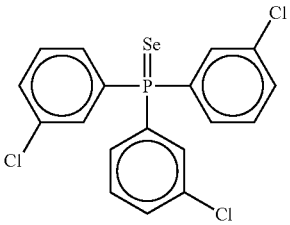
SE2-12
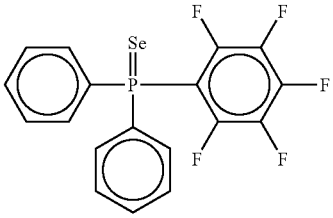

-continued
SE2-13
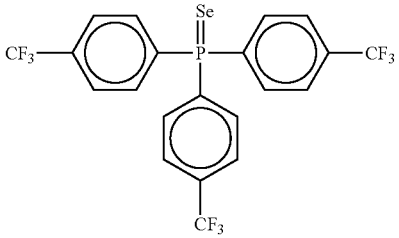
SE2-14
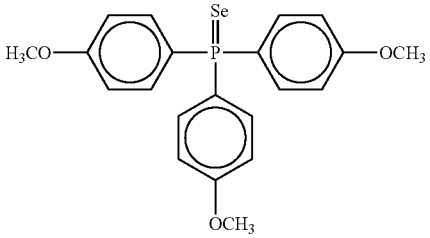
SE2-15
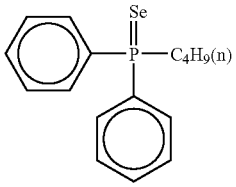
SE2-16
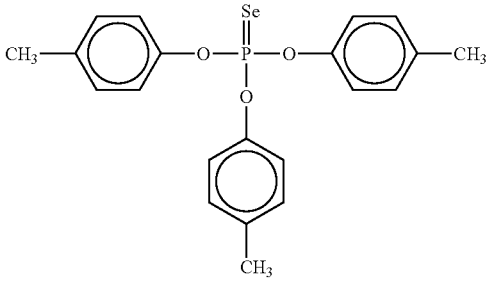
SE2-17
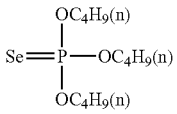
SE2-18
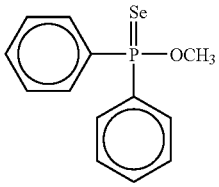
SE2-19
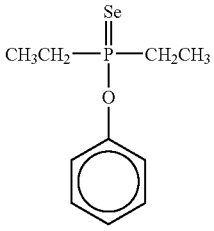
-continued
SE2-20
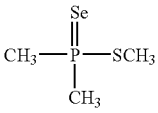
SE3-1
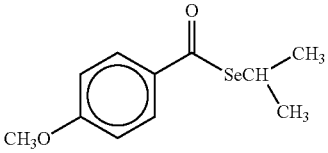
SE3-2
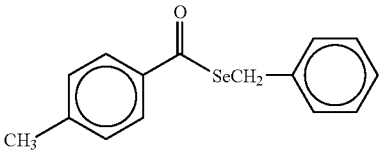
SE3-3
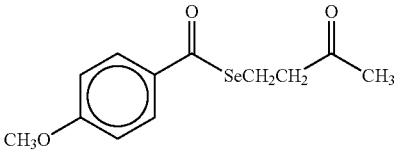
SE3-4
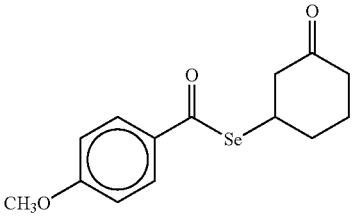
SE3-5
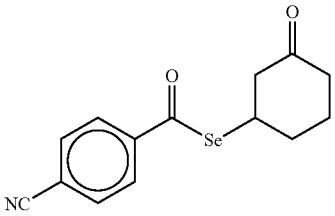
SE3-6
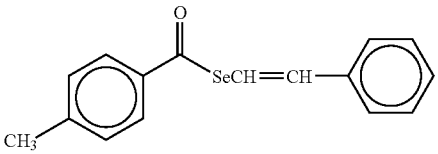
SE3-7
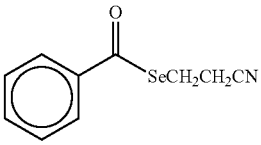

-continued
SE3-8
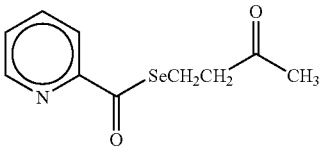
SE3-9
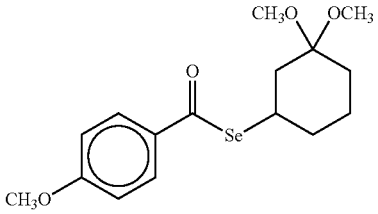
SE3-10
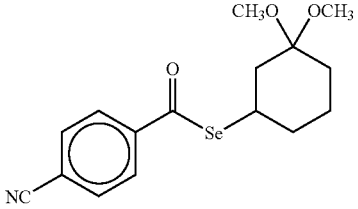
SE3-11
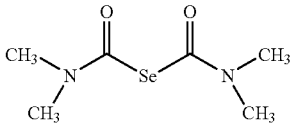
SE3-12
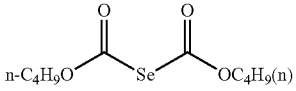
SE3-13
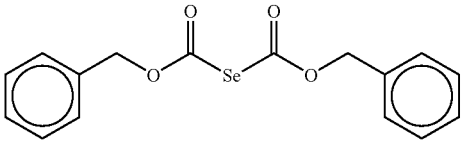
SE3-14
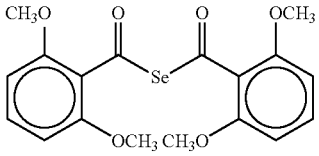
SE3-15
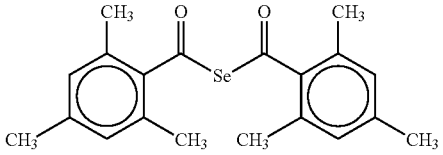
SE3-16
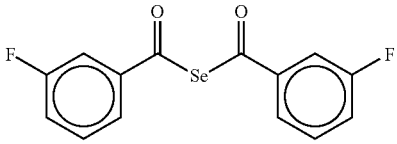
-continued
SE3-17
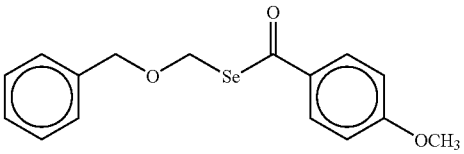
SE3-18
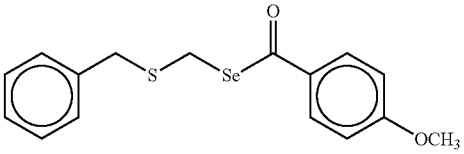
SE3-19
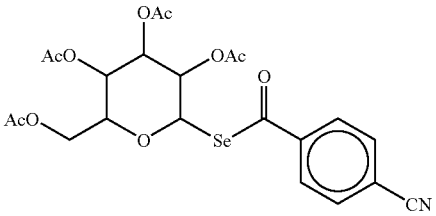
SE3-20
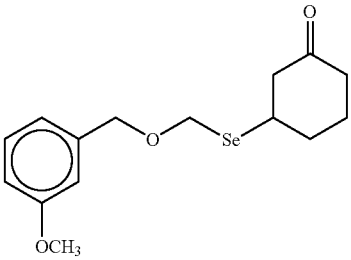
SE3-21
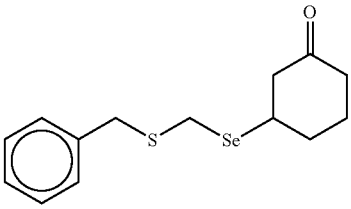
SE3-22
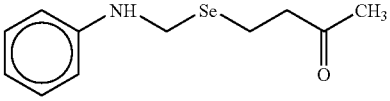
SE3-23
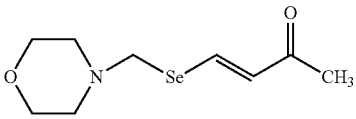
SE3-24
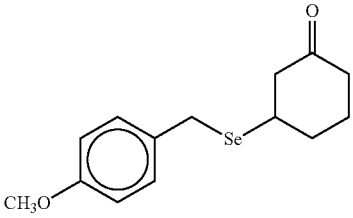

-continued

SE3-25

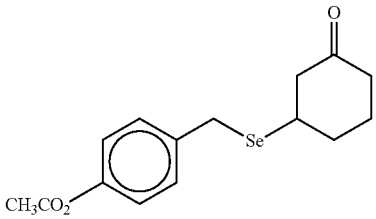

SE3-26

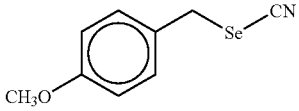

SE3-27

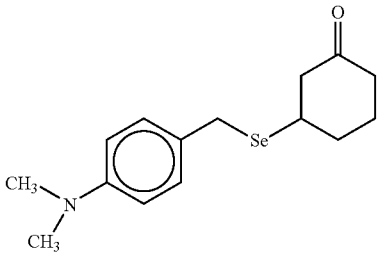

SE3-28

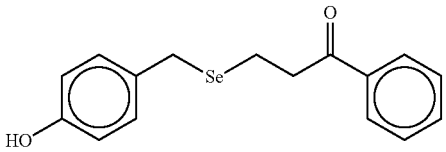

SE3-29

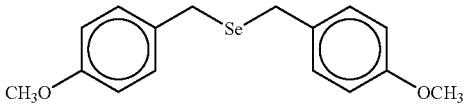

SE3-30

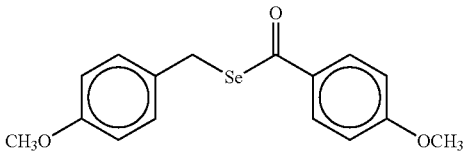

SE3-31

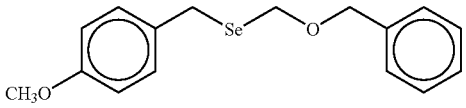

SE3-32

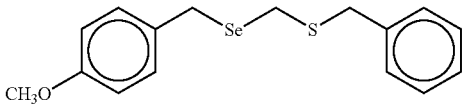

SE3-33

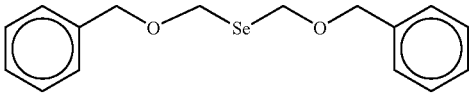

SE3-34

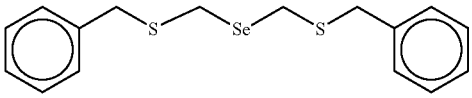

-continued

SE3-35

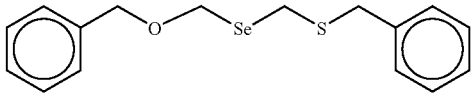

SE3-36

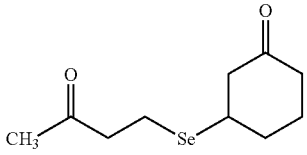

SE3-37

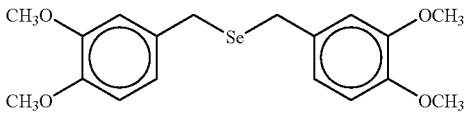

SE3-38

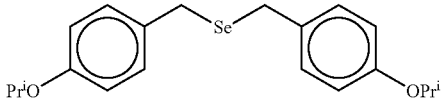

In addition to the foregoing ones, in the present invention, use can be made of any of selenium compounds as described, for example, in JP-B-43-13489, JP-B-44-15748, JP-A-4-25832-JP-A-4-109240, JP-A-4-271341, JP-A-5-40324, JP-A-5-11385, JP-A-6-51415, JP-A-6-175258, JP-A-6-180478, JP-A-6-208186, JP-A-6-208184, JP-A-6-317867, JP-A-7-92599, JP-A-7-98483, JP-A-7-140579, JP-A-7-301879, JP-A-7-301880, JP-A-8-114882, JP-A-9-138475, JP-A-9-197603, and JP-A-10-10666, specifially colloidal metallic selenium, selenoketones (e.g., selenobenzophenone), isoselenocyanates, and selenocarboxylic acid compounds. Further, the non-labile selenium compounds as described, for example, in JP-B-46-4553 and JP-B-52-34492, including selenous acid compounds, selenocyanic acid compounds (such as potassium selenocyanate), selenazoles, and selenides, can also be optionally used. Of these compounds, selenocyanic acid compounds are preferred over the others.

Up to this point, the structures that can be used as the selenium compounds are shown, but the present invention should not be construed to be limited to those.

From the viewpoints of hard gradation enhancement and fog reduction, it is preferable that the 3d-orbital electron of a selenium atom in the selenium compound that can be used in the present invention has bound energy of from 54.0 eV to 65.0 eV, as measured with an X-ray photoelectron spectroscope.

The amount of a selenium sensitizer for use in the present invention, though it varies depending on, for example, the selenium compound to be used, the silver halide grains used in combination therewith, and the chemical ripening conditions adopted, is generally from about $1\times10^{-8}$ to about $1\times10^{-4}$ mole, preferably from about $1\times10^{-7}$ to about $1\times10^{-5}$ mole, per mole of silver halide. The present invention has no particular restriction as to conditions for chemical sensitization, but the pCl is preferably from 0 to 7, more preferably from 0 to 5, and further preferably from 1 to 3, and the temperature is preferably from 40 to 95° C., and more preferably from 50 to 85° C.

The selenium compounds according to the present invention can be added at any stage during the period from the instant following the grain formation to the instant preceding the completion of chemical sensitization. The preferable addition timing is within a period between the instant following completion of desalting and the chemical sensitization process inclusive.

Next, a gold selenium compound that can be used in the present invention will be explained.

As the gold selenium compound that can be used in the present invention, a compound represented by any one of formulae (PF1) to (PF6) can be preferably used.

Formula (PF1)

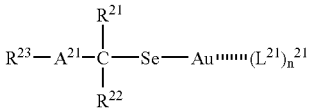

Formula (PF2)

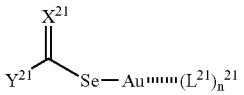

Formula (PF3)

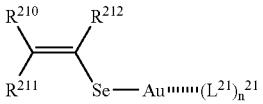

Formula (PF4)

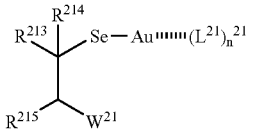

Formula (PF5)

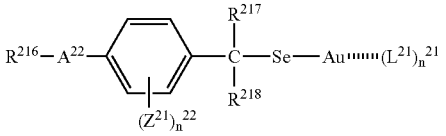

Formula (PF6)

$[Q^{21}\text{''''}Au\text{''''}(Q^{22})_{n^{23}}]\ J^{21}$

In formulae (PF1) to (PF6), $L^{21}$ represents a compound capable of coordinating with gold via an N atom, an S atom, an Se atom, a Te atom, or a P atom; $n^{21}$ represents 0 or 1; $A^{21}$ represents O, S, or —$NR^{24}$; $R^{21}$, $R^{22}$, $R^{23}$, and $R^{24}$ each independently represent a hydrogen atom or a substituent; $R^{23}$ may form a 5- to 7-membered ring together with $R^{21}$ or $R^{22}$;

$X^{21}$ represents =O, =S, or =$NR^{25}$; $Y^{21}$ represents an alkyl group, an alkenyl group, an alkynyl group, an aryl group, a heterocyclic group, —$OR^{26}$, —$SR^{27}$, or —$N(R^{28})R^{29}$; $R^{25}$, $R^{26}$, $R^{27}$, $R^{28}$, and $R^{29}$ and independently represent a hydrogen atom, an alkyl group, an alkenyl group, an alkynyl group, an aryl group, or a heterocyclic group; $X^{21}$ and $Y^{21}$ may bond together, to form a ring;

$R^{210}$, $R^{211}$ and $R^{212}$ each independently represent a hydrogen atom or a substituent, and at least one of $R^{210}$ and $R^{211}$ represents an electron attractive group;

$W^{21}$ represents an electron attractive group; $R^{213}$, $R^{214}$, and $R^{215}$ each independently represent a hydrogen atom or a substituent; $W^{21}$ and $R^{213}$ may bond together, to form a cyclic structure;

$A^{22}$ represents —O—, —S—, —Se—, —Te—, or —$NR^{219}$—; $R^{216}$ represents a hydrogen atom, an alkyl group an alkenyl group, an alkynyl group, an aryl group, a heterocyclic group, or an acyl group; $R^{217}$, $R^{218}$, and $R^{219}$ each independently represent a hydrogen atom, an alkyl group, an alkenyl group, an alkynyl group, an aryl group, or a heterocyclic group; $Z^{21}$ represents a substituent; $n^{22}$ represents an integer of from 0 to 4; when $n^{22}$ is 2 or more, $Z^{21}$s may be the same or different, or may bond together to form a ring;

$Q^{21}$ and $Q^{22}$ each independently represent a compound selected from those represented by any of formulae (SE1) to (SE3) mentioned in the above; the Se atoms in $Q^{21}$ and $Q^{22}$ each are coordinated with the Au; $n^{23}$ represents 0 or 1; $J^{21}$ represents a counter anion; when $n^{23}$ is 1, $Q^{21}$ and $Q^{22}$ may be the same or different; and the compound represented by formula (PF6) does not include the compounds represented by any of formulae (PF1) to (PF5).

Next, the gold selenium compound represented by formula (PF1) will be explained.

In formula (PF1), $R^{21}$ and $R^{22}$ each preferably represents a hydrogen atom, an alkyl group, an aryl group, a heterocyclic group, a hydroxyl group, an alkoxy group, an aryloxy group, a heterocyclic oxy group, an amino group, a mercapto group, an alkylthio group, an arylthio group, or a heterocyclic thio group, more preferably a hydrogen atom, an alkyl group, an aryl group, or a heterocyclic group, most preferably a hydrogen atom or an alkyl group.

$R^{23}$ preferably represents a hydrogen atom, an alkyl group, an aryl group, or a heterocyclic group, more preferably an alkyl group, an aryl group, or a heterocyclic group, most preferably an alkyl group or an aryl group. $R^{24}$ preferably represents a hydrogen atom, an alkyl group, an alkenyl group, an alkynyl group, an aryl group, a heterocyclic group, an amino group, an acylamino group, an alkyl- or aryl-sulfonylamino group, an alkyl- or aryl-sulfonyl group, an acyl group, an aryloxycarbonyl group, an alkoxycarbonyl group, or a carbamoyl group, more preferably a hydrogen atom, an alkyl group, an aryl group, or a heterocyclic group.

$R^{23}$ may form a 5- to 7-membered ring structure together with $R^{21}$ or $R^{22}$. The ring structure to be formed is a non-aromatic, oxygen-, sulfur- or nitrogen-containing hetero ring. Also, this ring structure may form a fused ring together with an aromatic or non-aromatic carbon ring or a hetero ring. In the present invention, it is more preferable that $R^{23}$ forms a 5- to 7-membered ring structure together with $R^{21}$ or $R^{22}$.

In the present invention, among the compounds represented by formula (PF1), preferred are those wherein $A^{21}$ represents —O—, —S— or —$NR^{24}$—; $R^{21}$ and $R^{22}$ each represent a hydrogen atom, an alkyl group, an aryl group, a heterocyclic group, an alkoxy group, an aryloxy group, a heterocyclic oxy group, an alkylthio group, an arylthio group or a heterocyclic thio group; $R^{23}$ represents a hydrogen atom, an alkyl group, an aryl group, or a heterocyclic group; and $R^{24}$ represents a hydrogen atom, an alkyl group, an aryl group, a heterocyclic group, an amino group, an acylamino group, an alkyl- or aryl-sulfonylamino group, an alkyl- or aryl-sulfonyl group, or an acyl group. More preferred are those wherein $A^{21}$ represents —O— or —S—; $R^{21}$ and $R^{22}$ each represent a hydrogen atom, an alkyl group, an aryl group, or a heterocyclic group; and $R^{23}$ represents an alkyl group, an aryl group, or a heterocyclic group. Still more preferred are those wherein $A^{21}$ represents —O— or —S—; $R^{21}$ and $R^{22}$ each represent a hydrogen atom, an alkyl group, or an aryl group; and $R^{23}$ represents an alkyl group or an aryl group.

Particularly preferred are those wherein a ring structure formed by $R^{23}$, together with $R^{21}$ or $R^{22}$, is, for example, glucose, mannose, galactose, gulose, xylose, lyxose, arabinose, ribose, fucose, idose, talose, allose, altrose, rhamnose, sorbose, digitoxose, 2-deoxyglucose, 2-deoxygalactose, fructose, glucosamine, galactosamine, or glucuronic acid, or a sugar derivative thereof (in the case where $A^{21}$ in formula (PF1) represents O), or a sulfur analogue thereof (in the case where $A^{21}$ in formula (PF1) represents S).

Herein, sugar derivatives represent compounds each having a sugar structure in which any one or more of the hydroxy group, amino group or carboxy group is substituted with an alkoxy group (containing a group having an ethyleneoxy group or propylene oxy group unit repeatedly), an aryloxy group, a heterocyclic oxy group, an acyloxy group, an alkoxycarbonyloxy group, an aryloxycarbonyloxy group, a carbamoyloxy group, a sulfonyloxy group, a silyloxy group, an (alkyl-, aryl- or heterocyclic-) amino group, an acylamino group, a sulfonamido group, a ureido group, a thioureido group, an N-hydroxyureido group, an alkoxycarbonylamino group, an aryloxycarbonylamino group, a sulfamoylamino group, a semicarbazido group, a thiosemicarbazido group, an oxamoylamino group, an N-(alkyl- or aryl-)sulfonylureido group, an N-acylureido group, an N-acylsulfamoylamino group, a hydroxyamino group, an acyl group, an alkoxycarbonyl group, an aryloxycarbonyl group, a heterocyclic oxycarbonyl group, a carbamoyl group, an N-hydroxycarbamoyl group, an N-acylcarbamoyl group, an N-sulfonylcarbamoyl group, an N-carbamoylcarbamoyl group, an N-sulfamoylcarbamoyl group, or the like. In these sugar structures, there exist α-isomers and β-isomers, which are different from each other in the 1-position stereostructure, and D-isomers and L-isomers, which are in a relation of mirror image with each other. In the present invention, however, these isomers are not discriminated from each other. In this case, preferable examples of the compound include selenoglucose gold (I) salts, selenomannose gold (I) salts, selenogalactose gold (I) salts, selenolyxose gold (I) salts, and sugar derivatives of these.

Next, the compound represented by formula (PF2) will be explained.

In formula (PF2), $X^{21}$ preferably represents =O or =S, more preferably =O. $Y^{21}$ preferably represents an alkyl group containing 1 to 30 carbon atoms, an alkenyl group, an alkynyl group, an aryl group, a 5- to 7-membered heterocyclic group containing at least one of an N atom, an O atom or an S atom, —$OR^{26}$, —$SR^{27}$, or —$N(R^{28})R^{29}$; preferably an alkyl group, an aryl group, a heterocyclic group, —$OR^{26}$, —$SR^{27}$, or —$N(R^{28})R^{29}$; more preferably an alkyl group, an aryl group, a heterocyclic group, or —$N(R^{28})R^{29}$; still more preferably an alkyl group, an aryl group or a heterocyclic group.

$R^{25}$ to $R^{29}$ each independently represent a hydrogen atom, an alkyl group, an alkenyl group, an alkynyl group, an aryl group or a heterocyclic group, preferably a hydrogen atom, an alkyl group, an aryl group or a heterocyclic group, more preferably an alkyl group or an aryl group.

In formula (PF2), $X^{21}$ and $Y^{21}$ may bond together to form a ring. In this case, the ring to be formed is a 3- to 7-membered, nitrogen-containing hetero ring, and examples thereof include a pyrrole ring, an indole ring, an imidazole ring, a benzimidazole ring, a thiazole ring, a benzothiazole ring, an isoxazole ring, an oxazole ring, a benzoxazole ring, an indazole ring, a purine ring, a pyridine ring, a pyrazine ring, a pyrimidine ring, a quinoline ring and a quinazoline ring.

Among the compounds represented by formula (PF2), preferred compounds are those wherein $X^{21}$ represents =O or =S; $Y^{21}$ represents an alkyl group, an aryl group, a heterocyclic group, —$OR^{26}$, —$SR^{27}$ or —$N(R^{28})R^{29}$; and $R^{26}$ to $R^{29}$ each represent an alkyl group, an aryl group or a heterocyclic group. Still more preferred are those wherein $X^{21}$ represents =O, and $Y^{21}$ represents an alkyl group, an aryl group or a heterocyclic group. Most preferred are those wherein $X^{21}$ represents =O, and $Y^{21}$ represents an alkyl group, an aryl group or a heterocyclic group.

Next, the compound represented by formula (PF3) will be explained.

In formula (PF3), at least one of $R^{210}$ and $R^{211}$ represents an electron attractive group. The term "electron attractive group" as used herein means a substituent group having a positive Hammett's substituent constant $\sigma_p$ value, preferably a $\sigma_p$ value of 0.2 or more, with the upper limit being 1.0. Specific examples of the electron attractive group having a cup value of 0.2 or more include an acyl group, a formyl group, an acyloxy group, an acylthio group, a carbamoyl group, an alkoxycarbonyl group, an aryloxycarbonyl group, a cyano group, a nitro group, a dialkylphosphono group, diarylphosphono group, a dialkylphosphinyl group, a diarylphosphinyl group, a phosphoryl group, an alkylsulfinyl group, an arylsulfinyl group, an alkylsulfonyl group, an arylsulfonyl group, a sulfonyloxy group, an acylthio group, a sulfamoyl group, a thiocyanato group, a thiocarbonyl group, an imino group, an imino group substituted at N atom, a carboxy group (or its salt), an alkyl group substituted by at least two halogen atoms, an alkoxy group substituted by at least two halogen atoms, an aryloxy group substituted by at least two halogen atoms, an acylamino group, an alkylamino group substituted by at least two halogen atoms, an alkylthio group substituted by at least two halogen atoms, an aryl group substituted by other electron attractive group having a $\sigma_p$ value of 0.2 or more, a heterocyclic group, a halogen atom, an azo group, and a selenocyanato group. In the present invention, it is preferably an acyl group, a formyl group, a carbamoyl group, an alkoxycarbonyl group, an aryloxycarbonyl group, a cyano group, a dialkylphosphono group, a diarylphosphono group, a dialkylphosphinyl group, a diarylphosphinyl group, an alkylsulfinyl group, an arylsulfinyl group, an alkylsulfonyl group, an arylsulfonyl group, a sulfamoyl group, a thiocarbonyl group, an imino group, an imino group substituted at N atom, a phosphoryl group, a carboxy group (or its salt), an alkyl group substituted by at least two halogen atoms, an aryl group substituted by other electron attractive group having a $\sigma_p$ value of 0.2 or more, a heterocyclic group, or a halogen atom; more preferably an acyl group, a carbamoyl group, an alkoxycarbonyl group, an aryloxycarbonyl group, a cyano group, a carboxy group, an alkyl group substituted by at least two halogen atoms, an aryl group substituted by other electron attractive group having a cup value of 0.2 or more, or a heterocyclic group.

In formula (PF3), it is preferable that $R^{210}$ and $R^{211}$ each represent an electron attractive group. $R^{212}$ preferably represents a hydrogen atom, an alkyl group, an aryl group, a heterocyclic group, an alkoxy group, an aryloxy group, a heterocyclic oxy group, an amino group, an acylamino group, an alkylthio group, an arylthio group, a heterocyclic thio group, an alkyl- or aryl-sulfonyl group, an acyl group, an aryloxycarbonyl group, an alkoxycarbonyl group, or a carbamoyl group, more preferably a hydrogen atom, an alkyl group, an aryl group, a heterocyclic group, an alkoxy group, an aryloxy group, a heterocyclic oxy group, an amino group, or an acylamino group.

In formula (PF3), $R^{210}$ $R^{211}$ and $R^{212}$ are also preferably such that any of two groups among these are bonded to each other, to form a ring. The ring to be formed is a non-aromatic carbon ring or hetero ring, and is preferably a 5- to 7-membered ring. $R^{210}$ forming the ring is preferably an acyl group, a carbamoyl group, an oxycarbonyl-group, a thiocarbonyl group or a sulfonyl group, and $R^{211}$ is preferably an acyl group, a carbamoyl group, an oxycarbonyl group, a thiocarbonyl group, a sulfonyl group, an imino group, an imino group substituted at N atom, an acylamino group or a carbonylthio group.

Among the compounds represented by formula (PF3), preferred are those wherein $R^{210}$ and $R^{211}$ each represent an electron attractive group, and $R^{212}$ represents a hydrogen atom, an alkyl group, an aryl group, a heterocyclic group, an alkoxy group, an aryloxy group, a heterocyclic oxy group, an amino group or an acylamino group. More preferred are those wherein $R^{210}$ and $R^{211}$ each represent an electron attractive group, and $R^{212}$ represents a hydrogen atom, an alkyl group, an aryl group or a heterocyclic group. Most preferred are those wherein $R^{210}$ and $R^{211}$ each represent an electron attractive group, and $R^{212}$ represents a hydrogen atom, an alkyl group, an aryl group or a heterocyclic group.

Also, among the compounds represented by formula (PF3), those wherein $R^{210}$ and $R^{211}$ form a 5- to 7-membered non-aromatic ring are also preferred; and in this case, $R^{212}$ represents a hydrogen atom, an alkyl group, an aryl group, a heterocyclic group, an alkoxy group, an aryloxy group, a heterocyclic oxy group, an amino group or an acylamino group. More preferred are those wherein $R^{210}$ and $R^{211}$ form a 5- to 7-membered non-aromatic ring, and $R^{212}$ represents a hydrogen atom, an alkyl group, an aryl group or a heterocyclic group. Most preferred are those compounds wherein $R^{210}$ and $R^{211}$ form a 5- to 7-membered non-aromatic ring, and $R^{212}$ represents a hydrogen atom, an alkyl group, an aryl group or a heterocyclic group.

Next, the compound represented by formula (PF4) will be explained.

In formula (PF4), the electron attractive group represented by $W^{21}$ has the same meaning as the electron attractive group represented by the foregoing $R^{210}$ and $R^{211}$, and its preferred range is also the same.

In formula (PF4), preferred examples of $R^{213}$ to $R^{215}$ include a hydrogen atom, a halogen atom, an alkyl group, an alkenyl group, an alkynyl group, an aryl group, a heterocyclic group, a cyano group, a carboxy group, a sulfamoyl group, a sulfo group, an alkyl- or aryl-sulfonyl group, an acyl group, an aryloxycarbonyl group, an alkoxycarbonyl group, and a carbamoyl group. More preferred examples thereof include a hydrogen atom, a halogen atom, an alkyl group, an alkenyl group, an alkynyl group, an aryl group, a heterocyclic group, a cyano group, a carboxy group, a sulfo group, an alkyl- or aryl-sulfonyl group, an acyl group, an aryloxycarbonyl group, an alkoxycarbonyl group, and a carbamoyl group.

$W^{21}$ and $R^{213}$ may bond together, to form a ring. The ring to be formed is a non-aromatic carbon ring or hetero ring, preferably a 5- to 7-membered ring. $W^{21}$ for forming the ring is preferably an acyl group, a carbamoyl group, an oxycarbonyl group, a thiocarbonyl group, or a sulfonyl group, and $R^{213}$ is preferably an alkyl group, an alkenyl group, an aryl group or a heterocyclic group.

Among the compounds represented by formula (PF4), preferred are those compounds wherein $W^{21}$ represents an electron attractive group; and $R^{213}$ to $R^{215}$ each represent a hydrogen atom, a halogen atom, an alkyl group, an alkenyl group, an alkynyl group, an aryl group, a heterocyclic group, a cyano group, a carboxy group, a sulfo group, an alkyl- or aryl-sulfonyl group, an acyl group, an aryloxycarbonyl group, an alkoxycarbonyl group or a carbamoyl group. More preferred are those compounds wherein $W^{21}$ represents an electron attractive group; and $R^{213}$ to $R^{215}$ each represent a hydrogen atom, a halogen atom, an alkyl group, an alkenyl group, an aryl group, a heterocyclic group, a cyano group, a carboxy group, a sulfo group, an alkyl- or aryl-sulfonyl group, an acyl group, an aryloxycarbonyl group, an alkoxycarbonyl group or a carbamoyl group. Most preferred are those compounds wherein $W^{21}$ represents an electron attractive group; and $R^{213}$ to $R^{215}$ each represent a hydrogen atom, a halogen atom, an alkyl group, an alkenyl group, an alkynyl group, an aryl group, a heterocyclic group, a cyano group, a carboxy group, a sulfo group, an alkyl- or aryl-sulfonyl group, an acyl group, an aryloxycarbonyl group, an alkoxycarbonyl group or a carbamoyl group.

Also, among the compounds represented by formula (PF4), those compounds wherein $W^{21}$ and $R^{213}$ bond together to form a non-aromatic 5- to 7-membered ring are preferred as well; and in this case, $R^{213}$ represents an alkyl group, an alkenyl group, an aryl group, a heterocyclic group, or the like, and $R^{214}$ and $R^{215}$ each represent a hydrogen atom, a halogen atom, an alkyl group, an alkenyl group, an alkynyl group, an aryl group, a heterocyclic group, a cyano group, a carboxy group, a sulfo group, an alkyl- or aryl-sulfonyl group, an acyl group, an aryloxycarbonyl group, an alkoxycarbonyl group, a carbamoyl group, or the like. More preferred are those compounds wherein $W^{21}$ and $R^{213}$ bond together to form a non-aromatic 5- to 7-membered ring, and $R^{214}$ and $R^{215}$ each represent a hydrogen atom, a halogen atom, an alkyl group, an alkenyl group, an alkynyl group, an aryl group, a heterocyclic group, a cyano group, a carboxy group, a sulfo group, an alkyl- or aryl-sulfonyl group, an acyl group, an aryloxycarbonyl group, an alkoxycarbonyl group or a carbamoyl group. Most preferred are those compounds wherein $W^{21}$ and $R^{213}$ bond together to form a non-aromatic 5- to 7-membered ring; and $R^{214}$ and $R^{215}$ each represent a hydrogen atom, a halogen atom, an alkyl group, an alkenyl group, an alkynyl group, an aryl group, a heterocyclic group, a cyano group, a carboxy group, a sulfo group, an alkyl- or aryl-sulfonyl group, an acyl group, an aryloxycarbonyl group, an alkoxycarbonyl group or a carbamoyl group.

Next, the compound represented by formula (PF5) will be explained.

In formula (PF5), $R^{216}$ is preferably a hydrogen atom, an alkyl group, an aryl group or an acyl group, more preferably a hydrogen atom, an alkyl group or an acyl group, and most preferably an alkyl group. $R^{217}$ and $R^{218}$ each are preferably a hydrogen atom, an alkyl group or an aryl group, more preferably a hydrogen atom or an alkyl group, and most preferably such the case that one of $R^{217}$ and $R^{218}$ is a hydrogen atom and the other is a hydrogen atom or an alkyl group. $R^{219}$ is preferably a hydrogen atom, an alkyl group or an aryl group, more preferably a hydrogen atom or an alkyl group, and most preferably an alkyl group.

In formula (PF5), $A^{22}$ represents —O—, —S—, —Se—, —Te— or —$NR^{219}$, preferably —O—, —S—, or —$NR^{219}$, more preferably —O— or —S—, and most preferably —O—, in the present invention.

In formula (PF5), $Z^{21}$ represents a substituent. Examples of the substituent include the same groups as the substituents explained in the above. In the present invention, preferable examples of $Z^{21}$ include a halogen atom, an alkyl group, an aryl group, a heterocyclic group, an acyl group, an alkoxycarbonyl group, an aryloxycarbonyl group, a carbamoyl group, an N-acylcarbamoyl group, an N-sulfonylcarbamoyl group, an N-carbamoylcarbamoyl group, a thiocarbamoyl group, an N-sulfamoylcarbamoyl group, a carbazoyl group, a carboxy group (including its salts), a cyano group, a formyl group, a hydroxy group, an alkoxy group, an aryloxy group, a heterocyclic oxy group, an acyloxy group, a nitro group, an amino group, an (alkyl-, aryl- or heterocyclic-)amino group, an acylamino group, a sulfonamido group, a ureido group, a thioureido group, an alkylthio group, an arylthio group, a heterocyclic thio group, an (alkyl- or aryl-)sulfonyl group, an (alkyl- or aryl-)sulfinyl group, a sulfo group (including its salts), and a sulfamoyl group. More preferable examples of $Z^{21}$ include a halogen atom, an alkyl group, an aryl group, a heterocyclic group, a carboxy group (including its salts), a hydroxy group, an alkoxy group, an aryloxy group, a heterocyclic oxy group, an acyloxy group, an amino group, an (alkyl-, aryl- or heterocyclic-)amino group, an acylamino group, a ureido group, a thioureido group, an alkylthio group, an arylthio group, a heterocyclic thio group, and a sulfo group (including its salts). Still more preferable examples of $Z^{21}$ include an alkyl group, an aryl group, a carboxy group (including its salts), a hydroxy group, an alkoxy group, an aryloxy group, an (alkyl-, aryl- or heterocyclic-)amino group, a ureido group, an alkylthio group, an arylthio group, and a sulfo group (including its salts).

In formula (PF5), $n^{22}$ represents an integer from 0 to 4. In the present invention, $n^{22}$ is preferably 0 to 2 and more preferably 0 or 1.

In formula (PF5), preferable is the case in which $A^{22}$ represents —O—, —S— or —$NR^{219}$—; $R^{216}$ represents a hydrogen atom, an alkyl group, an aryl group or an acyl group; $R^{217}$ and $R^{218}$ each represent a hydrogen atom, an alkyl group or an aryl group; $R^{219}$ represents a hydrogen atom, an alkyl group or an aryl group; $n^{22}$ denotes 0 to 2; and $Z^{21}$ represents an alkyl group, an aryl group, a carboxy group (including its salts), a hydroxy group, an alkoxy group, an aryloxy group, an (alkyl-, aryl- or heterocyclic-)amino group, a ureido group, an alkylthio group, an arylthio group, or a sulfo group (including its salts). More preferable is the case in which $A^{22}$ represents —O—, —S— or —$NR^{219}$—; $R^{216}$ represents an alkyl group; $R^{217}$ and $R^{218}$ each represent a hydrogen atom or an alkyl group; $R^{219}$ represents an alkyl group or an aryl group; $n^{22}$ denotes 0 to 2; and $Z^{21}$ represents an alkyl group, an aryl group, a carboxy group (including its salts), a hydroxy group, an alkoxy group, an aryloxy group, an (alkyl-, aryl- or heterocyclic-)amino group, a ureido group, an alkylthio group, an arylthio group, or a sulfo group (including its salts). Further preferable is the case in which $A^{22}$ represents —O—, —S— or —$NR^{219}$—; $R^{216}$ represents an alkyl group; $R^{217}$ and $R^{218}$ each represents a hydrogen atom or an alkyl group; $R^{219}$ represents an alkyl group; $n^{22}$ denotes 0 to 2; and $Z^{21}$ represents an alkyl group, an aryl group, a carboxy group (including its salts), a hydroxy group, an alkoxy group, an aryloxy group, an (alkyl-, aryl- or heterocyclic-)amino group, a ureido group, an alkylthio group, an arylthio group, or a sulfo group (including its salts). Most preferable is the case in which $A^{22}$ represents —O—; $R^{216}$ represents an alkyl group; one of $R^{217}$ and $R^{218}$ represent a hydrogen atom and the other represents a hydrogen atom or an alkyl group; $n^{22}$ denotes 0 to 1; and $Z^{21}$ represents an alkyl group, an aryl group, a carboxy group (including its salts), a hydroxy group, an alkoxy group, an aryloxy group, an (alkyl-, aryl- or heterocyclic-)amino group, a ureido group, an alkylthio group, an arylthio group, or a sulfo group (including its salts).

In formulae (PF1) to (PF5), $n^{21}$ represents 0 or 1. When $n^{21}$ represents 1, $L^{21}$ represents compound, which can be coordinated with gold through an N atom, S atom, Se atom, Te atom or P atom. Specific examples of $L^{21}$ include a substituted or unsubstituted amine (which means, preferably, a primary, secondary or tertiary alkylamine having 1 to 30 carbon atoms, or an arylamine), a five to six-membered nitrogen-containing hetero ring (preferably a five- or six-membered nitrogen-containing hetero ring composed of a combination of N, O, S and C, which hetero ring may have a substituent. This hetero ring may be coordinated with gold through a nitrogen atom in the ring, or through a substituent; and examples of the hetero ring include benzotriazole, triazole, tetrazole, indazole, benzimidazole, imidazole, benzothiazole, thiazole, thiazoline, benzoxazole, benzoxazoline, oxazole, thiadiazole, oxadiazole, triazine, pyrrole, pyrrolidine, imidazolidine and morpholine), a meso-ion (a meso-ion compound so called herein is a five- or six-membered heterocyclic compound, which cannot be satisfactorily expressed by one covalent bond structural formula or polar structural formula, and in which the ring carries a positive charge partly due to a compound having a sextet of π-electron related to all atoms constituting the ring, to keep a balance with the equal negative charge of atoms or an atomic group(s) outside of the ring; and examples of the meso-ion ring include an imidazolium ring, pyrazolium ring, oxazolium ring, thiazolium ring, triazolium ring, tetrazolium ring, thiadiazolium ring, oxadiazolium ring, thiatriazolium ring, or oxatriazolium ring), a thiol (preferably, an alkylthiol having 1 to 30 carbon atoms, an arylthiol having 6 to 30 carbon atoms, or a five- to seven-membered heterocyclic thiol containing at least one of an N atom, an O atom and an S atom), a thioether (preferably, a compound in which an alkyl group having 1 to 30 carbon atoms, an aryl group, or a five- to seven-membered heterocyclic group containing at least one of an N atom, an O atom and an S atom is bonded with an S atom, respectively, which compound may be either symmetric or asymmetric. Examples of the compound include dialkyl thioethers, diaryl thioethers, diheterocyclic thioethers, alkyl-aryl thioethers, alkyl-heterocyclic thioethers, and aryl-heterocyclic thioethers), a disulfide (preferably, a disulfide compound in which an alkyl group having 1 to 30 carbon atoms, aryl group or heterocyclic group is bonded with an S atom, which compound may be either symmetric or asymmetric. Examples of the compound include dialkyl disulfides, diaryl disulfides, diheterocyclic disulfides, alkyl-aryl disulfides, alkyl-heterocyclic disulfides, and aryl-heterocyclic disulfides; and a dialkyl disulfide, a diaryl disulfide or an alkyl-aryl disulfide is more preferable), a thioamide (the thioamide may be a part of the ring structure or non-cyclic thioamide. Useful one as the thioamide may be selected from those disclosed, for example, in U.S. Pat. Nos. 4,030,925, 4,031,127, 4,080,207, 4,245,037, 4,255,511, 4,266,031 and 4,276,364, and Research disclosure vol. 151, November 1976, item No. 15162 and ibid. vol. 176, December 1978, item No. 17626. Examples of the thioamide include thio urea, thiourethane, dithiocarbamate, 4-thiazoline-2-thion, thiazolidine-2-thion, 4-oxazoline-2-thion, oxazolidine-2-thion, 2-pyrazoline-5-thion, 4-imidazoline-2-thion, 2-thiohydantoin, rhodanine, isorhodanine, 2-thio-2,4-oxazolidinedione, thiobarbituric acid, tetrazoline-5-thion, 1,2,4-triazoline-3-thion, 1,3,4-thiadiazoline-2-thion, 1,3,4-oxadiazoline-2-thion, benzimidazoline-2-thion, benzoxazonline-2-thion, and benzothiazoline-2-thion, each of which may be substituted), a selenol (preferably, an alkyl selenol having 1 to 30 carbon atoms, an aryl selenol, or a five- to seven-membered heterocyclic selenol containing at least one of an N atom, an O atom and an S atom), a selenoether (preferably, a selenoether compound in which an alkyl group having 1 to 30 carbon atoms, aryl group or heterocyclic group is bonded with an Se atom, in which the substitution of the groups may be either symmetric or asymmetric with respect to the Se atom. Examples of the selenoether include dialkyl selenoethers, diaryl selenoethers, diheterocyclic selenoethers, alkyl-aryl selenoethers, alkyl-heterocyclic selenoethers, and aryl-heterocyclic selenoethers. Among these, a dialkyl selenoether, a diaryl selenoether, or an alkyl-aryl selenoether is preferable), a diselenide (preferably, a diselenide compound in which an alkyl group having 1 to 30 carbon atoms, aryl group or heterocyclic group is bonded with a Se atom, in which the substitution of the groups may be either symmetric or asymmetric with respect to the diselenido group. Examples of the diselenide include dialkyl diselenides, diaryl diselenides, diheterocyclic diselenides, alkyl-aryl diselenides, alkyl-heterocyclic diselenides, and aryl-heterocyclic diselenides. Among these, a dialkyl diselenide, a diaryl diselenide or an alkyl-aryl diselenide is preferable), a selenoamide (a compound obtained by replacing the S atom with an Se atom in the aforementioned thioamide compound is given as an example), a tellurol (a compound obtained by replacing the Se atom with a Te atom in the aforementioned selenol compound is given as an example), a telluroether (a compound obtained by replacing the Se atom with a Te atom in the aforementioned selenoether compound is given as an example), a ditelluride (a compound obtained by replacing the Se atom with a Te atom in the aforementioned diselenide compound is given as an example), a telluroamide (a compound obtained by replacing the Se atom with a Te atom in the aforementioned selenoamide compound is given as an example), an alkylphosphine (preferably, a primary, secondary or tertiary alkylphosphine having 1 to 20 carbon atoms), and an arylphosphine (preferably, a primary, secondary or tertiary arylphosphine having 1 to 20 carbon atoms).

$L^{21}$ is preferably a 5- to 6-membered nitrogen-containing hetero ring, a meso-ion, a thiol, a thioether, a thioamide, a selenol, a selenoether, a selenoamide, an alkylphosphine or an arylphosphine, more preferably a 5- to 6-membered nitrogen-containing hetero ring, a meso-ion, a thiol, a thioether, a thioamide, a selenol, an alkylphosphine or an arylphosphine, and most preferably a meso-ion, a thiol, a thioether, a thioamide, a selenol, an alkylphosphine or an arylphosphine. Particularly preferable examples of $L^{21}$ are selected from compounds of any of the following formulae (PL1) to (PL5).

Formula (PL1)

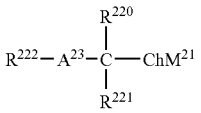

Formula (PL2)

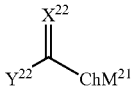

Formula (PL3)

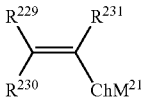

Formula (PL4)

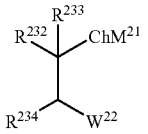

Formula (PL5)

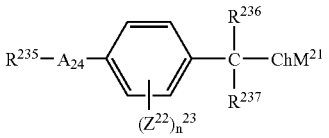

In formulae (PL1) to (PL5), Ch represents S, Se, or Te; $M^{21}$ represents a hydrogen atom, or a counter cation that is necessary to neutralize the charge of the compound. In formula (PL1), $A^{23}$ represents —O—, —S—, or —$NR^{223}$—; and $R^{220}$, $R^{221}$, $R^{222}$ and $R^{223}$ have the same meanings as the aforementioned $R^{21}$, $R^{22}$, $R^{23}$ and $R^{24}$, respectively, and each preferable range is also the same.

In formula (PL2), $X^{22}$ represents =O, =S or =$NR^{224}$; $Y^{22}$ represents a hydrogen atom, an alkyl group, an alkenyl group, an alkynyl group, an aryl group, a heterocyclic group, —$OR^{225}$, —$SR^{226}$, or —$N(R^{227})R^{228}$. $R^{224}$, $R^{225}$, $R^{226}$, $R^{227}$ and $R^{228}$ have the same meanings as the above $R^{25}$, $R^{26}$, $R^{27}$, $R^{28}$ and $R^{29}$ respectively, and each preferable range is also the same.

In formula (PL3), $R^{229}$, $R^{230}$ and $R^{231}$ have the same meanings as the above $R^{210}$, $R^{211}$ and $R^{212}$ respectively, and each preferable range is also the same.

In formula (PL4), $W^{22}$, $R^{232}$, $R^{233}$ and $R^{234}$ have the same meanings as the above $W^{21}$, $R^{213}$, $R^{214}$ and $R^{215}$ respectively, and each preferable range is also the same.

In formula (PL5), $A^{24}$ represents —O—, —S—, —Se—, —Te— or —$NR^{238}$—. $R^{235}$, $R^{236}$, $R^{237}$, $R^{238}$, $Z^{22}$ and $n^{23}$ have the same meanings as the above $R^{216}$, $R^{217}$, $R^{218}$, $R^{219}$, $Z^{21}$ and $n^{22}$ respectively, and each preferable range is also the same.

When $L^{21}$ is selected from the above formulae (PL1) to (PL5), the compound represented by any of formulae (PF1) to (PF5) may be a complex, which is either symmetric or asymmetric with respect to gold (I). Both the symmetric complex and the asymmetric complex are preferable in the present invention, but a complex symmetric with respect to gold (I) is more preferable.

In formulae (PL1) to (PL5), Ch represents S, Se or Te. In the present invention, S or Se is preferable, and S is more preferable.

In formulae (PL1) to (PL5), $M^{21}$ represents a hydrogen atom, or a counter cation that neutralizes the charge of the compound. When $M^{21}$ represents a counter cation, it specifically represents an inorganic cation, including an alkali metal, such as Li, Na, K, Rb or Cs, or an alkali earth metal, such as Mg, Ca or Ba; or an organic cation, such as a substituted or unsubstituted ammonium ion or phosphonium ion. In the present invention, when $M^{21}$ is an inorganic cation, it represents neither an $Ag^+$ ion nor an $Au^+$ ion. In the present invention, $M^{21}$ is preferably a hydrogen atom, a cation of an alkali metal, a cation of an alkali earth metal, or a substituted or unsubstituted ammonium ion, more preferably a cation of an alkali metal or a substituted or unsubstituted ammonium ion, and still more preferably a cation of an alkali metal or a substituted or unsubstituted ammonium ion.

In the present invention, among the compounds represented by formula (PL1), preferred are those wherein $M^{21}$ represents a cation of alkali metal; Ch represents S or Se; $A^{23}$ represents —O— or —S—; $R^{220}$ and $R^{221}$ each represent a hydrogen atom, an alkyl group or an aryl group; and $R^{222}$ represents an alkyl group or an aryl group. More preferred are those wherein $M^{21}$ represents a cation of alkali metal; Ch represents S; $A^{23}$ represents —O— or —S—; $R^{220}$ and $R^{221}$ each represent a hydrogen atom, an alkyl group or an aryl group; and $R^{222}$ represents an alkyl group or an aryl group. Particularly preferred are those wherein a ring structure formed by $R^{222}$, together with $R^{220}$ or $R^{221}$, is glucose, mannose, galactose, gulose, xylose, lyxose, arabinose, ribose, fucose, idose, talose, allose, altrose, rhamnose, sorbose, digitoxose, 2-deoxyglucose, 2-deoxygalactose, fructose, glucosamine, galactosamine, or glucuronic acid, or a sugar derivative thereof (in the case where $A^{23}$ in formula (PL1) represents O), or a sulfur analogue thereof (in the case where $A^{23}$ in formula (PL1) represents S). In these sugar structures, there exist c-isomers and β-isomers, which are different from each other in the 1-position stereostructure, and D-isomers and L-isomers, which are in a relation of mirror image with each other. In the present invention, however, these isomers are not discriminated from each other. Preferable examples of the compound used as $L^{21}$ include thioglucose, thiomannose, thiogalactose, thiolyxose, thioxylose, thioarabinose, selenoglucose, selenomannose, selenogalactose, selenolyxose, selenoxylose, selenoarabinose, telluroglucose, alkali metal salts thereof, their sulfur analogues, and derivatives of these compounds.

Among the compounds represented by formula (PL2), preferred compounds are those wherein $M^{21}$ represents a cation of alkali metal; Ch represents S or Se; $X^{22}$ represents =O or =S; $Y^{22}$ represents a hydrogen atom, an alkyl group, an aryl group, a heterocyclic group, —$OR^{225}$, —$SR^{226}$, or —$N(R^{227})R^{228}$; and $R^{224}$ to $R^{223}$ each represent an alkyl group, an aryl group or a heterocyclic group. More preferred are those wherein $M^{21}$ represents a cation of alkali metal; Ch represents S or Se; $X^{22}$ represents =O; and $Y^{22}$ represents an alkyl group, an aryl group or a heterocyclic group. Most preferred are those wherein $M^{21}$ represents a cation of alkali metal; Ch represents S; $X^{22}$ represents =O; and $Y^{22}$ represents an alkyl group, an aryl group or a heterocyclic group.

Among the compounds represented by formula (PL3), preferred are those wherein $M^{21}$ represents a cation of alkali metal; Ch represents S or Se; $R^{229}$ and $R^{230}$ each represent an electron attractive group; and $R^{231}$ represents a hydrogen atom, an alkyl group, an aryl group, a heterocyclic group, an alkoxy group, an aryloxy group, a heterocyclic oxy group, an amino group or an acylamino group. More preferred are those wherein $M^{21}$ represents a cation of alkali metal; Ch represents S or Se; $R^{229}$ and $R^{230}$ each represent an electron attractive group; and $R^{231}$ represents a hydrogen atom, an alkyl group, an aryl group or a heterocyclic group. Most preferred are those wherein $M^{21}$ represents a cation of alkali metal; Ch represents S; $R^{229}$ and $R^{230}$ each represent an electron attractive group; and $R^{231}$ represents a hydrogen atom, an alkyl group, an aryl group or a heterocyclic group.

Also, among the compounds represented by formula (PL3), those wherein $R^{229}$ and $R^{230}$ form a 5- to 7-membered non-aromatic ring are also preferred; and in this case, $M^{21}$ represents a cation of alkali metal; Ch represents S or Se; and $R^{231}$ represents a hydrogen atom, an alkyl group, an aryl group, a heterocyclic group, an alkoxy group, an aryloxy group, a heterocyclic oxy group, an amino group or an acylamino group. More preferred are those wherein $R^{229}$ and $R^{230}$ form a 5- to 7-membered non-aromatic ring; $M^{21}$ represents a cation of alkali metal; Ch represents S or Se; and $R^{231}$ represents a hydrogen atom, an alkyl group, an aryl group or a heterocyclic group. Most preferred are those compounds wherein $M^{21}$ represents a cation of alkali metal; Ch represents S; $R^{229}$ and $R^{230}$ form a 5- to 7-membered non-aromatic ring; and $R^{231}$ represents a hydrogen atom, an alkyl group, an aryl group or a heterocyclic group.

Among the compounds represented by formula (PL4), preferred are those compounds wherein $M^{21}$ represents a cation of alkali metal; Ch represents S or Se; $W^{22}$ represents an electron attractive group; and $R^{232}$ to $R^{234}$ each represent a hydrogen atom, a halogen atom, an alkyl group, an alkenyl group, an alkynyl group, an aryl group, a heterocyclic group, a cyano group, a carboxy group, a sulfo group, an alkyl- or aryl-sulfonyl group, an acyl group, an aryloxycarbonyl group, an alkoxycarbonyl group or a carbamoyl group. More preferred are those compounds wherein $M^{21}$ represents a cation of alkali metal; Ch represents S or Se; $W^{22}$ represents an electron attractive group; and $R^{232}$ to $R^{234}$ each represent a hydrogen atom, a halogen atom, an alkyl group, an alkenyl group, an aryl group, a heterocyclic group, a cyano group, a carboxy group, a sulfo group, an alkyl- or aryl-sulfonyl group, an acyl group, an aryloxycarbonyl group, an alkoxycarbonyl group or a carbamoyl group. Most preferred are those compounds wherein $M^{21}$ represents a cation of alkali metal, Ch represents S or Se, $W^{22}$ represents an electron attractive group, and $R^{232}$ to $R^{234}$ each represent a hydrogen atom, a halogen atom, an alkyl group, an alkenyl group, an alkynyl group, an aryl group, a heterocyclic group, a cyano group, a carboxy group, a sulfo group, an alkyl- or aryl-sulfonyl group, an acyl group, an aryloxycarbonyl group, an alkoxycarbonyl group or a carbamoyl group.

Also, among the compounds represented by formula (PL4), those compounds wherein $W^{22}$ and $R^{232}$ bond together to form a non-aromatic 5- to 7-membered ring are preferred as well, and in this case, preferably, $M^{21}$ represents a cation of alkali metal, Ch represents S or Se, $R^{26}$ represents an alkyl group, an alkenyl group, an aryl group, a heterocyclic group or the like, and $R^{233}$ and $R^{234}$ each represent a hydrogen atom, a halogen atom, an alkyl group, an alkenyl group, an alkynyl group, an aryl group, a heterocyclic group, a cyano group, a carboxy group, a sulfo group, an alkyl- or aryl-sulfonyl group, an acyl group, an aryloxycarbonyl group, an alkoxycarbonyl group, a carbamoyl group or the like. More preferred are those compounds wherein $M^{21}$ represents a cation of alkali metal, Ch represents S or Se, $W^{22}$ and $R^{232}$ bond together to form a non-aromatic 5- to 7-membered ring, and $R^{233}$ and $R^{234}$ each represent a hydrogen atom, a halogen atom, an alkyl group, an alkenyl group, an alkynyl group, an aryl group, a heterocyclic group, a cyano group, a carboxy group, a sulfo group, an alkyl- or aryl-sulfonyl group, an acyl group, an aryloxycarbonyl group, an alkoxycarbonyl group or a carbamoyl group. Most preferred are those compounds wherein $M^{21}$ represents a cation of alkali metal, Ch represents S, $W^{22}$ and $R^{232}$ bond together to form a non-aromatic 5- to 7-membered ring, and $R^{233}$ and $R^{234}$ each represent a hydrogen atom, a halogen atom, an alkyl group, an alkenyl group, an alkynyl group, an aryl group, a heterocyclic group, a cyano group, a carboxy group, a sulfo group, an alkyl- or aryl-sulfonyl group, an acyl group, an aryloxycarbonyl group, an alkoxycarbonyl group or a carbamoyl group.

Among the compounds represented by formula (PL5), preferable are those in which Ch is S or Se, $A^{24}$ represents —O—, —S— or —$NR^{231}$—, $R^{135}$ represents a hydrogen atom, an alkyl group, an aryl group or an acyl group, $R^{236}$ and $R^{237}$ each represent a hydrogen atom, an alkyl group or an aryl group, $R^{238}$ represents a hydrogen atom, an alkyl group or an aryl group, $n^{23}$ denotes 0 to 2, and $Z^{22}$ represents an alkyl group, an aryl group, a carboxy group (including its salts), a hydroxy group, an alkoxy group, an aryloxy group, an (alkyl-, aryl- or heterocyclic-)amino group, a ureido group, an alkylthio group, an arylthio group or a sulfo group (including its salts). More preferable are those in which Ch is S or Se, $A^{24}$ represents —O—, —S— or —$NR^{238}$, $R^{235}$ represents an alkyl group, $R^{236}$ and $R^{237}$ each represent a hydrogen atom or an alkyl group, $R^{238}$ represents an alkyl group or an aryl group, $n^{23}$ denotes 0 to 2, and $Z^{22}$ represents an alkyl group, an aryl group, a carboxy group (including its salts), a hydroxy group, an alkoxy group, an aryloxy group, an (alkyl-, aryl- or heterocyclic-)amino group, a ureido group, an alkylthio group, an arylthio group or a sulfo group (including its salts). Still more preferable are those in which $A^{24}$ represents —O—, —S— or —$NR^{238}$—, $R^{235}$ represents an alkyl group, $R^{236}$ and $R^{237}$ each represent a hydrogen atom or an alkyl group, $R^{238}$ represents an alkyl group, $n^{23}$ denotes 0 to 2, and $Z^{22}$ represents an alkyl group, an aryl group, a carboxy group (including its salts), a hydroxy group, an alkoxy group, an aryloxy group, an (alkyl-, aryl- or heterocyclic)amino group, a ureido group, an alkylthio group, an arylthio group or a sulfo group (including its salts). Most preferable are those in which Ch is S, $A^{24}$ represents —O—, $R^{235}$ represents an alkyl group, one of $R^{236}$ and $R^{237}$ represent a hydrogen atom and the other represents a hydrogen atom or an alkyl group, $n^{23}$ denotes 0 to 1, and $Z^{22}$ represents an alkyl group, an aryl group, a carboxy group (including its salts), a hydroxy group, an alkoxy group, an aryloxy group, an (alkyl-, aryl- or heterocyclic-)amino group, a ureido group, an alkylthio group, an arylthio group or a sulfo group (including its salts).

Among the compounds represented by any of formulae (PL1) to (PL5), $L^{21}$ is preferably a compound represented by formula (PL1), (PL2) or (PL5), more preferably a compound represented by formula (PL1) or (PL5), and most preferably a compound represented by formula (PL1).

Next, the compound represented by formula (PF6) will be explained.

In formula (PF6), $J^{21}$ represents a counter anion. Specific examples of the counter anion include a halogen ion (e.g., $F^-$, $Cl^-$, $Br^-$ and $I^-$), tetrafluoroboronate ion ($BF_4^-$), hexafluorophosphonate ion ($PF_6^-$), hexafluoroantimonate ion ($SbF_6^-$), aryl sulfonate ion (e.g., p-toluene sulfonate ion), alkyl sulfonate ion (e.g., methane sulfonate ion, and trifluoromethane sulfonate ion), and carboxy ion (e.g., acetic acid ion, trifluoroacetic acid ion, and benzoic acid ion). These counter anions preferably contain no adsorption group to gold, which group is typified by a mercapto group (—SH), thioether group (—S—), selenoether group (—Se—) or telluroether group (—Te—).

In the present invention, $J^{21}$ is preferably a halogen ion, tetrafluoroboronate ion, hexafluorophosphonate ion, aryl sulfonate ion or alkyl sulfonate ion, more preferably a halogen ion, tetrafluoroboronate ion or hexafluorophosphonate ion, and still more preferably a halogen ion. Among the halogen ions, $Cl^-$, $Br^-$ or $I^-$ is preferable, $Cl^-$ or $Br^-$ is more preferable, and $Cl^-$ is still more preferable.

$Q^{21}$ and $Q^{22}$ in formula (PF6) are selected from the compounds represented by any of formulae (SE1) to (SE3) which are explained before.

When $Q^{21}$ or/and $Q^{22}$ is a compound represented by formula (SE1), in a preferable case, $M^1$ and $M^2$ each are a hydrogen atom, an alkyl group, an alkenyl group, an aryl group, a heterocyclic group or an acyl group, Q is an alkyl group, an alkenyl group, an aryl group or —$NM^4M^5$, and $M^4$ and $M^5$ each represent a hydrogen atom, an alkyl group, an alkenyl group, an aryl group or a heterocyclic group. In a more preferable case, $M^1$ and $M^2$ each are a hydrogen atom, an alkyl group, an alkenyl group or an aryl group, Q is an alkyl group, an aryl group or —$NM^4M^5$; and $M^4$ and $M^5$ each represent a hydrogen atom, an alkyl group, an alkenyl group or an aryl group. In a still more preferable case, $M^1$ and $M^2$ each are a hydrogen atom, an alkyl group or an aryl group, Q is —$NM^4M^5$; and $M^4$ and $M^5$ each represent a hydrogen atom, an alkyl group or an aryl group.

When $Q^{21}$ or/and $Q^{22}$ is a compound represented by formula (SE2), in a preferable case, $V^1$ to $V^3$ each represent an alkyl group, an aryl group or a heterocyclic group; and, in a more preferable case, $V^1$ to $V^3$ each represent an aryl group.

When $Q^{21}$ or/and $Q^{22}$ is a compound represented by formula (SE3), $E^1$ and $E^2$ are selected from the compounds represented by any of formulae (T2) to (T4) in a preferable case, one of $E^1$ and $E^2$ is selected from the compounds represented by formula (T4) and the other is selected from the compounds represented by formula (T2), (T3) or (T4) in a more preferable case, one of $E^1$ and $E^2$ is selected from the compounds represented by formula (T4) and the other is selected from the compounds represented by formula (T3) or (T4) in a still more preferable case, and both $E^1$ and $E^2$ are selected from the compounds represented by formula (T4) in a most preferable case.

In the present invention, among the compounds represented by formula (PF6), preferable are those in which $J^{21}$ is a halogen ion, a tetrafluoroboronate ion, a hexafluorophosphonate ion, an aryl sulfonate ion or an alkyl sulfonate ion, $n^{23}$ is 0 or 1, and $Q^{21}$ and $Q^{22}$ each are independently selected from the compounds represented by formula (SE1) or (SE3); more preferable are those in which $J^{21}$ is a halogen ion, a tetrafluoroboronate ion or a hexafluorophosphonate ion, $n^{23}$ is 0, and $Q^{21}$ is selected from the compounds represented by formula (SE3); and still more preferable are those in which $J^{21}$ is a halogen ion, $n^{23}$ is 0, and $Q^{21}$ is selected from the compounds represented by formula (SE3).

In the present invention, among the compounds represented by any of formulae (PF1) to (PF6), preferred compounds that can be used are those represented by any of formulae (PF1), (PF5) and (PF6), more preferred are those represented by formula (PF1) or (PF6), and most preferred are those represented by formula (PF6).

Next, specific examples of the compounds represented by any of formulae (PF1) to (PF6) are shown below, but the present invention is not limited to those. Also, as to compounds with which a plurality of stereoisomers exist, the following examples do not limit the stereostructures of said compounds. In the following specific examples, Et means an ethyl group, Me means a methyl group, i-Pr means an isopropyl group, Ph means a phenyl group, Bn means a benzyl group, and Ac means an acetyl group.

PF1-1

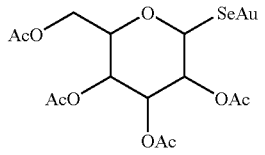

PF1-2

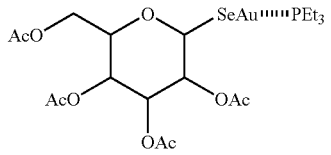

PF1-3

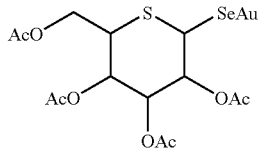

PF1-4

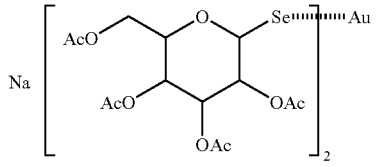

PF1-5

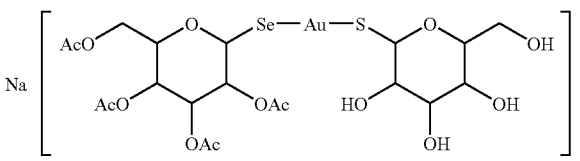

-continued
PF1-6
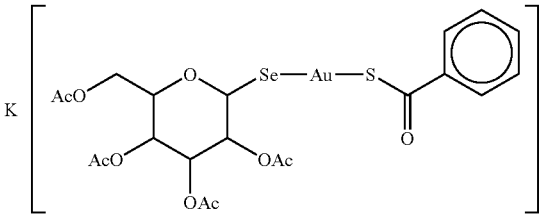
PF1-7
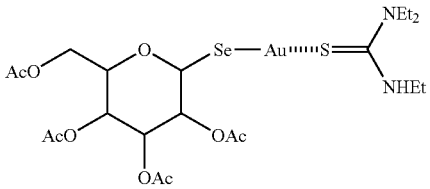
PF1-8
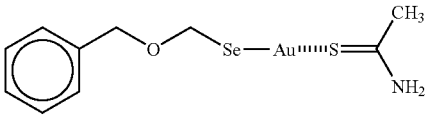
PF1-9
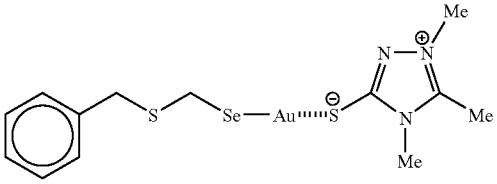
PF1-10
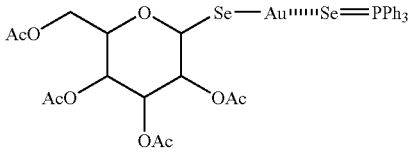
PF2-1
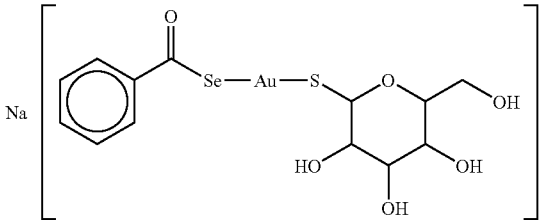
PF2-2
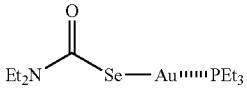
PF2-3
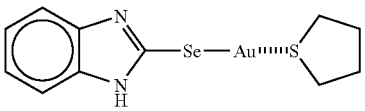
-continued
PF2-4
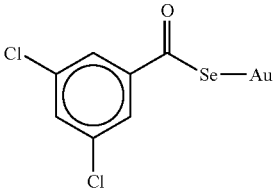
PF2-5
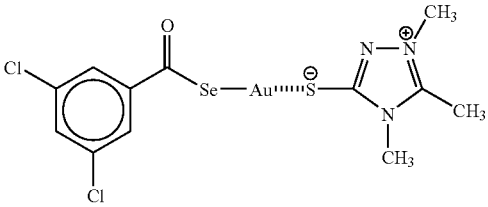
PF2-6
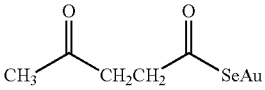
PF2-7
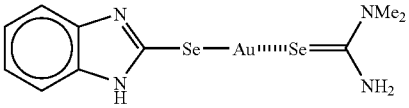
PF2-8
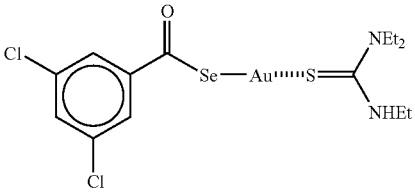
PF2-9
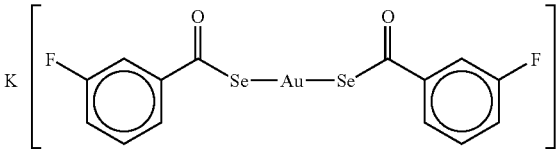
PF2-10
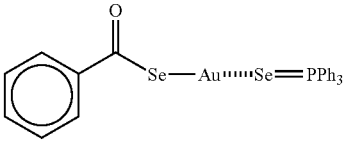
PF3-1
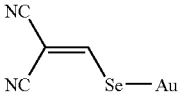
PF3-2
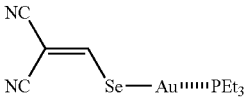

-continued
PF3-3
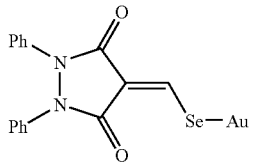
PF3-4
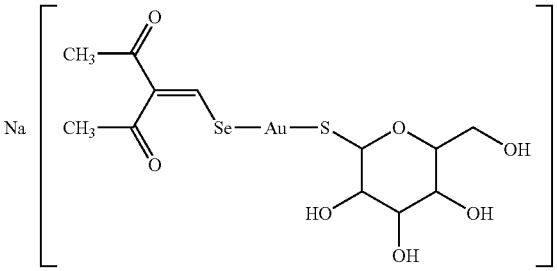
PF3-5
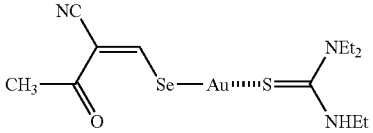
PF3-6
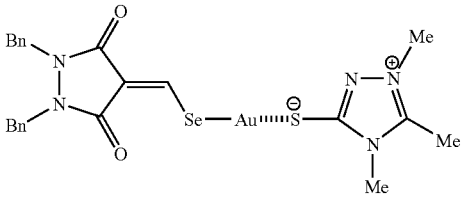
PF3-7
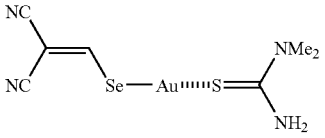
PF3-8
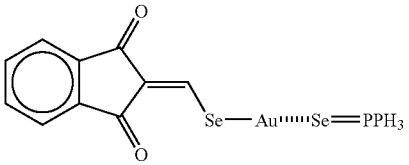
PF3-9
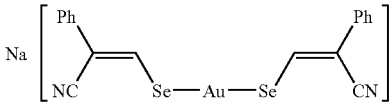
PF3-10
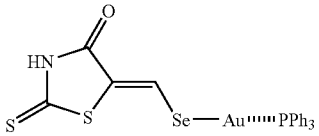
PF4-1
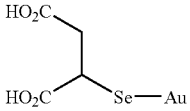
-continued
PF4-2
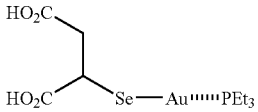
PF4-3
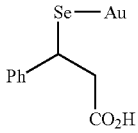
PF4-4
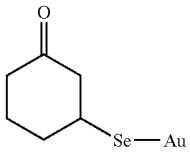
PF4-5
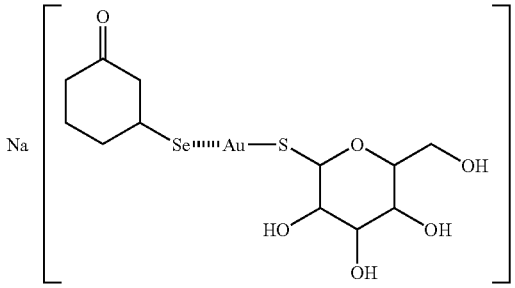
PF4-6
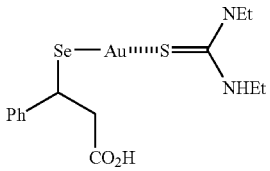
PF4-7
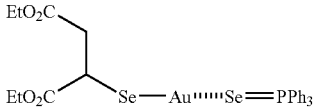
PF4-8
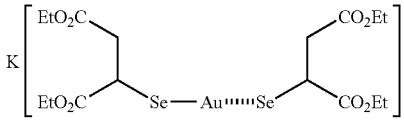
PF4-9
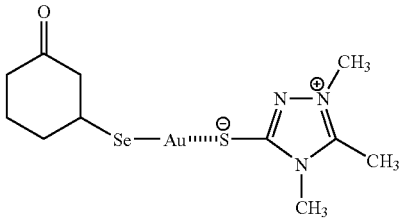
PF4-10
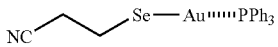
PF5-1
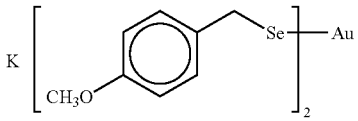

-continued
PF5-2
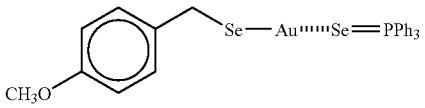
PF5-3
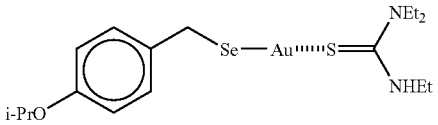
PF5-4
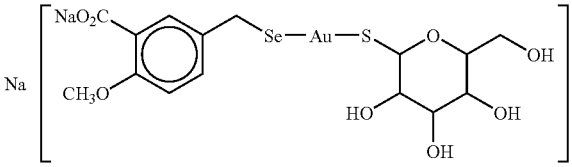
PF5-5
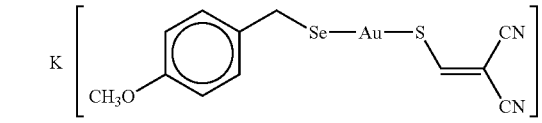
PF5-6
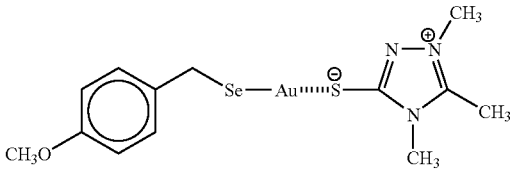
PF5-7
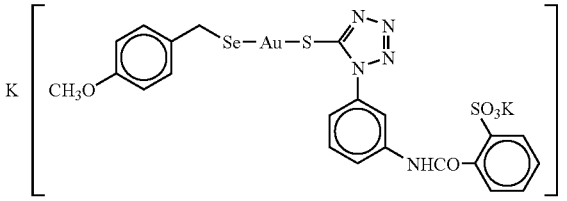
PF5-8
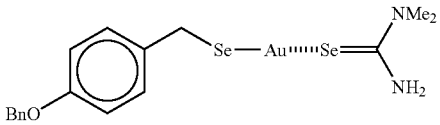
PF5-9
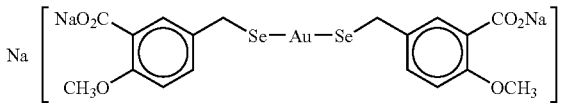
PF5-10
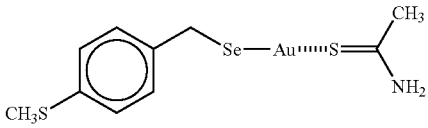
PF6-1
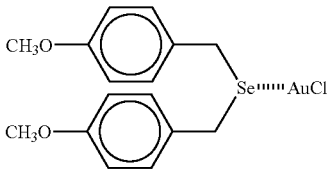
-continued
PF6-2
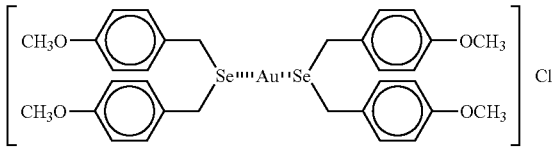
PF6-3
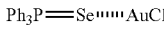
PF6-4
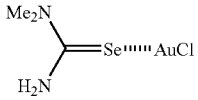
PF6-5
PF6-6
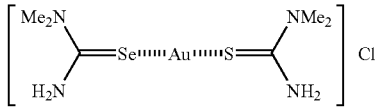
PF6-7
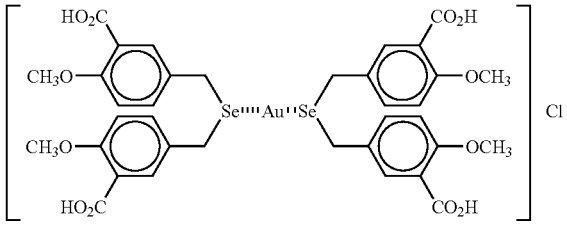
PF6-8
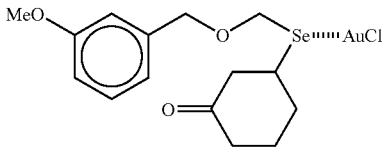
PF6-9
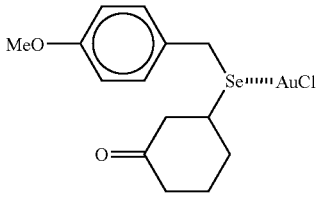
PF6-10
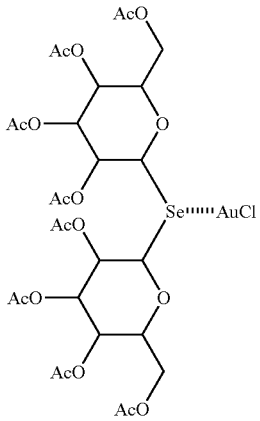

The addition amount of the compound represented by any of formulae (PF1) to (PF6) that can be used in the present invention can widely vary depending upon the cases, but it is generally $1\times10^{-7}$ to $5\times10^{-3}$ mol, preferably $5\times10^{-6}$ to $5\times10^{-4}$ mol, per mol of silver halide.

The compound represented by any of formulae (PF1) to (PF6) may be dissolved in water, an alcohol (such as methanol or ethanol), a ketone (such as acetone), an amide (such as dimethylfomamide), a glycol (such as methylpropylene glycol) or an ester (such as ethyl acetate) to add to the system, or may be added as a solid dispersion (fine crystal dispersion) prepared by a known dispersing method.

Addition of the compound represented by any of formulae (PF1) to (PF6) that can be used in the present invention may be conducted at any stage in the production of photosensitive emulsion, but is preferably conducted after formation of silver halide grains and before completion of the chemical sensitization step.

As the selenium sensitizer that can be used in the present invention, the exemplified compounds SE1-2, SE2-1, SE2-12, SE3-16 and SE3-31 are preferable, the exemplified compounds SE3-4, SE3-9, SE3-17, SE3-29 and SE3-37 are more preferable, the exemplified compounds PF2-5, PF3-6, PF4-3 and PF5-7 are still more preferable, and the exemplified compounds PF1-1 and PF6-1 are most preferable.

Silver halide grains constituting the silver halide emulsion that can be used in the present invention are not particularly restricted as to their average side length. The average side length is preferably from 0.1 μm to 0.35 μm, more preferably from 0.1 μm to 0.30 μm, and most preferably from 0.1 μm to 0.27 μm. Further, it is preferable that the projected area of silver halide grains ranging in side length from 0.1 μm to 0.35 μm makes up at least 50%, preferably at least 80%, particularly preferably at least 90%, of the sum total of projected area of all silver halide grains constituting the silver halide emulsion. The side lengths of silver halide grains can be determined from electron micrographs of the grains. More specifically, the side lengths of cubes having the same volumes as silver halide grains are taken as side lengths of the grains. The average side length can be determined by measuring side lengths of silver halide grains so high in number as to be statistically significant (for instance, at least 600 silver halide grains), and then calculating the average of the side lengths measured.

The silver halide emulsion that can be used in the present invention is required to have a silver chloride content of at least 90 mol %, and it is preferable that the silver chloride content therein be 95 mol % or above. The silver halide grains have no particular restriction as to their grain shapes. It is preferable that the grains are made up of cubic grains having substantially {100} faces, tetradecahedral crystal grains (which may be round in their vertexes and may have higher-order planes), octahedral crystal grains, or tabular grains having principal faces formed of {100} faces or {111} faces and an aspect ratio of 2 or more. The term "aspect ratio" as used herein refers to the value obtained by dividing the diameter of a circle whose area is equivalent to the projected area of an individual grain by the gain thickness. In the present invention, it is preferable that the silver halide grains be cubic or tetradecahedral grains.

The silver halide grain in the silver halide emulsion for use in the present invention, preferably has a silver bromide-containing phase and/or a silver iodide-containing phase. When the silver halide emulsion that can be used in the present invention has a silver bromide-containing phase, the silver bromide content therein is generally from 0.1 to 4 mol %, preferably from 0.5 to 2 mol %. When the silver halide emulsion that can be used in the present invention has a silver iodide-containing phase, the silver iodide content therein is generally from 0.05 to 1 mol %, preferably from 0.1 to 1 mol %, and more preferably from 0.1 to 0.40 mol %.

The specific silver halide grains in the silver halide emulsion for use in the present invention, each preferably have a silver bromide-containing phase and/or a silver iodide-containing phase. Especially, silver iodobromochloride grains having the above halogen composition are preferred. Herein, the term "silver bromide-containing phrase" or "silver iodide-containing phase" means a region where the content of silver bromide or silver iodide is higher than that in the surrounding regions. The halogen compositions of the silver bromide-containing phase or the silver iodide-containing phase and of the surrounding region (outer periphery) may vary either continuously or drastically. Such a silver bromide-containing phase or silver iodide-containing phase may form a layer which has an approximately constant concentration in a certain width at a portion in the grain, or it may form a maximum point having no spread. The local silver bromide content in the silver bromide-containing phase is preferably 3 mol % or more, more preferably from 5 to 40 mol %, and most preferably from 5 to 25 mol %. The local silver iodide content in the silver iodide-containing phase is preferably 0.3 mol % or more, more preferably from 0.5 to 8 mol %, and most preferably from 1 to 5 mol %. Such a silver bromide- or silver iodide-containing phase may be present in plural numbers in layer form, within the grain. In this case, the phases may have different silver bromide or silver iodide contents from each other.

It is preferable that the silver bromide-containing phase or silver iodide-containing phase that the silver halide emulsion grains for use in the present invention have, are each formed in the layer form so as to surround the grain center. One preferred embodiment is that the silver bromide-containing phase or silver iodide-containing phase formed in the layer form so as to surround the grain, has a uniform concentration distribution in the circumferential direction of the grain in each phase. However, in the silver bromide-containing phase or the silver iodide-containing phase formed in the layer form so as to surround the grain, there may be the maximum point or the minimum point of the silver bromide or silver iodide concentration in the circumferential direction of the grain, to have a concentration distribution. For example, when the emulsion grain has the silver bromide-containing phase or silver iodide-containing phase formed in the layer form so as to surround the grain in the vicinity of the grain surface, the silver bromide or silver iodide concentration of a corner portion or of an edge of the grain can be different from that of a principal face of the grain. Further, aside from the silver bromide-containing phase and/or silver iodide-containing phase formed in the layer form so as to surround the grain, another silver bromide-containing phase and/or silver iodide-containing phase not surrounding the grain may exist in isolation at a specific portion of the surface of the grain.

In a case where the silver halide emulsion for use in the present invention contains a silver bromide-containing phase, it is preferable that said silver bromide-containing phase be formed in a layer form so as to have a concentration maximum of silver bromide inside the grain. Likewise, in a case where the silver halide emulsion that can be used in the present invention contains a silver iodide-containing phase, it is preferable that said silver iodide-containing phase be formed in a layer form so as to have a concentration maximum of silver iodide on the surface of the grain. Such a silver bromide-containing phase or silver iodide-containing phase is constituted preferably with a silver amount of 3% to 30%, more preferably with a silver amount of 3% to 15%, in terms of the grain volume, in the viewpoint of increasing the local concentration with a smaller silver bromide or silver iodide content.

The silver halide grain of the silver halide emulsion for use in the present invention preferably contains both a silver bromide-containing phase and a silver iodide-containing phase. In this case, the silver bromide-containing phase and the silver iodide-containing phase may exist either at the same place in the grain or at different places thereof. It is preferred that these phases exist at different places, from a viewpoint that the control of grain formation may become easy. Further, a silver bromide-containing phase may contain silver iodide. Alternatively, a silver iodide-containing phase may contain silver bromide. In general, an iodide added during formation of high-silver chloride grains is liable to ooze to the surface of the grain more than a bromide, so that the silver iodide-containing phase is liable to be formed at the vicinity of the surface of the grain. Accordingly, when a silver bromide-containing phase and a silver iodide-containing phase exist at different places in a grain, it is preferred that the silver bromide-containing phase be formed more internally than the silver iodide-containing phase. In such a case, another silver bromide-containing phase may be provided further outside the silver iodide-containing phase in the vicinity of the surface of the grain.

It is preferred to integrate, in the vicinity of the surface of the grain, functions of the silver bromide-containing phase and silver iodide-containing phase for controlling photographic actions. Accordingly, it is preferred that the silver bromide-containing phase and the silver iodide-containing phase be placed adjacent to each other. From these points, it is preferred that the silver bromide-containing phase be formed at any of the position ranging from 50% to 100% of the grain volume measured from the inside, and that the silver iodide-containing phase be formed at any of the position ranging from 80% to 100% (preferably from 85% to 100%) of the grain volume measured from the inside. Further, it is more preferred that the silver bromide-containing phase be formed at any of the position ranging from 70% to 95% of the grain volume measured from the inside, and that the silver iodide-containing phase be formed at any of the position ranging from 90% to 100% of the grain volume measured from the inside.

When the silver halide emulsion for use in the present invention has a silver bromide-containing phase, another preferable mode of the silver halide emulsion having a silver bromide-containing phase is a mode in which the silver halide emulsion has a region ranging in silver bromide content from 0.5 to 20 mol % at a depth of 20 nm or less below the emulsion grain surface. It is preferable for the silver bromide-containing phase to be situated at a depth of 10 nm or less below the emulsion grain surface and to range in silver bromide content from 0.5 to 10 mol %, more preferably from 0.5 to 5 mol %. In this case, it is not always required that the silver bromide-containing phase take a layer form. For maximizing the effects of the present invention, however, it is preferable that the silver bromide-containing phase be formed so as to take a layer form to surround the emulsion grain.

When the silver halide emulsion for use in the present invention has a silver iodide-containing phase, another preferable mode of the silver halide emulsion having a silver iodide-containing phase is a mode in which the silver halide emulsion has a region ranging in silver iodide content from 0.3 to 10 mol % at a depth of 20 nm or less below the emulsion grain surface. It is preferable for the silver iodide-containing phase to be situated at a depth of 10 nm or less below the emulsion grain surface and to range in silver iodide content from 0.5 to 10 mol %, more preferably from 0.5 to 5 mol %. In this case, it is not always required that the silver iodide-containing phase take a layer form. For maximizing the effects of the present invention, however, it is preferable that the silver iodide-containing phase be formed so as to take a layer form to surround the emulsion grain.

In order to introduce bromide ion or iodide ion to have the silver halide emulsion for use in the present invention to contain silver bromide and/or silver iodide, a bromide salt or iodide salt solution may be added singly, or it may be added in combination with both a silver salt solution and a high chloride salt solution. In the latter case, the bromide or iodide salt solution and the high chloride salt solution may be added separately, or as a mixture solution of these salts of bromide or iodide and high chloride. The bromide or iodide salt is generally added in a form of a soluble salt, such as an alkali or alkali earth bromide or iodide salt. Alternatively, bromide or iodide ion may be introduced by cleaving the bromide or iodide ion from an organic molecule, as described in U.S. Pat. No. 5,389,508. As another source of bromide or iodide ion, fine silver bromide grains or fine silver iodide grains may be used.

The addition of a bromide salt or iodide salt solution may be concentrated at one time of grain formation process, or may be performed over a certain period of time. For obtaining an emulsion with high sensitivity and low fog, the position of the introduction of iodide ion into a high chloride emulsion may be limited. The deeper in the emulsion grain iodide ions are introduced, the smaller is the increment of sensitivity. Accordingly, the addition of an iodide salt solution is preferably started at 50% or outer side of the volume of the grain, more preferably 70% or outer side, particularly preferably 80% or outer side, and most preferably 85% or outer side.

On the other hand, the addition of a bromide salt solution is preferably started at 50% or outer side, more preferably 70% or outer side of the volume of the grain.

The distribution of a bromide ion concentration and iodide ion concentration in the depth direction of the grain can be measured, according to an etching/TOF-SIMS (Time of Flight—Secondary Ion Mass Spectrometry) method by means of, for example, TRIFT II Model TOF-SIMS apparatus (trade name, manufactured by Phi Evans Co.). A TOF-SIMS method is specifically described in, edited by Nippon Hyomen Kagakukai, "Hyomen Bunseki Gijutsu Sensho Niji Ion Shisuryo Bunsekiho (Surface Analysis Technique Selection—Secondary Ion Mass Analytical Method)", Maruzen Co., Ltd. (1999). When an emulsion grain is analyzed by the etching/TOF-SIMS method, it can be analyzed that iodide ions ooze toward the surface of the grain, even though the addition of an iodide salt solution is finished at an inner side of the grain. In the analysis with the etching/TOF-SIMS method, it is preferred that the emulsion that can be used in the present invention have the maximum concentration of iodide ions at the surface of the grain, that the iodide ion concentration decrease inwardly in the grain, and that the bromide ions have the maximum concentration in the inside of the grain. The local concentration of silver bromide can also be measured with X-ray diffractometry, as long as the silver bromide content is high to some extent.

The following is one of the embodiments of the present invention and is particularly preferable, i.e. the specific silver halide grains in the silver halide emulsion that can be used in the present invention contains a hexacoordinate complex having at least two different kinds of ligands in one and the same complex and containing Ir as a central metal. As the hexacoordinate complex containing Ir as a central metal, particularly preferably are hexacoordinate complexes containing Ir as a central metal and having both halogen ligands and organic ligands in one and the same complex, and hexacoordinate complexes containing Ir as a central metal and having both halogen ligands and inorganic ligands other than halogen ligands in one and the same complex. It is more preferable to use the combination of a hexacoordinate complex containing Ir as a central metal and having both a halogen ligand and an organic ligand in the complex molecule with a hexacoordinate complex containing Ir as a central metal and having both a halogen ligand and an inorganic ligand other than any halogen ligand in the complex molecule.

The hexacoordinate complex containing Ir as a central metal that can be preferably used in the present invention, is preferably a metal complex represented by formula (II):

$$[IrX^{1}_{n}L^{1}_{(6-n)}]^{m} \quad \text{Formula (II)}$$

wherein $X^{I}$ represents a halogen ion or a pseudohalogen ion other than a cyanate ion; $L^{I}$ represents a ligand different from $X^{I}$; n is 3, 4, or 5; and m is 5−, 4−, 3−, 2−, 1−, 0, or 1+, which represents an electric charge of the metal complex.

In formula (II), three to five of $X^{I}$s may be the same or different from each other. When plural $L^{I}$s are present, these plural $L^{1}$s may be the same or different from each other.

In the above, the pseudohalogen (halogenoid) ion means an ion having a nature similar to that of halogen ion, and examples of the same include cyamide ion ($CN^{-}$), thiocyanate ion ($SCN^{-}$), selenocyanate ion ($SeCN^{-}$), tellurocyanate ion ($TeCN^{-}$), azide dithiocarbonate ion ($SCSN_3^{-}$), cyanate ion ($OCN^{-}$), fulminate ion ($ONC^{-}$), and azide ion ($N_3^{-}$).

$X^{I}$ is preferably a fluoride ion, a chloride ion, a bromide ion, an iodide ion, a cyamide ion, an isocyanate ion, a thiocyanate ion, a nitrate ion, a nitrite ion, or an azide ion. Among these, chloride ion and bromide ion are particularly preferable. $L^{I}$ is not particularly limited, and it may be an organic or inorganic compound that may or may not have electric charge(s), with organic or inorganic compounds with no electric charge being preferable.

Among the metal complexes represented by formula (II), a metal complex represented by the following formula (IIA) is preferred:

$$[IrX^{1A}_{n}L^{1A}_{(6-n)}]^{m} \quad \text{Formula (IIA)}$$

wherein $X^{IA}$ represents a halogen ion or a pseudohalogen ion other than a cyanate ion; $L^{IA}$ represents an inorganic ligand different from $X^{IA}$; n is 3, 4, or 5; and m is 5−, 4−, 3−, 2−, 1−, 0, or 1+.

In formula (IIA), $X^{IA}$ has the same meaning as $X^{I}$ in formula (II), and the preferred range is also the same. $L^{IA}$ is preferably water, OCN, ammonia, phosphine, and carbonyl, with water being particularly preferred.

In formula (IIA), three to five of $X^{IA}$s may be the same or different from each other. When plural $L^{IA}$s are present, these plural $L^{IA}$s may be the same or different from each other.

Among the metal complexes represented by formula (II), a metal complex represented by the following formula (IIB) is more preferred:

$$[IrX^{1B}_{n}L^{1B}_{(6-n)}]^{m} \quad \text{Formula (IIB)}$$

wherein $X^{IB}$ represents a halogen ion or a pseudohalogen ion other than cyanate ion; $L^{IB}$ represents a ligand having a chain or cyclic hydrocarbon as a basic structure, or a ligand in which a portion of carbon atoms or hydrogen atoms of the basic structure is substituted with other atom(s) or atomic group(s); n is 3, 4, or 5; m is 5−, 4−, 3−, 2−, 1−, 0, or 1+.

$X^{IB}$ has the same meaning as $X^{I}$ in formula (II), and the preferable range is also the same. $L^{IB}$ represents a ligand having a chain or cyclic hydrocarbon as a basic structure, or a ligand in which a part of carbon atoms or hydrogen atoms of the basic structure is substituted with other atom(s) or atomic group(s), but it is not a cyamide ion. $L^{IB}$ is preferably a heterocyclic compound, more preferably a 5-membered heterocyclic compound ligand. Among the 5-membered heterocyclic compounds, a compound having at least one nitrogen atom and at least one sulfur atom in its 5-membered ring skeleton are further preferred.

In formula (IIB), three to five of $X^{IB}$s may be the same or different from each other. When plural $L^{IB}$s are present, these plural $L^{IB}$s may be the same or different from each other.

Among the metal complexes represented by formula (IIB), a metal complex represented by formula (IIC) is further preferred:

$$[IrX^{1C}_{n}L^{1C}_{(6-n)}]^{m} \quad \text{Formula (IIC)}$$

wherein $X^{IC}$ represents a halogen ion or a pseudohalogen ion other than a cyanate ion; $L^{IC}$ represents a 5-membered ring ligand, which has at least one nitrogen atom and at least one sulfur atom in its ring skeleton, and which may have a substituent(s) on a carbon atom(s) in said ring skeleton; n is 3, 4, or 5; and m is 5−, 4−, 3−, 2−, 1−, 0, or 1+.

$X^{IC}$ has the same meaning as $X^{I}$ in formula (II), and the preferable range is also the same. The substituent on the carbon atom in said ring skeleton in $L^{IC}$ is preferably a substituent having a volume smaller than an n-propyl group. Preferred examples of the substituent include a methyl group, an ethyl group, a methoxy group, an ethoxy group, a cyano group, an isocyano group, a cyanato group, an isocyanato group, a thiocyanato group, a isothiocyanato group, a formyl group, a thioformyl group, a hydroxyl group, a mercapto group, an amino group, a hydrazino group, an azido group, a nitro group, a nitroso group, a hydroxyamino group, a carboxyl group, a carbamoyl group, and a halogen atom (fluoro, chloro, bromo, and iodo).

In formula (IIC), three to five of $X^{IC}$s may be the same or different from each other. When plural $L^{IC}$s are present, these plural $L^{IC}$s may be the same or different from each other.

Preferable specific examples of the metal complex represented by formula (II) are shown below, but the present invention is not limited to these complexes.

$[IrCl_5(H_2O)]^{2-}$
$[IrCl_4(H_2O)_2]^{-}$
$[IrCl_5(H_2O)]^{-}$
$[IrCl_4(H_2O)_2]^{0}$
$[IrCl_5(OH)]^{3-}$
$[IrCl_4(OH)_2]^{2-}$
$[IrCl_5(OH)]^{2-}$
$[IrCl_4(OH)_2]^{2-}$
$[IrCl_5(O)]^{4-}$
$[IrCl_4(O)_2]^{5-}$
$[IrCl_5(O)]^{3-}$
$[IrCl_4(O)_2]^{4-}$
$[IrBr_5(H_2O)]^{2-}$
$[IrBr_4(H_2O)_2]^{-}$
$[IrBr_5(H_2O)]^{-}$
$[IrBr_4(H_2O)_2]^{0}$
$[IrBr_5(OH)]^{3-}$
$[IrBr_4(OH)_2]^{2-}$
$[IrBr_5(OH)]^{2-}$
$[IrBr_4(OH)_2]^{2-}$
$[IrBr_5(O)]^{4-}$
$[IrBr_4(O)_2]^{5-}$
$[IrBr_5(O)]^{3-}$
$[IrBr_4(O)_2]^{4-}$
$[IrCl_5(OCN)]^{3-}$ $[IrBr_5(OCN)]^{3-}$
$[IrCl_5(thiazole)]^{2-}$
$[IrCl_4(thiazole)_2]^{-}$
$[IrCl_3(thiazole)_3]^{0}$
$[IrBr_5(thiazole)]^{2-}$
$[IrBr_4(thiazole)_2]^{-}$
$[IrBr_3(thiazole)_3]^{0}$
$[IrCl_5(5\text{-methylthiazole})]^{2-}$
$[IrCl_4(5\text{-methylthiazole})_2]^{-}$
$[IrBr_5(5\text{-methylthiazole})]^{2-}$
$[IrBr_4(5\text{-methylthiazole})_2]^{-}$ The specific silver halide grains in the silver halide emulsion for use in the present invention may contain, in stead of or alternatively in addition to the aforementioned iridium hexacoordinate complex represented by formula (II), another hexacoordinate complex containing Ir as a central metal and having 6 ligands, all of which are Cl, Br, or I; and in the present invention, the combination use of such another iridium hexacoordinate complex with the hexacoordinate complex of formula (II) is preferred. In this case, any two or three kinds of Cl, Br, and I may be mixed and present in the 6-coordination complex. The iridium complex (hexacoordination complex containing Ir as a central metal) in which the ligands are Cl, Br, or I is particularly preferably incorporated in a silver bromide-containing phase, in order to obtain hard gradation upon high illuminance exposure.

Specific examples of the iridium complex (hexacoordination complex containing Ir as a central metal) in which the six ligands each are Cl, Br, or I are shown below, but the present invention is not limited to these complexes.

$[IrCl_6]^{2-}$
$[IrCl_6]^{3-}$
$[IrBr_6]^{2-}$
$[IrBr_6]^{3-}$
$[IrI_6]^{3-}$

The foregoing metal complexes are anionic ions. When these are formed into salts with cationic ions, counter cationic ions are preferably those easily soluble in water. Preferable examples thereof include an alkali metal ion, such as sodium ion, potassium ion, rubidium ion, cesium ion, and lithium ion; an ammonium ion, and an alkyl ammonium ion. These metal complexes can be used being dissolved in water or in a mixed solvent of water and an appropriate water-miscible organic solvent (such as an alcohol, an ether, a glycol, a ketone, an ester, or an amide). The iridium complex is added in an amount of, preferably $1\times10^{-10}$ mole to $1\times10^{-3}$ mole, and particularly preferably $1\times10^{-8}$ mole to $1\times10^{-5}$ mole, per mole of silver, during grain formation.

In the present invention, the above-mentioned iridium complex is preferably added directly to the reaction solution at the time of silver halide grain formation, or indirectly to the grain-forming reaction solution via addition to an aqueous halide solution for forming silver halide grains or other solution, so that the iridium complex is doped into the inside of the silver halide grains. Further, it is also preferable to employ a method in which the iridium complex is doped into a silver halide grain, by preparing fine grains doped with the complex in advance and adding the fine grains for carrying out physical ripening. Further, it is also possible that these methods may be combined, to incorporate the iridium complex into the inside of the silver halide grains.

In the case where these metal complexes are doped to the inside of the silver halide grains, they are preferably uniformly distributed in the inside of the grains. On the other hand, as disclosed in JP-A-4-208936, JP-A-2-125245 and JP-A-3-188437, they are also preferably distributed only in the grain surface layer. Alternatively, they are also preferably distributed only in the inside of the grain, while the grain surface is covered with a layer free of the complex. Further, as disclosed in U.S. Pat. Nos. 5,252,451 and 5,256,530, it is also preferred that the silver halide grains be subjected to physical ripening in the presence of fine grains having the metal complexes incorporated therein, to modify the grain surface phase. Further, these methods may be used in combination. Two or more kinds of complexes may be incorporated in the inside of an individual silver halide grain. There is no particular limitation on the halogen composition at the site where the above-mentioned metal complex is incorporated, but it is preferable that the hexacoordinate complex whose central metal is Ir and whose six ligands are all Cl, Br or I ions, be incorporated into the maximum silver-bromide concentration region(s).

In the present invention, a metal ion other than the above-mentioned iridium can be doped in the inside and/or on the surface of the silver halide grains. The metal ions to be used are preferably ions of a transition metal. Preferable examples of the transition metal are iron, ruthenium, osmium, and rhodium. It is more preferable that these metal ions are used in the form of a hexacoordination complex of octahedron-type having ligands. When employing an inorganic compound as a ligand, any of cyamide ion, halide ion, thiocyanate ion, hydroxide ion, peroxide ion, azide ion, nitrite ion, water (aquo), ammonio, nitrosyl ion, or thionitrosyl ion is preferably used. Such a ligand is preferably coordinated to any metal ion selected from the group consisting of the above-mentioned iron, ruthenium, osmium, lead, cadmium and zinc. Two or more kinds of these ligands are also preferably used in one complex molecule. Further, an organic compound can also be preferably used as a ligand. Preferable examples of the organic compound include chain compounds having a main chain of 5 or less carbon atoms and/or heterocyclic compounds of 5- or 6-membered ring. More preferable examples of the organic compound are those having at least a nitrogen, phosphorus, oxygen, or sulfur atom in the molecule as an atom which is capable of coordinating to a metal. Most preferred organic compounds are furan, thiophene, oxazole, isooxazole, thiazole, isothiazole, imidazole, pyrazole, triazole, furazane, pyran, pyridine, pyridazine, pyrimidine and pyrazine. Further, an organic compound which has a substituent introduced into a basic skeleton of any of the above-mentioned compounds is also preferred.

As a combination of the metal ion and the ligand, a combination of an iron ion and a cyamide ligand and a combination of a ruthenium ion and a cyamide ligand are preferable. In the present invention, it is preferable to use these metal complex compounds and the iridium complexes as mentioned above in combination. Preferred of these compounds are those in which the number of cyamide ions accounts for the majority of the coordination number (site) intrinsic to the iron or ruthenium that is the central metal. The remaining sites are preferably occupied by thiocyanate, ammonio, aquo, nitrosyl ion, dimethylsulfoxide, pyridine, pyrazine, or 4,4'-bipyridine. Most preferably each of 6 coordination sites of the central metal is occupied by a cyamide ion, to form a hexacyano iron complex or a hexacyano ruthenium complex. Such metal complexes composed of these cyamide ion ligands are preferably added during grain formation in an amount of $1\times10^{-8}$ mol to $1\times10^{-2}$ mol, most preferably $1\times10^{-6}$ mol to $5\times10^{-4}$ mol, per mol of silver atom. In the case of the ruthenium complex and the osmium complex, nitrosyl ion, thionitrosyl ion, or water molecule is also preferably used in combination with chloride ion, as ligands. More preferably these ligands form a pentachloronitrosyl complex, a pentachlorothionitrosyl complex, or a pentachloroaquo complex. The formation of a hexachloro complex is also preferred. These complexes are preferably added during grain formation in an amount of $1\times10^{-10}$ mol to $1\times10^{-6}$ mol, more preferably $1\times10^{-9}$ mol to $1\times10^{-6}$ mol, per mol of silver atom.

Various compounds or precursors thereof can be included in the silver halide emulsion for use in the present invention, to prevent fogging from occurring or to stabilize photographic performance, during manufacture, storage or photographic processing of the photographic material. Specific examples of the compounds are disclosed in JP-A-62-215272, pages 39 to 72, and they can be preferably used. In addition, 5-arylamino-1,2,3,4-thiatriazole compounds (the aryl residual group has at least one electron-withdrawing group) disclosed in European Patent No. 0447647 can also be preferably used.

Further, in the present invention, to enhance storage stability of the silver halide emulsion, it is also preferred in the present invention to use hydroxamic acid derivatives described in JP-A-11-109576; cyclic ketones having a double bond adjacent to a carbonyl group, each end of said double bond being substituted with an amino group or a hydroxyl group, as described in JP-A-11-327094 (in particular, compounds represented by formula (S1); the description at paragraph Nos. 0036 to 0071 of JP-A-11-327094 is incorporated herein by reference); sulfo-substituted catecols or hydroquinones described in JP-A-11-143011 (for example, 4,5-dihydroxy-1,3-benzenedisulfonic acid, 2,5-dihydroxy-1,4-benzenedisulfonic acid, 3,4-dihydroxybenzenesulfonic acid, 2,3-dihydroxybenzenesulfonic acid, 2,5-dihydroxybenzenesulfonic acid, 3,4,5-trihydroxybenzenesulfonic acid, and salts of these acids); hydroxylamines represented by formula (A) described in U.S. Pat. No. 5,556,741 (the description of line 56 in column 4 to line 22 in column 11 of U.S. Pat. No. 5,556,741 is preferably applied to the present invention and is incorporated herein by reference); and water-soluble reducing agents represented by formula (I), (II), or (III) of JP-A-11-102045.

Further, the silver halide emulsion for use in the present invention can contain a spectral sensitizing dye, to impart sensitivity in a desired light wavelength region, i.e. so-called spectral sensitivity. Examples of the spectral sensitizing dye that can be used in spectral sensitization of blue, green, or red light region, include those disclosed by F. M. Harmer, in "Heterocyclic Compounds—Cyanine Dyes and Related Compounds", John Wiley & Sons, New York, London (1964). Specific examples of compounds and spectral sensitization methods that can be preferably used in the present invention, include those described in JP-A-62-215272, from page 22, right upper column to page 38. In addition, the spectral sensitizing dyes described in JP-A-3-123340 are very preferred as red-sensitive spectral sensitizing dyes for silver halide emulsion grains having a high-silver chloride content, from the viewpoint of stability, adsorption strength, temperature dependency of exposure, and the like.

The amount of these spectral sensitizing dyes to be added can vary in a wide range depending on the occasion, and it is preferably in the range of $0.5\times10^{-6}$ mole to $1.0\times10^{-2}$ mole, more preferably in the range of $1.0\times10^{-6}$ mole to $5.0\times10^{-3}$ mole, per mole of silver halide.

The silver halide color photographic light-sensitive material according to the present invention will be explained in below.

As described above, the constitution of the silver halide color photographic light-sensitive material of the present invention, has, on a support, at least one cyan dye-forming coupler-containing silver halide emulsion layer, at least one magenta dye-forming coupler-containing silver halide emulsion layer, and at least one yellow dye-forming coupler-containing silver halide emulsion layer. Preferably, the silver halide emulsions contained in the above layers may have photo-sensitivities to mutually different wavelength regions of light (for example, light in a blue region, light in a green region, and light in a red region). The amount of the coupler to be used is preferably 0.6 equivalents or more, particularly preferably 0.7 equivalents or more, to silver, although it is ideally 1 equivalent to silver. As mentioned herein, the term "1 equivalent" means the amount of the coupler which develops a color when the coupler is reacted with all the amount of silver to be used; and the term "0.5 equivalents" means the amount of the coupler which develops a color when the coupler is reacted with half the amount of silver to be used.

In the light-sensitive material of the present invention, any of known materials for photography or additives may be used.

For example, as a photographic support (base), a transmissive type support or a reflective type support may be used. As the transmissive type support, it is preferred to use a transparent film, such as a cellulose nitrate film, and a polyethylene terephthalate film; or a polyester of 2,6-naphthalenedicarboxylic acid (NDCA) and ethylene glycol (EG), or a polyester of NDCA, terephthalic acid, and EG, provided thereon with an information-recording layer such as a magnetic layer. In the present invention, it is preferred to use the reflective type support (or reflective support). As the reflective type support, it is especially preferable to use a reflective support having a substrate laminated thereon with a plurality of polyethylene layers or polyester layers, at least one of the waterproof resin layers (laminate layers) contains a white pigment such as titanium oxide.

In the present invention, examples of more preferable reflective support includes a support having a paper substrate provided with a polyolefin layer having micropores (fine holes), on the same side as silver halide emulsion layers to be provided. The polyolefin layer may be composed of multi-layers. In this case, it is more preferable for the support to be composed of a micropore-free polyolefin (e.g., polypropylene, polyethylene) layer adjacent to a gelatin layer on the same side as the silver halide emulsion layers, and a micropore-containing polyolefin (e.g., polypropylene, polyethylene) layer closer to the paper substrate. The density of the multi-layer or single-layer of polyolefin layer(s) existing between the paper substrate and photographic constituting layers is preferably in the range of 0.40 to 1.0 g/ml, more preferably in the range of 0.50 to 0.70 g/ml. Further, the thickness of the multi-layer or single-layer of polyolefin layer(s) existing between the paper substrate and photographic constituting layers is preferably in the range of 10 to 100 μm, more preferably in the range of 15 to 70 μm. Further, the ratio of thickness of the polyolefin layer(s) to the paper substrate is preferably in the range of 0.05 to 0.2, more preferably in the range 0.1 to 0.15.

Further, it is also preferable for enhancing rigidity of the reflective support, that a polyolefin layer be provided on the surface of the foregoing paper substrate opposite to the side of the photographic constituting layers, i.e., on the back surface of the paper substrate. In this case, it is preferable that the polyolefin layer on the back surface be polyethylene or polypropylene, the surface of which is matted, with the polypropylene being more preferable. The thickness of the polyolefin layer on the back surface is preferably in the range of 5 to 50 μm, more preferably in the range of 10 to 30 μm, and further the density thereof is preferably in the range of 0.7 to 1.1 g/ml. As to the reflective support for use in the present invention, preferable embodiments of the polyolefin layer to be provided on the paper substrate include those described in JP-A-10-333277, JP-A-10-333278, JP-A-11-52513, JP-A-11-65024, European Patent Nos. 0880065 and 0880066.

Further, it is preferred that the above-described water-proof resin layer contain a fluorescent whitening agent. Further, the fluorescent whitening agent may be dispersed and contained in a hydrophilic colloid layer, which is formed separately from the above layers in the light-sensitive material. Preferred examples of the fluorescent whitening agent that can be used, include benzoxazole-series, coumarin-series, and pyrazoline-series compounds. Further, fluorescent whitening agents of benzoxazolylnaphthalene-series and benzoxazolylstilbene-series are more preferably used. The amount of the fluorescent whitening agent to be used is not particularly limited, and it is preferably in the range of 1 to 100 mg/m$^2$. When a fluorescent whitening agent is mixed with a water-proof resin, a mixing ratio of the fluorescent whitening agent to be used in the water-proof resin is preferably in the range of 0.0005 to 3% by mass, and more preferably in the range of 0.001 to 0.5% by mass, to the resin.

Further, a transmissive type support or the foregoing reflective type support each having coated thereon a hydrophilic colloid layer containing a white pigment may be used as the reflective type support. Furthermore, a reflective type support having a mirror plate reflective metal surface or a secondary diffusion reflective metal surface may be employed as the reflective type support.

As the support for use in the light-sensitive material of the present invention, a support of the white polyester type, or a support provided with a white pigment-containing layer on the same side as the silver halide emulsion layer, may be adopted for display use. Further, it is preferable for improving sharpness that an antihalation layer be provided on the silver halide emulsion layer side or the reverse side of the support. In particular, it is preferable that the transmission density of support be adjusted to the range of 0.35 to 0.8, so that a display may be enjoyed by means of both transmitted and reflected rays of light.

In the light-sensitive material of the present invention, in order to improve, e.g., the sharpness of an image, a dye (particularly an oxonole-series dye) that can be discolored by processing, as described in European Patent No. 0,337,490 A2, pages 27 to 76, is preferably added to the hydrophilic colloid layer, such that an optical reflection density at 680 nm in the light-sensitive material is 0.70 or more. It is also preferable to add 12% by mass or more (more preferably 14% by mass or more) of titanium oxide that is surface-treated with, for example, a dihydric to tetrahydric alcohol (e.g., trimethylolethane) to a water-proof resin layer of the support.

The light-sensitive material of the present invention preferably contains, in the hydrophilic colloid layer, a dye (particularly oxonole dyes and cyanine dyes) that can be discolored by processing, as described in European Patent No. 0337490A2, pages 27 to 76, in order to prevent irradiation or halation or to enhance safelight safety, and the like. Further, a dye described in European Patent No. 0819977 may also be preferably used in the present invention. Among these water-soluble dyes, some deteriorate color separation or safelight safety when used in an increased amount. Preferable examples of the dye which can be used and which does not deteriorate color separation, include water-soluble dyes described in JP-A-5-127324, JP-A-5-127325 and JP-A-5-216185.

In the present invention, it is possible to use a colored layer which can be discolored during processing, in place of the water-soluble dye, or in combination with the water-soluble dye. The colored layer that can be discolored with a processing, to be used, may contact with an emulsion layer directly, or indirectly through an interlayer containing an agent for preventing color-mixing during processing, such as hydroquinone or gelatin. The colored layer is preferably provided as a lower layer (i.e. a layer closer to the support) with respect to the emulsion layer which develops the same primary color as the color of the colored layer. It is possible to provide colored layers independently, each corresponding to respective primary colors. Alternatively, only some layers selected from them may be provided. In addition, it is possible to provide a colored layer subjected to coloring so as to match a plurality of primary-color regions. About the optical reflection density of the colored layer, it is preferred that, at the wavelength which provides the highest optical density in a range of wavelengths used for exposure (a visible light region from 400 nm to 700 nm for an ordinary printer exposure, and the wavelength of the light generated from the light source in the case of scanning exposure), the optical density is 0.2 or more but 3.0 or less, more preferably 0.5 or more but 2.5 or less, and particularly preferably 0.8 or more but 2.0 or less.

The colored layer may be formed by a known method. For example, there are a method in which a dye in a state of a dispersion of solid fine particles is incorporated in a hydrophilic colloid layer, as described in JP-A-2-282244, from page 3, upper right column to page 8, and JP-A-3-7931, from page 3, upper right column to page 11, left under column; a method in which an anionic dye is mordanted in a cationic polymer; a method in which a dye is adsorbed onto fine grains of silver halide or the like and fixed in the layer; and a method in which a colloidal silver is used, as described in JP-A-1-239544. As to a method of dispersing fine-powder of a dye in solid state, for example, JP-A-2-308244, pages 4 to 13, describes a method in which fine particles of dye which is at least substantially water-insoluble at the pH of 6 or less, but at least substantially water-soluble at the pH of 8 or more, are incorporated. The method of mordanting anionic dyes in a cationic polymer is described, for example, in JP-A-2-84637, pages 18 to 26. U.S. Pat. Nos. 2,688,601 and 3,459,563 disclose methods of preparing colloidal silver for use as a light absorber. Among these methods, preferred examples are the method of incorporating fine particles of dye, the method of using colloidal silver, and the like.

The photographic material of the present invention can be used, for example, as a color negative film, a color positive film, a color reversal film, a color reversal photographic paper, a color photographic paper, a display photosensitive material, a digital color proof, a motion picture color positive, or a motion picture color negative. Among these, a display photosensitive material, a digital color proof, a motion picture color positive, a color reversal photographic paper, and a color photographic paper are preferred over the others as use thereof, and the use as a color photographic paper is particularly preferable. The color photographic paper, as mentioned above, preferably contains at least one yellow-color-forming blue-sensitive silver halide emulsion layer, at least one magenta-color-forming green-sensitive silver halide emulsion layer, and at least one cyan-color-forming red-sensitive silver halide emulsion layer. In general, the arranging order of these silver halide emulsion layers in the direction that goes away from a support is a yellow-color-forming blue-sensitive silver halide emulsion layer, a magenta-color-forming green-sensitive silver halide emulsion layer, and a cyan-color-forming red-sensitive silver halide emulsion layer.

However, a layer arrangement, which is different from the above, may be adopted.

The blue-sensitive silver halide emulsion layer may be provided at any position on a support. In the case where silver halide tabular grains are contained in the blue-sensitive silver halide emulsion layer, it is preferable that the blue-sensitive silver halide emulsion layer be positioned more apart from a support than at least one of a green-sensitive silver halide emulsion layer and a red-sensitive silver halide emulsion layer. Further, it is preferable that the blue-sensitive silver halide emulsion layer be positioned most apart from a support than other silver halide emulsion layers, from the viewpoint of color-development acceleration, desilvering acceleration, and reducing residual color due to a sensitizing dye. Further, it is preferable that the red-sensitive silver halide emulsion layer be disposed in the middle of the other silver halide emulsion layers, from the viewpoint of reducing blix fading. On the other hand, it is preferable that the red-sensitive silver halide emulsion layer be the lowest layer, from the viewpoint of reducing light fading. Further, each of the yellow-color-forming layer, the magenta-color-forming layer, and the cyan-color-forming layer may be composed of two or three layers. It is also preferable that a color-forming layer be formed by providing a silver-halide-emulsion-free layer containing a coupler in adjacent to a silver halide emulsion layer, as described in, for example, JP-A-4-75055, JP-A-9-114035, JP-A-10-246940, and U.S. Pat. No. 5,576,159.

Preferred examples of silver halide emulsions and other materials (additives or the like) that can be used in the present invention, photographic constituting layers (arrangement of the layers or the like), and processing methods for processing the photographic materials and additives for processing, are disclosed in JP-A-62-215272, JP-A-2-33144, and European Patent No. 0355660 A2. Particularly, those disclosed in European Patent No. 0355660 A2 are preferably used. Further, it is also preferred to use or apply silver halide color photographic light-sensitive materials and processing methods thereof disclosed in, for example, JP-A-5-34889, JP-A-4-359249, JP-A-4-313753, JP-A-4-270344, JP-A-5-66527, JP-A-4-34548, JP-A-4-145433, JP-A-2-854, JP-A-1-158431, JP-A-2-90145, JP-A-3-194539, JP-A-2-93641, and European Patent Publication No. 0520457 A2.

In particular, in the present invention, use can be particularly preferably made of those described in the patent publications as shown in the following Table 1, as the above-described reflective support and silver halide emulsion, as well as the different kinds of metal ions to be doped in the silver halide grains, the storage stabilizers or antifogging agents of the silver halide emulsion, the methods of chemical sensitization (sensitizers), the methods of spectral sensitization (spectral sensitizers), the cyan, magenta, and yellow couplers and the emulsifying and dispersing methods thereof, the dye-image-stability-improving agents (stain inhibitors and discoloration inhibitors), the dyes (coloring layers), the kinds of gelatin, the layer structure of the light-sensitive material, the film pH of the light-sensitive material, and the like.

TABLE 1

| Element | JP-A-7-104448 | JP-A-7-77775 | JP-A-7-301895 |
|---|---|---|---|
| Reflective type supports | Column 7, line 12 to column 12, line 19 | Column 35, line 43 to column 44, line 1 | Column 5, line 40 to column 9, line 26 |
| Silver halide emulsions | Column 72, line 29 to column 74, line 18 | Column 44, line 36 to column 46, line 29 | Column 77, line 48 to column 80, line 28 |
| Other metal ion species | Column 74, lines 19 to 44 | Column 46, line 30 to column 47, line 5 | Column 80, line 29 to column 81, line 6 |
| Storage stabilizers or antifoggants | Column 75, lines 9 to 18 | Column 47, lines 20 to 29 | Column 18, line 11 to column 31, line 37 (Especially, mercapto-heterocyclic compounds) |
| Chemical sensitizing methods (Chemical sensitizers) | Column 74, line 45 to column 75, line 6 | Column 47, lines 7 to 17 | Column 81, lines 9 to 17 |
| Spectral sensitizing methods (Spectral sensitizers) | Column 75, line 19 to column 76, line 45 | Column 47, line 30 to column 49, line 6 | Column 81, line 21 to column 82, line 48 |
| Cyan couplers | Column 12, line 20 to column 39, line 49 | Column 62, line 50 to column 63, line 16 | Column 88, line 49 to column 89, line 16 |
| Yellow couplers | Column 87, line 40 to column 88, line 3 | Column 63, lines 17 to 30 | Column 89, lines 17 to 30 |
| Magenta couplers | Column 88, lines 4 to 18 | Column 63, line 3 to column 64, line 11 | Column 31, line 34 to column 77, line 44 and column 88, lines 32 to 46 |
| Emulsifying and dispersing methods of couplers | Column 71, line 3 to column 72, line 11 | Column 61, lines 36 to 49 | Column 87, lines 35 to 48 |
| Dye-image-preservability improving agents (antistaining agents) | Column 39, line 50 to column 70, line 9 | Column 61, line 50 to column 62, line 49 | Column 87, line 49 to column 88, line 48 |
| Anti-fading agents | Column 70, line 10 to column 71, line 2 | | |
| Dyes (coloring agents) | Column 77, line 42 to column 78, line 41 | Column 7, line 14 to column 19, line 42, and column 50, line 3 to column 51, line 14 | Column 9, line 27 to column 18, line 10 |
| Gelatins | Column 78, lines 42 to 48 | Column 51, lines 15 to 20 | Column 83, lines 13 to 19 |
| Layer construction of light-sensitive materials | Column 39, lines 11 to 26 | Column 44, lines 2 to 35 | Column 31, line 38 to column 32, line 33 |
| Film pH of light-sensitive materials | Column 72, lines 12 to 28 | | |
| Scanning exposure | Column 76, line 6 to column 77, line 41 | Column 49, line 7 to column 50, line 2 | Column 82, line 49 to column 83, line 12 |
| Preservatives in developer | Column 88, line 19 to column 89, line 22 | | |

As cyan, magenta, and yellow couplers which can be used in the present invention or can used in combination with the specific coupler defined in the present invention, other than the above-mentioned ones, those disclosed in JP-A-62-215272, page 91, right upper column, line 4 to page 121, left upper column, line 6; JP-A-2-33144, page 3, right upper column, line 14 to page 18, left upper column, bottom line, and page 30, right upper column, line 6 to page 35, right under column, line 11; and European Patent No. 0355,660 (A2), page 4, lines 15 to 27, page 5, line 30 to page 28, bottom line, page 45, lines 29 to 31, page 47, line 23 to page 63, line 50, are also advantageously used.

Further, it is preferred for the present invention to add compounds represented by formula (II) or (III) in WO 98/33760 and compounds represented by formula (D) described in JP-A-10-221825.

The magenta dye-forming coupler (which may be referred to simply as "magenta coupler") that can be used in the present invention can be a 5-pyrazolone-series magenta coupler or a pyrazoloazole-series magenta coupler, such as those described in the patent publications in the above table. Among these, preferred is a pyrazolotriazole coupler in which a secondary or tertiary alkyl group is directly bonded to the 2-, 3-, or 6-position of the pyrazolotriazole ring, such as those described in JP-A-61-65245; a pyrazoloazole coupler having a sulfonamido group in its molecule, such as those described in JP-A-61-65246; a pyrazoloazole coupler having an alkoxyphenylsulfonamido ballasting group, such as those described in JP-A-61-147254; and a pyrazoloazole coupler having an alkoxy or aryloxy group at the 6-position, such as those described in European Patent Nos. 226849 A and 294785 A, in view of hue and stability of an image to be formed therefrom, and color-forming property of the couplers. Particularly, as the magenta coupler, a pyrazoloazole coupler represented by formula (M-I) described in JP-A-8-122984 is preferred. The description of paragraph Nos. 0009 to 0026 of JP-A-8-122984 can be entirely applied to the present invention, and therefore is incorporated herein by reference. In addition, a pyrazoloazole coupler having each one steric hindrance group at both the 3- and 6-positions, as described in European Patent Nos. 854384 and 884640, can also be preferably used.

Further, as a yellow dye-forming coupler (which may be referred to simply as "yellow coupler"), other than the compounds described in the above-mentioned table, preferably use can be made of an acylacetamide-type yellow coupler in which the acyl group has a 3-membered to 5-membered ring structure, such as those described in European Patent No. 0447969 A1; a malondianilide-type yellow coupler having a ring structure, as described in European Patent No. 0482552 A1; a pyrrol-2 or 3-yl or indol-2 or 3-yl carbonyl acetanilide-series coupler, as described in European Patent (laid open to public) Nos. 953870 A1, 953871 A1, 953872 A1, 953873 A1, 953874 A1, and 953875 A1; an acylacetamide-type yellow coupler having a dioxane structure, such as those described in U.S. Pat. No. 5,118,599; or an acetanilide-type yellow coupler which has a hetero ring substituted on the acyl group, such as those described in JP-A-2003-173007. Among these couplers, use can be preferably made of the acylacetamide-type yellow coupler whose acyl group is a 1-alkylcyclopropane-1-carbonyl group, the malondianilide-type yellow coupler in which one anilido forms an indoline ring, or the acetanilide-type yellow coupler which has a hetero ring substituted on the acyl group. The couplers may be used singly or in combination with two or more of these.

It is preferred that coupler(s) for use in the present invention, is pregnated into a loadable latex polymer (as described, for example, in U.S. Pat. No. 4,203,716), in the presence (or absence) of the high-boiling-point organic solvent described in the foregoing table, or dissolved together with a polymer insoluble in water but soluble in an organic solvent, and then emulsified and dispersed into an aqueous hydrophilic colloid solution. Examples of the water-insoluble but organic-solvent-soluble polymer which can be preferably used, include the homo-polymers and co-polymers as disclosed in U.S. Pat. No. 4,857,449, from column 7 to column 15, and WO 88/00723, from page 12 to page 30. Use of a methacrylate-series or acrylamide-series polymer, especially an acrylamide-series polymer is more preferable, in view of color-image stabilization and the like.

In the present invention, any of known color mixing-inhibitors may be used. Among these compounds, those described in the following patent publications are preferred.

For example, high molecular weight redox compounds described in JP-A-5-333501; phenidone- or hydrazine-series compounds as described in, for example, WO 98/33760 and U.S. Pat. No. 4,923,787; and white couplers as described in, for example, JP-A-5-249637, JP-A-10-282615, and German Patent No. 19629142 A1, may be used. Particularly, in order to accelerate developing speed by increasing the pH of a developing solution, redox compounds described in, for example, German Patent No. 19,618,786 A1, European Patent Nos. 839,623 A1 and 842,975 A1, German Patent No. 19,806,846 A1 and French Patent No. 2,760,460 A1, are also preferably used.

In the present invention, as an ultraviolet ray absorbent, it is preferred to use a compound having a high molar extinction coefficient and a triazine skeleton. For example, compounds described in the following patent publications can be used. These compounds are preferably added to the light-sensitive layer or/and the light-insensitive layer. For example, use can be made of those described in JP-A-46-3335, JP-A-55-152776, JP-A-5-197074, JP-A-5-232630, JP-A-5-307232, JP-A-6-211813, JP-A-8-53427, JP-A-8-234364, JP-A-8-239368, JP-A-9-31067, JP-A-10-115898, JP-A-10-147577, JP-A-10-182621, German Patent No. 19,739,797A, European Patent No. 0,711,804 A, and JP-T-8-501291 ("JP-T" means searched and published International patent application), and the like.

As the binder or protective colloid which can be used in the light-sensitive material of the present invention, gelatin is used advantageously, but another hydrophilic colloid can be used singly or in combination with gelatin. It is preferable for the gelatin that the content of heavy metals, such as Fe, Cu, Zn, and Mn, included as impurities, be reduced to 5 ppm or below, more preferably 3 ppm or below. Further, the amount of calcium contained in the light-sensitive material is preferably 20 mg/$M^2$ or less, more preferably 10 mg/$M^2$ or less, and most preferably 5 mg/$M^2$ or less.

In the present invention, it is preferred to add an antibacterial (fungi-preventing) agent and antimold agent, as described in JP-A-63-271247, in order to destroy various kinds of molds and bacteria which propagate in a hydrophilic colloid layer and deteriorate the image. Further, the film pH of the light-sensitive material is preferably in the range of 4.0 to 7.0, more preferably in the range of 4.0 to 6.5.

In the present invention, a surfactant may be added to the light-sensitive material, in view of improvement in coating-stability, prevention of static electricity from being occurred, and adjustment of the charge amount. As the surfactant, mention can be made of anionic, cationic, betaine, and nonionic surfactants. Examples thereof include those described in JP-A-5-333492. As the surfactant that can be used in the present invention, a fluorine-containing surfactant is particularly preferred. The fluorine-containing surfactant may be used singly, or in combination with known other surfactant. The fluorine-containing surfactant is preferably used in combination with known other surfactant. The amount of the surfactant to be added to the light-sensitive material is not particularly limited, but it is generally in the range of $1\times10^{-5}$ to 1 g/m$^2$, preferably in the range of $1\times10^{-4}$ to $1\times10^{-1}$ g/m$^2$, and more preferably in the range of $1\times10^{-3}$ to $1\times10^{-2}$ g/m$^2$.

The photosensitive material of the present invention can form an image, as shown in the specific example of an image-forming apparatus for performing exposure to the photosensitive material, by undergoing an exposure step of irradiating the photosensitive material with light responsive to image information, and a development step of processing the light-irradiated photosensitive material.

The light-sensitive material of the present invention can preferably be used in the digital scanning exposure system using monochromatic high density light, such as a gas laser, a light-emitting diode, a semiconductor laser, a second harmonic generation light source (SHG) comprising a combination of nonlinear optical crystal with a semiconductor laser or a solid state laser using a semiconductor laser as an excitation light source. It is preferred to use a semiconductor laser, or a second harmonic generation light source (SHG) comprising a combination of nonlinear optical crystal with a solid state laser or a semiconductor laser, to make a system more compact and inexpensive. In particular, to design a compact and inexpensive apparatus having a longer duration of life and high stability, use of a semiconductor laser is preferable; and it is preferred that at least one of exposure light sources uses a semiconductor laser.

For the photographic material of the present invention, it is preferable to carry out image-wise exposure, by using coherent light of a blue laser with emission wavelength of 420 nm to 460 nm. Among the blue lasers, a blue semiconductor laser can be used particularly preferably.

Specific examples of the laser light source that can be preferably used, include a blue-light semiconductor laser of wavelength 430 to 450 nm (Presentation by Nichia Corporation at the 48th Applied Physics Related Joint Meeting, in March of 2001); a blue laser at about 470 nm obtained by wavelength modulation of a semiconductor laser (oscillation wavelength about 940 nm) with a SHG crystal of $LiNbO_3$ having a reversed domain structure in the form of a wave guide; a green-light laser at about 530 nm obtained by wavelength modulation of a semiconductor laser (oscillation wavelength about 1,060 nm) with SHG crystal of $LiNbO_3$ having a reversed domain structure in the form of a wave guide; a red-light semiconductor laser of wavelength at about 685 nm (Type No. HL6738MG (trade name) manufactured by Hitachi, Ltd.); and a red-light semiconductor laser of wavelength at about 650 nm (Type No. HL6501MG (trade name) manufactured by Hitachi, Ltd.).

When such a scanning exposure light source is used, the maximum spectral sensitivity wavelength of the light-sensitive material of the present invention can be arbitrarily set up in accordance with the wavelength of a scanning exposure light source to be used. Since oscillation wavelength of a laser can be made half, using a SHG light source obtainable by a combination of a nonlinear optical crystal with a semiconductor laser or a solid state laser using a semiconductor as an excitation light source, blue light and green light can be obtained. Accordingly, it is possible to have the spectral sensitivity maximum of a light-sensitive material in usual three wavelength regions of blue, green, and red. In the present invention, the exposure time in such a scanning exposure is defined as the time period necessary to expose the size of the picture element (pixel) with the density of the picture element being 300 dpi, and a preferred exposure time is $1\times10^{-4}$ sec or less, more preferably $1\times10^{-6}$ sec or less.

The silver halide color photosensitive material of the present invention can be preferably used in combination with the exposure and development system described in the following literatures. Example of the development system include the automatic print and development system described in JP-A-10-333253, the photosensitive material-conveying apparatus described in JP-A-2000-10206, a recording system including image reading apparatus, as described in JP-A-11-215312, exposure systems with the color image recording methods, as described in JP-A-11-88619 and JP-A-10-202950, a digital photo print system including remote diagnosis method, as described in JP-A-10-210206, and a photo print system including image recording apparatus, as described in JP-A-2000-310822.

The preferred scanning exposure methods which can be applied to the present invention are described in detail in the publications listed in the table shown above.

In order to process the light-sensitive material of the present invention, any of processing materials and processing methods described in JP-A-2-207250, page 26, right lower column, line 1, to page 34, right upper column, line 9, and in JP-A-4-97355, page 5, left upper column, line 17, to page 18, right lower column, line 20, can be applied preferably. Further, as the preservative for use in the developing solution, compounds described in the patent publications listed in the above table can be used preferably.

The light-sensitive material of the present invention can also be preferably applied to a light-sensitive material having rapid processing suitability.

When rapid process is carried out, it is preferable to start color-development processing within 9 seconds after the exposure.

In the case of conducting rapid processing, the color-developing time is preferably 30 sec or less, more preferably 28 sec or less, further more preferably from 25 sec to 6 sec, and particularly preferably from 20 sec to 6 sec. Likewise, the blix time is preferably 30 sec or less, more preferably from 25 sec to 6 sec, and further preferably from 20 sec to 6 sec. Further, the washing or stabilizing time is preferably 60 sec or less, and more preferably from 40 sec to 6 sec.

Herein, the term "color-developing time" as used herein means a period of time required from the beginning of dipping a light-sensitive material into a color developing solution until the light-sensitive material is dipped into a blix solution in the subsequent processing step. For example, when processing is carried out using an autoprocessor or the like, the color developing time is the sum total of a time in which a light-sensitive material has been dipped in a color developing solution (so-called "time in solution") and a time in which the light-sensitive material has left the color developing solution and been conveyed in the air toward a bleach-fixing bath in the step subsequent to color development (so-called "time in the air"). Likewise, the term "blix time" as used herein means a period of time required from the beginning of dipping a light-sensitive material into a blix solution until the light-sensitive material is dipped into a washing or stabilizing bath in the subsequent processing step. Further, the term "washing or stabilizing time" as used herein means a period of time required from the beginning of dipping a light-sensitive material into a washing or stabilizing solution until the end of the dipping toward a drying step (so-called "time in solution").

In particular, for the light-sensitive material of the present invention, the color-developing time is preferably adjusted to 20 seconds or below (more preferably from 6 to 20 seconds, especially preferably from 6 to 15 seconds). Herein, the expression "color-development processing with a color developing time of 20 seconds or below" means that the above-mentioned color-developing time is 20 seconds or below (and does not mean performing the whole processing steps for color development processing within such a time).

The present invention will be described in more detail based on the following examples, but the invention is not intended to be limited thereto.

EXAMPLES

Example 1

(Preparation of Blue-sensitive Layer Emulsion BH-1)

Using a method of simultaneously adding a silver nitrate solution and a sodium chloride solution into deionized distilled water containing a deionized gelatin under stirring to mix these, high-silver chloride cubic grains were prepared. In the course of this preparation, at the step of from 10% to 20% addition of the entire silver nitrate amount, $Cs_2[OsCl_5(NO)]$ was added. At the step of from 70% to 85% addition of the entire silver nitrate amount, potassium bromide (3.0 mol %, per mol of the finished silver halide) and $K_4[Fe(CN)_6]$ were added. $K_2[IrCl_6]$ was added at the step of from 75% to 80% addition of the entire silver nitrate amount. $K_2[IrCl_5(H_2O)]$ and $K[IrCl_4(H_2O)_2]$ were added at the step of from 88% to 98% addition of the entire silver nitrate amount. Potassium iodide (0.4 mol %, per mol of the finished silver halide) was added, under vigorous stirring, at the step of completion of 93% addition of the entire silver nitrate amount. The thus-obtained emulsion grains were monodisperse cubic silver iodobromochloride grains of side length 0.25 μm and variation coefficient 9.5%. After the resultant emulsion was subjected to sedimentation desalting, to the resultant emulsion added were gelatin, Compounds Ab-1, Ab-2 and Ab-3, and calcium nitrate, and followed by re-dispersing.

The re-dispersed emulsion was dissolved at 40° C., and thereto were added sodium benzenethiosulfate, p-glutaramidophenyldisulfide, Compound-1 as a gold-sulfur sensitizer, SE3-9 as a selenium sensitizer, and (bis(1,4,5-trimethyl-1,2,4-triazolium-3-thiorato)aurate (I) tetrafluoroborate) as a gold sensitizer, followed by repening to conduct chemical sensitization optimally. Then, added thereto were 1-(3-acetoamidophenyl)-5-mercaptotetrazole; 1-(5-methylureidophenyl)-5-mercaptotetrazole; Compound 2; a compound whose major components were recurring units 2 or 3 represented by Compound-3, in which both ends $X_1$ and $X_2$ each were a hydroxy group; Compound-4; and potassium bromide. Further, in a midway of the emulsion preparation process, Sensitizing dyes S-1, S-2 and S-3 were added, to conduct spectral sensitization. The thus-obtained emulsion was designated to as Emulsion BH-1.

(Ab-1) Antiseptic

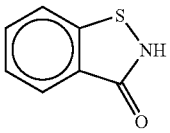

(Ab-2) Antiseptic

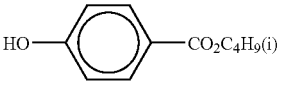

(Ab-3) Antiseptic

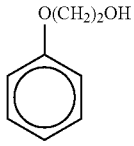

(Ab-4) Antiseptic

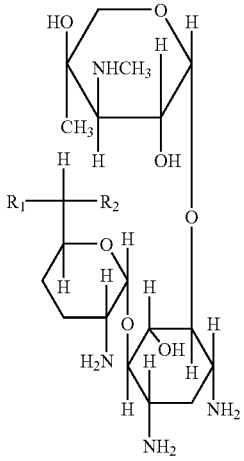

A mixture in 1:1:1:1 of a, b, c, and d (mol ratio)

| | $R_1$ | $R_2$ |
|---|---|---|
| a | —$CH_3$ | —$NHCH_3$ |
| b | —$CH_3$ | —$NH_2$ |
| c | —H | —$NH_2$ |
| d | —H | —$NHCH_3$ |

Sensitizing dye S-1

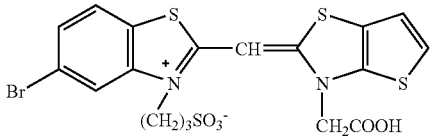

Sensitizing dye S-2

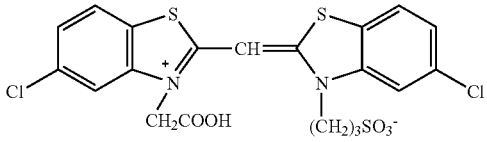

Sensitizing dye S-3

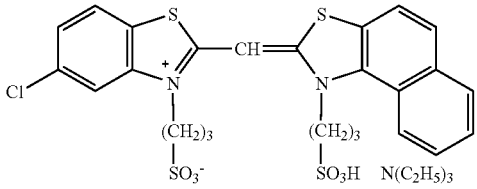

Compound-1

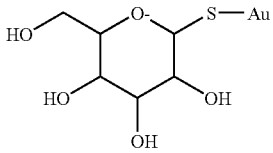

-continued

Compound-2

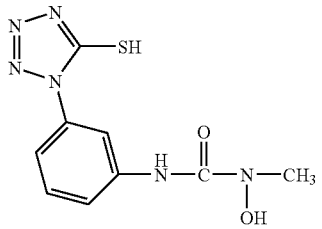

Compound-3

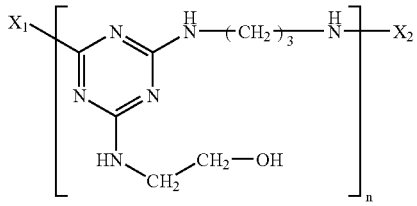

Compound-4

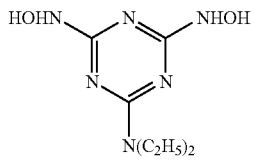

(Preparation of Green-sensitive Layer Emulsion GH-1)

Using a method of simultaneously adding silver nitrate and sodium chloride into deionized distilled water containing a deionized gelatin under stirring to mix these, high-silver chloride cubic grains were prepared. In the course of this preparation, at the step of from 70% to 85% addition of the entire silver nitrate amount, $K_4[Ru(CN)_6]$ was added. At the step of from 70% to 85% addition of the entire silver nitrate amount, potassium bromide (1 mol %, per mol of the finished silver halide) was added. $K_2[IrCl_6]$ and $K_2[RhBr_5(H_2O)]$ were added at the step of from 70% to 85% addition of the entire silver nitrate amount. Potassium iodide (0.2 mol %, per mol of the finished silver halide) was added, under vigorous stirring, at the step of completion of 90% addition of the entire silver nitrate amount. Further, $K_2[IrCl_5(H_2O)]$ and $K[IrCl_4(H_2O)_2]$ were added at the step of from 87% to 98% addition of the silver nitrate amount. The thus-obtained emulsion grains were monodisperse cubic silver iodobromochloride grains of side length 0.25 μm and variation coefficient 9.5%. The resultant emulsion was subjected to sedimentation desalting and re-dispersing in the same manner as in the above.

This emulsion was dissolved at 40° C., and thereto sodium benzenethiosulfate, p-glutaramidophenyldisulfide, SE3-9 as a selenium sensitizer, and (bis(1,4,5-trimethyl-1,2,4-triazolium-3-thiorato) aurate (I) tetrafluoroborate) as a gold sensitizer were added, followed by ripening for optimal chemical sensitization. Then, 1-(3-acetoamidophenyl)-5-mercaptotetrazole, 1-(5-methylureidophenyl)-5-mercaptotetrazole, Compound 2, Compound 4, and potassium bromide were added. Further, in a midway of the emulsion preparation process, Sensitizing dyes S-4, S-5, S-6 and S-7 were added as sensitizing dyes, to conduct spectral sensitization. The thus-obtained emulsion was designated to as Emulsion GH-1.

Sensitizing dye S-4

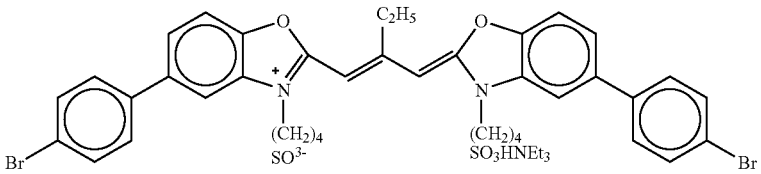

Sensitizing dye S-5

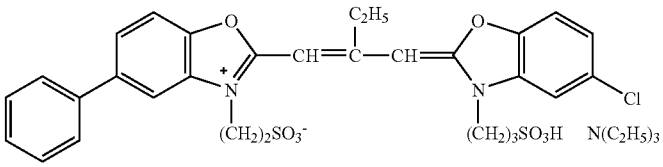

Sensitizing dye S-6

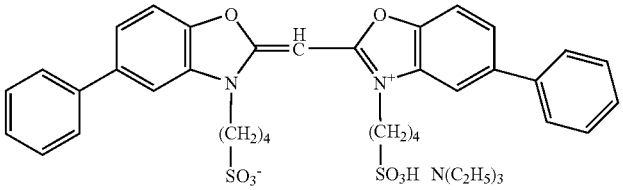

Sensitizing dye S-7

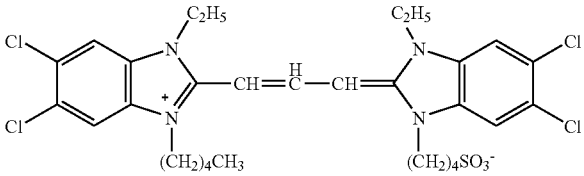

(Preparation of Red-sensitive Layer Emulsion RH-1)

Using a method of simultaneously adding silver nitrate and sodium chloride into deionized distilled water containing deionized gelatin under stirring to mix these, high-silver chloride cubic grains were prepared. In the course of this preparation, at the step of from 60% to 80% addition of the entire silver nitrate amount, $Cs_2[OsCl_5(NO)]$ was added. At the step of from 93% to 98% addition of the entire silver nitrate amount, $K_4[Ru(CN)_6]$ was added. At the step of from 85% to 100% addition of the entire silver nitrate amount, potassium bromide (3 mol %, per mol of the finished silver halide) was added. $K_2[IrCl_5(5\text{-methylthiazole})]$ was added at the step of from 88% to 93% addition of the entire silver nitrate amount. Potassium iodide (the amount of silver iodide would be 0.05 mol %, per mol of the finished silver halide) was added, under vigorous stirring, at the step of completion of 93% addition of the entire silver nitrate amount. Further, $K_2[IrCl_5(H_2O)]$ and $K[IrCl_4(H_2O)_2]$ were added at the step of from 93% to 98% addition of the entire silver nitrate amount. The thus-obtained emulsion grains were monodisperse cubic silver iodobromochloride grains of side length 0.25 μm and variation coefficient 9.5%. The resultant emulsion was subjected to sedimentation desalting and re-dispersing in the same manner as above.

This emulsion was dissolved at 40° C., and Sensitizing dye S-8, Compound-5, sodium benzenethiosulfate, p-glutaramidophenyldisulfide, SE3-9 as a selenium sensitizer, and (bis (1,4,5-trimethyl-1,2,4-triazolium-3-thiorato) aurate (I) tetrafluoroborate) as a gold sensitizer were added, followed by ripening for optimal chemical sensitization. Thereafter, 1-(3-acetoamidophenyl)-5-mercaptotetrazole, 1-(5-methylureidophenyl)-5-mercaptotetrazole, Compound-2, Compound-4, and potassium bromide were added. The thus-obtained emulsion was designated to as Emulsion RH-1.

Sensitizing dye S-8

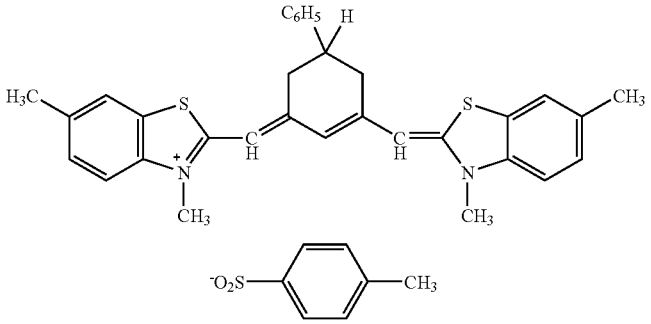

Compound-5

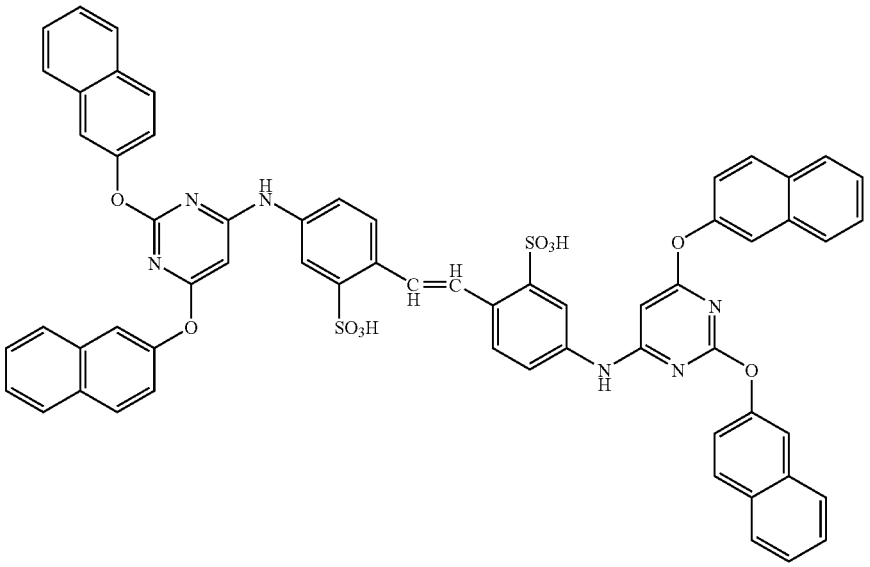

(H-1) Hardener

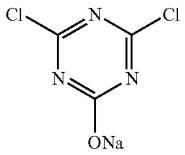

(H-2) Hardener

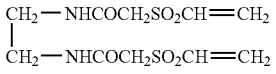

-continued (H-3) Hardener

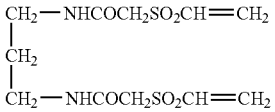

(Preparation of Red-sensitive Layer Emulsion RH-2)

Emulsion RH-2 was prepared in the same manner as in the preparation of Emulsion RH-1, except that Compound-1 was added as a gold-sulfur sensitizer in place of the selenium sensitizer SE3-9, that the gold sensitizer (bis(1,4,5-trimethyl-1,2,4-triazolium-3-thiolato) aurate (I) tetrafluoroborate) was not added, and that amounts of the compounds to be added were changed from those in RH-1.

(Preparation of Red-sensitive Layer Emulsion RH-3)

Emulsion RH-3 was prepared in the same manner as in the preparation of Emulsion RH-1, except that SE3-29 was added in place of the selenium sensitizer SE3-9, and that amounts of the compounds to be added were changed from those in RH-1.

(Preparation of Red-sensitive Layer Emulsion RH-4)

Emulsion RH-4 was prepared in the same manner as in the preparation of Emulsion RH-1, except that PF1-1 was added in place of the selenium sensitizer SE3-9, and that amounts of the compounds to be added were changed from those in RH-1.

(Preparation of Red-sensitive Layer Emulsion RH-5)

Emulsion RH-5 was prepared in the same manner as in the preparation of Emulsion RH-1, except that PF6-1 was added in place of the selenium sensitizer SE3-9, and that amounts of the compounds to be added were changed from those in RH-1.

(Preparation of Red-sensitive Layer Emulsion RH-6)

Emulsion RH-6 was prepared in the same manner as in the preparation of Emulsion RH-1, except that the amount of potassium iodide to be added was changed such that the amount of silver iodide would be 0.3 mol %, per mol of the finished silver halide.

(Preparation of Red-sensitive Layer Emulsion RH-7)

Emulsion RH-7 was prepared in the same manner as in the preparation of Emulsion RH-6, except that Compound-1 was added as a gold-sulfur sensitizer in place of the selenium sensitizer SE3-9, that the gold sensitizer (bis(1,4,5-trimethyl-1,2,4-triazolium-3-thiolato) aurate (I) tetrafluoroborate) was not added, and that amounts of the compounds to be added were changed from those in RH-6.

(Preparation of Red-sensitive Layer Emulsion RH-8)

Emulsion RH-8 was prepared in the same manner as in the preparation of Emulsion RH-6, except that SE3-29 was added in place of the selenium sensitizer SE3-9, and that amounts of the compounds to be added were changed from those in RH-6.

(Preparation of Red-sensitive Layer Emulsion RH-9)

Emulsion RH-9 was prepared in the same manner as in the preparation of Emulsion RH-6, except that PF6-1 was added in place of the selenium sensitizer SE3-9, and that amounts of the compounds to be added were changed from those in RH-6.

Preparation of Coating Solution for the First Layer

Into 17 g of a solvent (Solv-4), 3 g of a solvent (Solv-6), 17 g of a solvent (Solv-9) and 45 ml of ethyl acetate, were dissolved 24 g of a yellow coupler (Ex-Y), 6 g of a color-image stabilizer (Cpd-8), 1 g of a color-image stabilizer (Cpd-16), 1 g of a color-image stabilizer (Cpd-17), and 1 g of a color-image stabilizer (Cpd-18), 1 g of a color-image stabilizer (Cpd-19), 11 g of a color-image stabilizer (Cpd-21), 0.1 g of an additive (ExC-3), and 1 g of a color-image stabilizer (UV-A). This solution was emulsified and dispersed in 205 g of a 20 mass % aqueous gelatin solution containing 3 g of sodium dodecylbenzenesulfonate, with a high-speed stirring emulsifier (dissolver). Water was added thereto, to prepare 700 g of Emulsified dispersion A.

Then, the above Emulsified dispersion A and the Emulsions BH-1 were mixed and dissolved, to prepare the first-layer coating solution so that it would have the composition shown below. The coating amount of the emulsion is in terms of silver.

The coating solutions for the second layer to the seventh layer were prepared in the similar manner as that for the first-layer coating solution. As a gelatin hardener for each layer, (H-1), (H-2), and (H-3) were used. Further, to each layer, were added Ab-1, Ab-2, Ab-3, and Ab-4, so that the total amounts would be 10.0 mg/m$^2$, 45.0 mg/M$^2$, 5.0 mg/M$^2$, and 10.0 mg/M$^2$, respectively.

Further, to the third layer, the fifth layer, and the sixth layer, was added 1-(3-methylureidophenyl)-5-mercaptotetrazole in amounts of 0.2 mg/m$^2$, 0.2 mg/m$^2$, and 0.6 mg/mr$^2$, respectively. To the blue-sensitive emulsion layer and the green-sensitive emulsion layer, was added 4-hydroxy-6-methyl-1,3,3a,7-tetrazaindene in amounts of $1\times10^{-4}$ mol and $2\times10^{-4}$ mol, respectively, pre mol of the silver halide. To the red-sensitive emulsion layer, was added a copolymer latex of methacrylic acid and butyl acrylate (1:1 in mass ratio; average molecular weight, 200,000 to 400,000) in an amount of 0.05 g/m$^2$. Disodium catecol-3,5-disulfonate was added to the third layer, the fifth layer, and the sixth layer so that coating amounts would be 6 mg/M$^2$, 6 mg/M$^2$, and 18 mg/m$^2$, respectively. Further, to each layer, sodium polystyrene sulfonate was added to adjust viscosity of the coating solutions, if necessary. Further, in order to prevent irradiation, the following dyes (coating amounts are shown in parentheses) were added.

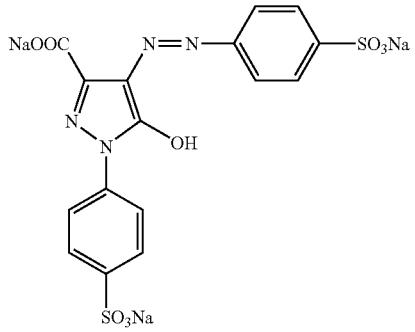

(2 mg/m$^2$)

-continued

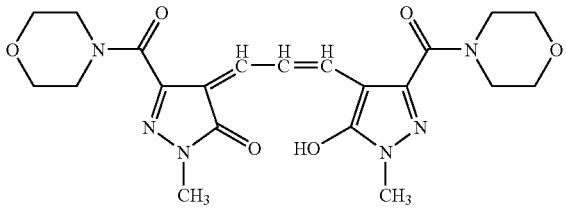

(3 mg/m²)

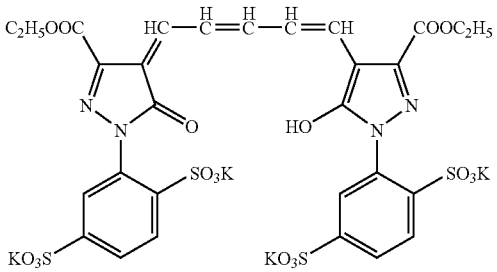

(10 mg/m²)

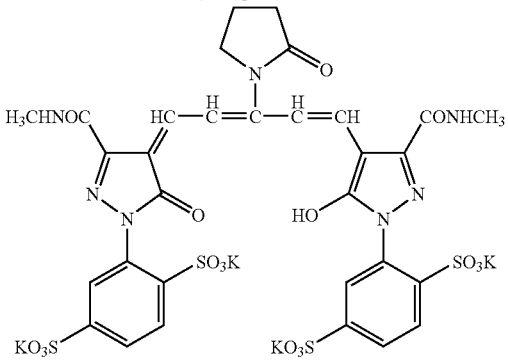

(16 mg/m²)

(Layer Structure)

The composition of each layer is shown below. The numerals show coating amounts (g/m²).

In the case of the silver halide emulsion, the coating amount is in terms of silver.

Support

Polyethylene resin laminated paper {The polyethylene resin on the first layer side contained white pigments ($TiO_2$, content of 16 mass %; ZnO, content of 4 mass %), a fluorescent whitening agent (4,4'-bis(5-methylbenzoxazolyl)stilbene, content of 0.03 mass %), and a bluish dye (ultramarine, content of 0.33 mass %); and the amount of the polyethylene resin was 29.2 g/m².}

| First layer (Blue-sensitive emulsion layer) | |
|---|---|
| Emulsion (BH-1) | 0.15 |
| Gelatin | 1.00 |
| Yellow coupler (Ex-Y) | 0.27 |
| Color-image stabilizer (Cpd-8) | 0.06 |
| Color-image stabilizer (Cpd-16) | 0.01 |
| Color-image stabilizer (Cpd-17) | 0.01 |
| Color-image stabilizer (Cpd-18) | 0.12 |

-continued

| | |
|---|---|
| Color-image stabilizer (Cpd-19) | 0.01 |
| Color-image stabilizer (Cpd-21) | 0.11 |
| Additive (ExC-3) | 0.001 |
| Color-image stabilizer (UV-A) | 0.01 |
| Solvent (Solv-4) | 0.17 |
| Solvent (Solv-6) | 0.03 |
| Solvent (Solv-9) | 0.17 |
| Second layer (Intermediate color-forming layer) | |
| Gelatin | 0.33 |
| Yellow coupler (Ex-Y) | 0.08 |
| Color-image stabilizer (Cpd-8) | 0.02 |
| Color-image stabilizer (Cpd-16) | 0.01 |
| Color-image stabilizer (Cpd-17) | 0.01 |
| Color-image stabilizer (Cpd-18) | 0.03 |
| Color-image stabilizer (Cpd-19) | 0.01 |
| Color-image stabilizer (Cpd-21) | 0.03 |
| Additive (ExC-3) | 0.001 |
| Color-image stabilizer (UV-A) | 0.01 |
| Solvent (Solv-4) | 0.05 |
| Solvent (Solv-6) | 0.01 |
| Solvent (Solv-9) | 0.05 |
| Third layer (Color-mixing-preventing layer) | |
| Gelatin | 0.31 |
| Color-mixing-prevention agent (Cpd-4) | 0.020 |
| Color-mixing-prevention agent (Cpd-12) | 0.004 |
| Color-image stabilizer (Cpd-3) | 0.004 |
| Color-image stabilizer (Cpd-5) | 0.004 |
| Color-image stabilizer (Cpd-6) | 0.020 |
| Color-image stabilizer (UV-A) | 0.020 |
| Color-image stabilizer (Cpd-7) | 0.002 |
| Solvent (Solv-1) | 0.024 |
| Solvent (Solv-2) | 0.024 |
| Solvent (Solv-5) | 0.028 |
| Solvent (Solv-8) | 0.028 |
| Fourth layer (Red-sensitive emulsion layer) | |
| Emulsion (RH-1) | 0.10 |
| Gelatin | 0.77 |
| Cyan coupler (ExC-1) | 0.16 |
| Cyan coupler (ExC-2) | 0.005 |
| Cyan coupler (ExC-3) | 0.01 |
| Color-image stabilizer (Cpd-1) | 0.01 |
| Color-image stabilizer (Cpd-7) | 0.01 |
| Color-image stabilizer (Cpd-9) | 0.03 |
| Color-image stabilizer (Cpd-10) | 0.001 |
| Color-image stabilizer (Cpd-14) | 0.001 |
| Color-image stabilizer (Cpd-15) | 0.15 |
| Color-image stabilizer (Cpd-16) | 0.03 |
| Color-image stabilizer (Cpd-17) | 0.02 |
| Color-image stabilizer (UV-5) | 0.07 |
| Solvent (Solv-5) | 0.07 |
| Fifth layer (Color-mixing-preventing layer) | |
| Gelatin | 0.39 |
| Color-mixing-prevention agent (Cpd-4) | 0.025 |
| Color-mixing-prevention agent (Cpd-12) | 0.005 |
| Color-image stabilizer (Cpd-3) | 0.005 |
| Color-image stabilizer (Cpd-5) | 0.005 |
| Color-image stabilizer (Cpd-6) | 0.025 |
| Color-image stabilizer (UV-A) | 0.025 |
| Color-image stabilizer (Cpd-7) | 0.002 |
| Solvent (Solv-1) | 0.030 |
| Solvent (Solv-2) | 0.030 |
| Solvent (Solv-5) | 0.035 |
| Solvent (Solv-8) | 0.035 |
| Sixth layer (Green-sensitive emulsion layer) | |
| Emulsion (GH-1) | 0.09 |
| Gelatin | 1.05 |
| Magenta coupler (ExM) | 0.11 |
| Color-image stabilizer (Cpd-2) | 0.01 |
| Color-image stabilizer (Cpd-8) | 0.01 |
| Color-image stabilizer (Cpd-9) | 0.005 |
| Color-image stabilizer (Cpd-10) | 0.005 |
| Color-image stabilizer (Cpd-11) | 0.0001 |
| Color-image stabilizer (Cpd-18) | 0.01 |

-continued

| | |
|---|---|
| Ultraviolet absorber (UV-B) | 0.26 |
| Solvent (Solv-3) | 0.04 |
| Solvent (Solv-4) | 0.08 |
| Solvent (Solv-6) | 0.05 |
| Solvent (Solv-9) | 0.12 |
| Solvent (Solv-7) | 0.11 |
| Compound (S1-4) | 0.0015 |
| Seventh layer (Protective layer) | |
| Gelatin | 0.44 |
| Additive (Cpd-20) | 0.015 |
| Liquid paraffin | 0.01 |
| Surfactant (Cpd-13) | 0.01 |

(Ex-Y) Yellow coupler

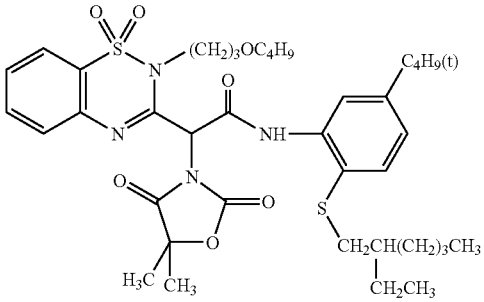

(Ex-M) Magenta coupler

A mixture in 40:40:20 (mol ratio) of

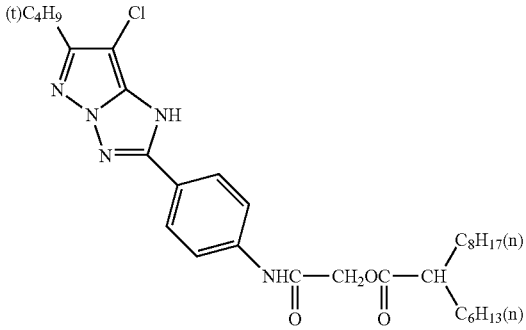

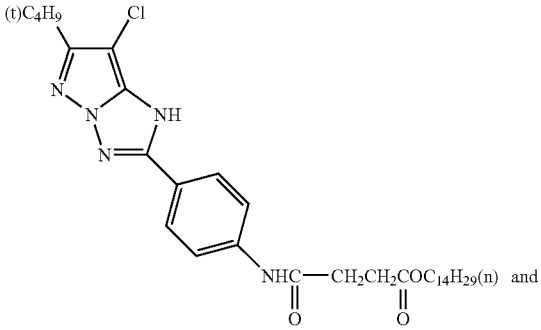

and

-continued

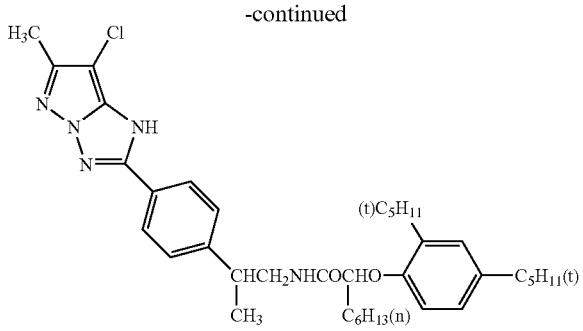

(ExC-1) Cyan coupler

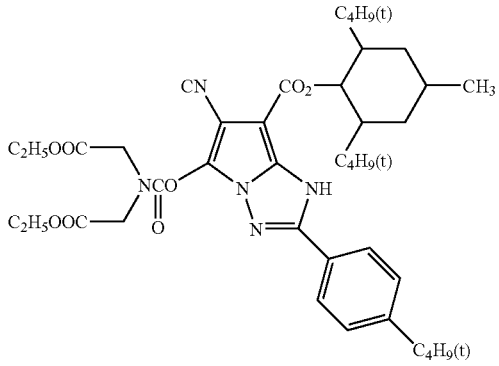

(ExC-2) Cyan coupler

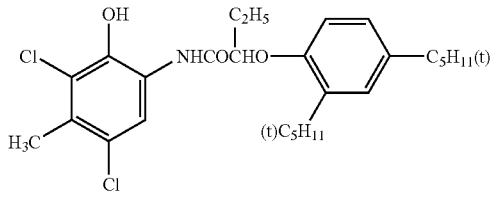

(ExC-3) Cyan coupler

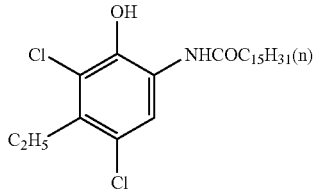

(Cpd-1) Color-image stabilizer

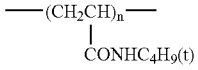

Number-average molecular weight 60,000

(Cpd-2) Color-image stabilizer

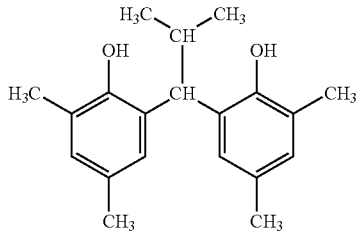

-continued
(Cpd-3) Color-image stabilizer
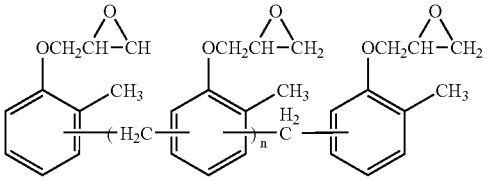
n = 7~8 (Average value)
(Cpd-4) Color-image stabilizer
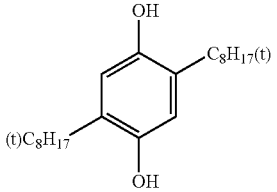
(Cpd-5) Color-image stabilizer
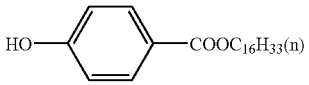
(Cpd-6) Color-image stabilizer
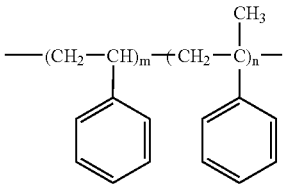
Number-average molecular weight 600, m/n = 10/90
(Cpd-7) Color-image stabilizer
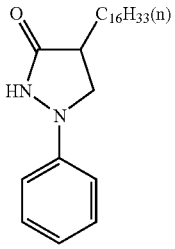
(Cpd-8) Color-image stabilizer
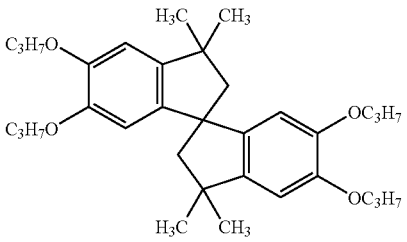
(Cpd-9) Color-image stabilizer
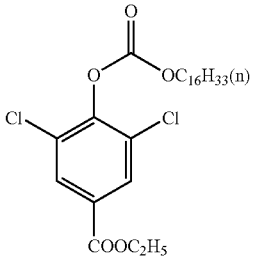
-continued
(Cpd-10) Color-image stabilizer
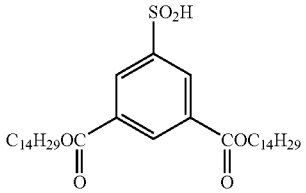
(Cpd-11)
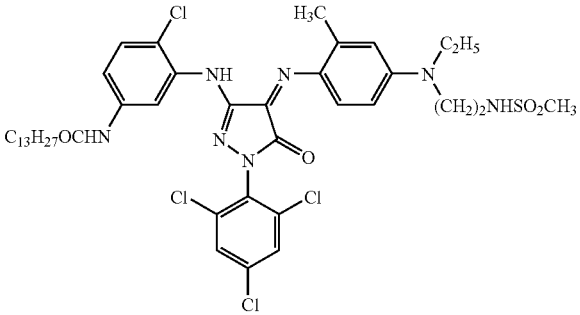
(Cpd-12)
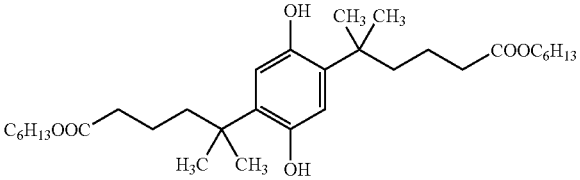
(C p d-13) A mixture in 6:2:2 of (a), (b), and (c) (mol ratio)
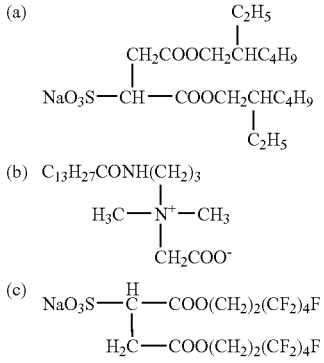
(Cpd-14)
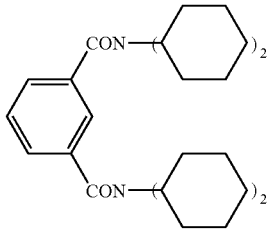
(Cpd-15)
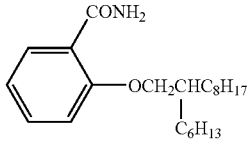

-continued (Cpd-16)

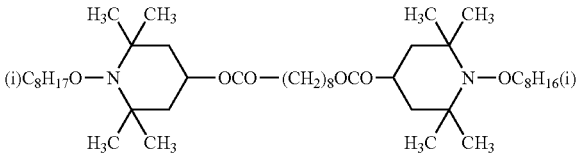

(Cpd-17)

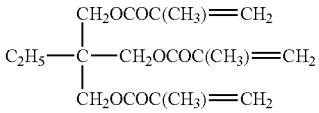

(Cpd-18)

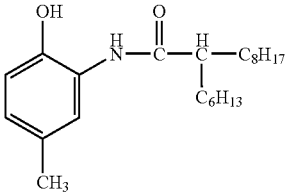

(Cpd-19)

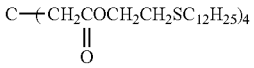

(Cpd-20)

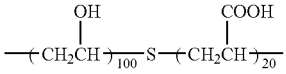

(Mass ratio)

(Cpd-21)

KAYARAD DPCA-30,
trade name, manufactured by Nippon Kayaku Co. Ltd.

(Solv-1)

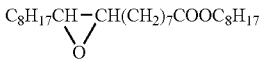

(Solv-2)

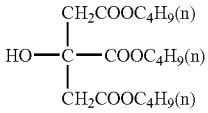

(Solv-3)

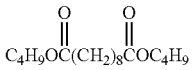

(Solv-4)

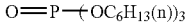

(Solv-5)

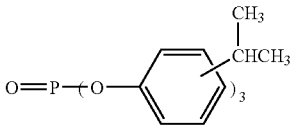

(Solv-6)

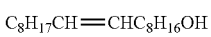

(Solv-7)

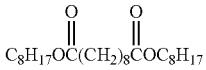

(Solv-8)

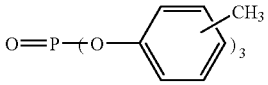

(Solv-9)

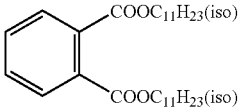

-continued (S1-4)

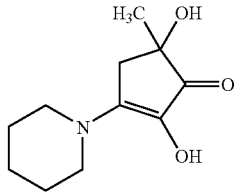

(UV-1)

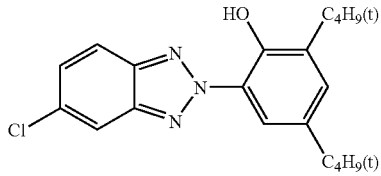

(UV-2)

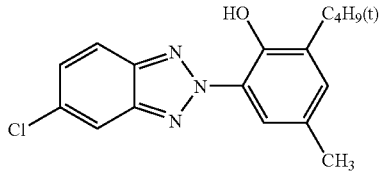

(UV-3)

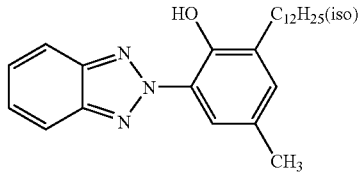

(UV-4)

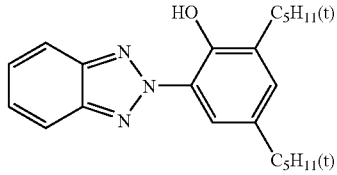

(UV-5)

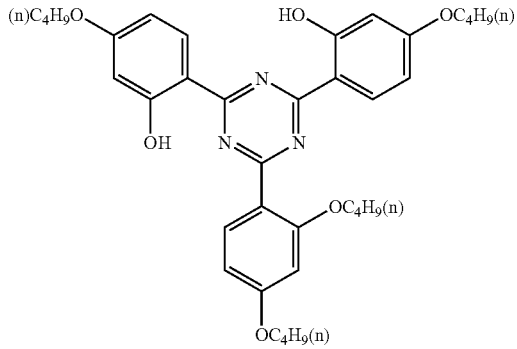

UV-A: A mixture of (UV-1)/(UV-4)/(UV-5) = 1/7/2 (Mass ratio)
UV-B: A mixture of (UV-1)/(UV-2)/(UV-3)/(UV-4)/(UV-5) = 1/1/2/3/3 (Mass ratio)

The thus-prepared sample was designated to as Sample 101. Further, Samples 102 to 105 and 121 to 124 were prepared in the same manner as Sample 101, except that the structure of the fourth layer was changed, as shown in Table 2 below, but in the same amount of the coated silver as in Sample 101.

Preparation of Sample 111

Sample 111 was prepared in the same manner as Sample 101, except that the composition of the fourth layer of Sample 101 was changed as described below.

| Fourth layer (Red-sensitive emulsion layer) | |
|---|---|
| Emulsion (RH-1) | 0.09 |
| Gelatin | 0.87 |
| Cyan coupler (IC-22) | 0.22 |
| Color-image stabilizer (Cpd-1) | 0.01 |
| Color-image stabilizer (Cpd-7) | 0.01 |
| Color-image stabilizer (Cpd-9) | 0.03 |
| Color-image stabilizer (Cpd-10) | 0.001 |
| Color-image stabilizer (Cpd-14) | 0.001 |
| Color-image stabilizer (Cpd-15) | 0.15 |
| Color-image stabilizer (Cpd-16) | 0.03 |
| Color-image stabilizer (Cpd-17) | 0.02 |
| Color-image stabilizer (UV-5) | 0.07 |
| Solvent (Solv-5) | 0.07 |

Samples 112 to 116 and 125 to 128 were prepared in the same manner as Sample 111, except that the composition of the fourth layer was changed, as shown in Table 2, but not to change the amount of coated silver and the molar concentration ratio of the coated silver to the coupler.

TABLE 2

| Sample | Emulsion | Coupler | Remarks |
|---|---|---|---|
| 101 | RH-1 | ExC-1, ExC-2, ExC-3 | Comparative example |
| 102 | RH-2 | ExC-1, ExC-2, ExC-3 | Comparative example |
| 103 | RH-3 | ExC-1, ExC-2, ExC-3 | Comparative example |
| 104 | RH-4 | ExC-1, ExC-2, ExC-3 | Comparative example |
| 105 | RH-5 | ExC-1, ExC-2, ExC-3 | Comparative example |
| 111 | RH-1 | IC-22 | This invention |
| 112 | RH-2 | IC-6 | Comparative example |
| 113 | RH-3 | IC-29 | This invention |
| 114 | RH-4 | IC-30 | This invention |
| 115 | RH-5 | IC-23 | This invention |
| 116 | RH-5 | IC-29 | This invention |
| 121 | RH-6 | ExC-1, ExC-2, ExC-3 | Comparative example |
| 122 | RH-7 | ExC-1, ExC-2, ExC-3 | Comparative example |
| 123 | RH-8 | ExC-1, ExC-2, ExC-3 | Comparative example |
| 124 | RH-9 | ExC-1, ExC-2, ExC-3 | Comparative example |
| 125 | RH-6 | IC-22 | This invention |
| 126 | RH-7 | IC-6 | Comparative example |
| 127 | RH-8 | IC-30 | This invention |
| 128 | RH-9 | IC-23 | This invention |

Processing A

The aforementioned Sample 101 was made into a roll with width 127 mm; the resultant sample was exposed to light with a standard photographic image, using Digital Minilab Frontier 350 (trade name, manufactured by Fuji Photo Film Co., Ltd.); and then, the exposed sample was continuously processed (running test) in the following processing steps, until an accumulated replenisher amount of the color developing solution reached to be equal to twice the color developer tank volume. A processing with this running processing solutions was named processing A.

| Processing step | Temperature | Time | Replenishment rate* |
|---|---|---|---|
| Color development | 38.5° C. | 45 sec | 45 mL |
| Bleach-fixing | 38.0° C. | 45 sec | Replenisher A 17.5 mL<br>Replenisher B 17.5 mL |

-continued

| Processing step | Temperature | Time | Replenishment rate* |
|---|---|---|---|
| Rinse 1 | 38.0° C. | 20 sec | — |
| Rinse 2 | 38.0° C. | 20 sec | — |
| Rinse 3 | 38.0° C. | 20 sec | — |
| Rinse 4 | 38.0° C. | 20 sec | 121 mL |
| Drying | 80° C. | | |

(Note)

*Replenishment rate per $m^2$ of the photosensitive material to be processed

** A rinse cleaning system RC50D, trade name, manufactured by Fuji Photo Film Co., Ltd., was installed in the above Rinse 3, and the rinse solution was taken out from Rinse 3 and sent to a reverse osmosis membrane module (RC50D) by using a pump. The permeated water obtained in that tank was supplied to Rinse 4, and the concentrated liquid was returned to Rinse 3. Pump pressure was controlled such that the permeated water in the reverse osmosis module would be maintained in an amount of 50 to 300 ml/min, and the rinse solution was circulated under controlled temperature for 10 hours a day. The rinse was made in a four-tank counter-current system from Rinse 1 to Rinse 4.

The compositions of each processing solution were as follows.

| (Color developer) | (Tank solution) | (Replenisher) |
|---|---|---|
| Water | 800 ml | 800 ml |
| Fluorescent whitening agent (FL-1) | 2.2 g | 5.1 g |
| Fluorescent whitening agent (FL-2) | 0.35 g | 1.75 g |
| Triisopropanolamine | 8.8 g | 8.8 g |
| Polyethyleneglycol (Average molecular weight: 300) | 10.0 g | 10.0 g |
| Ethylenediaminetetraacetic acid | 4.0 g | 4.0 g |
| Sodium sulfite | 0.10 g | 0.20 g |
| Potassium chloride | 10.0 g | — |
| Sodium 4,5-dihydroxybenzene-1,3-disulfonate | 0.50 g | 50 g |
| Disodium-N,N-bis(sulfonatoethyl)hydroxylamine | 8.5 g | 14.0 g |
| 4-Amino-3-methyl-N-ethyl-N-(β-methanesulfonamidoethyl)aniline · 3/2 sulfate · monohydrate | 4.8 g | 14.0 g |
| Potassium carbonate | 26.3 g | 26.3 g |
| Water to make | 1,000 ml | 1,000 ml |
| pH (25° C., adjusted using sulfuric acid and KOH) | 10.15 | 12.40 |

| (Bleach-fixing solution) | (Tank solution) | (Replenisher A) | (Replenisher B) |
|---|---|---|---|
| Water | 800 mL | 500 mL | 300 mL |
| Ammonium thiosulfate (750 g/L) | 107 mL | — | 386 mL |
| Ammonium bisulfite (65%) | 30.0 g | — | 190 g |
| Ethylenediamine tetraacetate iron (III) ammonium | 47.0 g | 133 g | — |
| Ethylenediamine tetraacetic acid | 1.4 g | 5 g | 6 g |
| Nitric acid (67%) | 6.5 g | 66.0 g | — |
| Imidazole | 14.6 g | 50.0 g | — |
| m-Carboxybenzenesulfinic acid | 8.3 g | 33.0 g | — |
| Water to make | 1,000 ml | 1,000 ml | 1,000 ml |
| pH (25° C.; adjusted using nitric acid and aqua ammonia) | 6.5 | 6.0 | 6.0 |

| (Rinse solution) | (Tank solution) | (Replenisher) |
|---|---|---|
| Sodium chlorinated-isocyanurate | 0.02 g | 0.02 g |
| Deionized water (conductivity 5 μS/cm or less) | 1,000 ml | 1,000 ml |
| pH (25° C.) | 6.5 | 6.5 |

Processing B

The aforementioned Sample 101 was made into a roll with width 127 mm; the resultant sample was exposed to light with a standard photographic image, using Digital Minilab Frontier 340 (trade name, manufactured by Fuji Photo Film Co., Ltd.); and then, the exposed sample was continuously processed (running test) in the following processing steps, until an accumulated replenisher amount of the color developing solution reached to be equal to twice the color developer tank volume. The processor was modified by modifying the processing racks thereby to change the conveyance speed, so as to set the following processing time conditions. A processing with this running processing solutions was named processing B.

| Processing step | Temperature | Time | Replenishment rate* |
|---|---|---|---|
| Color development | 45.0° C. | 12 sec | 35 mL |
| Bleach-fixing | 40.0° C. | 12 sec | Replenisher A 15 mL<br>Replenisher B 15 mL |
| Rinse 1 | 45.0° C. | 4 sec | — |
| Rinse 2 | 45.0° C. | 2 sec | — |
| Rinse 3 | 45.0° C. | 2 sec | — |
| Rinse 4 | 45.0° C. | 3 sec | 175 mL |
| Drying | 80° C. | 15 sec | |

(Note)
*Replenisher amount per $m^2$ of the light-sensitive material to be processed The compositions of each processing solution were as follows.

| (Color developer) | (Tank solution) | (Replenisher) |
|---|---|---|
| Water | 800 mL | 800 mL |
| Fluorescent whitening agent (FL-3) | 4.0 g | 10.0 g |
| Residual-color-reducing agent (SR-1) | 3.0 g | 3.0 g |
| m-Carboxybenzenesulfinic acid | 2.0 g | 4.0 g |
| Sodium p-toluenesulfonate | 10.0 g | 10.0 g |
| Ethylenediaminetetraacetic acid | 4.0 g | 4.0 g |
| Sodium sulfite | 0.10 g | 0.10 g |
| Potassium chloride | 10.0 g | — |

-continued

| (Color developer) | (Tank solution) | (Replenisher) |
|---|---|---|
| Sodium 4,5-dihydroxybenzene-1,3-disulfonate | 0.50 g | 0.50 g |
| Disodium-N,N-bis(sulfonatoethyl)hydroxylamine | 8.5 g | 14.0 g |
| 4-Amino-3-methyl-N-ethyl-N-(β-methanesulfonamidoethyl)-aniline · 3/2 sulfate · monohydrate | 7.0 g | 19.0 g |
| Potassium carbonate | 26.3 g | 26.3 g |
| Water to make | 1000 mL | 1000 mL |
| pH (25° C.; adjusted by using sulfuric acid and KOH) | 10.25 | 12.8 |

| (Bleach-fixing solution) | (Tank solution) | (Replenisher A) | (Replenisher B) |
|---|---|---|---|
| Water | 700 mL | 300 mL | 300 mL |
| Ammonium thiosulfate (750 g/L) | 107 mL | — | 400 mL |
| Ammonium sulfite | 30.0 g | — | — |
| Ammonium iron (III) ethylenediaminetetraacetate | 47.0 g | 200 g | — |
| Ethylenediaminetetraacetic acid | 1.4 g | 0.5 g | 10.0 g |
| Nitric acid (67%) | 7.0 g | 30.0 g | — |
| m-Carboxybenzenesulfinic acid | 3.0 g | 13.0 g | — |
| Ammonium bisulfite (65%) | — | — | 200 g |
| Succinic acid | 7.0 g | 30.0 g | — |
| Water to make | 1,000 mL | 1,000 mL | 1,000 mL |
| pH (25° C.; adjusted by using nitric acid and aqua ammonia) | 6.0 | 2.0 | 5.6 |

| (Rinse solution) | (Tank solution) | (Replenisher) |
|---|---|---|
| Sodium chlorinated-isocyanurate | 0.02 g | 0.02 g |
| Deionized water (conductivity 5 μS/cm or less) | 1,000 ml | 1,000 ml |
| pH (25° C.) | 6.5 | 6.5 |

FL-1

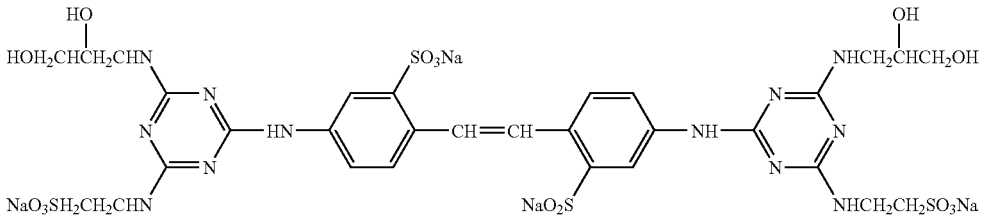

FL-2

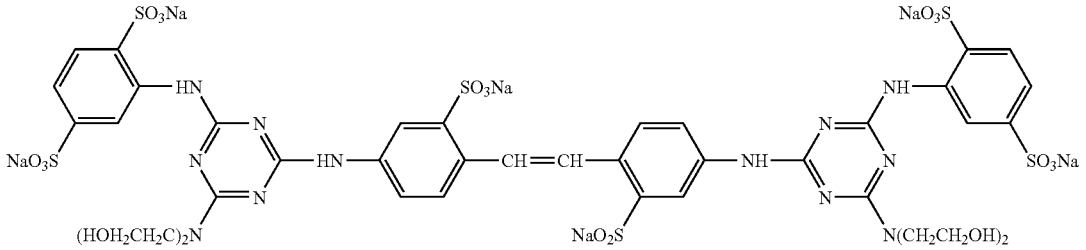

-continued

FL-3

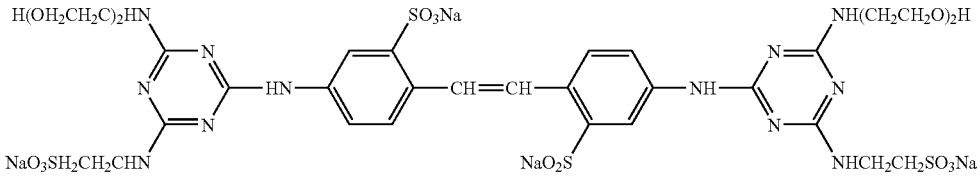

SR-1

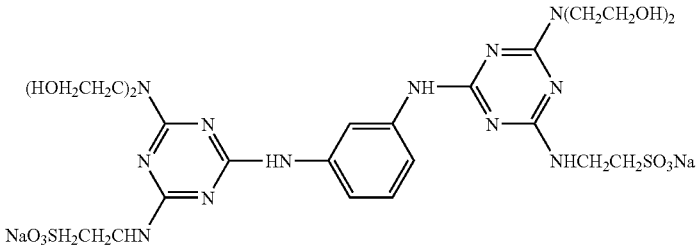

Each sample was subjected to gradation exposure to impart gray in the above Processing B, with the following exposure apparatus; and then, at five seconds after the exposure was finished, the sample was subject to color-development processing by the above Processing A or B. As the laser light sources, used were a blue-light laser of wavelength about 470 nm which was taken out of a semiconductor laser (oscillation wavelength about 940 nm) by converting the wavelength by an SHG crystal of $LiNbO_3$ having a waveguide-like inverse domain structure, a green-light laser of wavelength about 530 nm which was taken out of a semiconductor laser (oscillation wavelength about 1,060 nm) by converting the wavelength by an SHG crystal of $LiNbO_3$ having a waveguide-like inverse domain structure, and a red-light semiconductor laser (Type No. HL6501 MG, manufactured by Hitachi, Ltd.) of wavelength about 650 nm. Each of these three color laser lights was moved in a direction perpendicular to the scanning direction by a polygon mirror so that it could be scanned to expose successively on a sample. Each of the semiconductor lasers is maintained at a constant temperature by means of a Peltier element, to obviate light intensity variations associated with temperature variations. The laser beam had an effective diameter of 80 μm and a scanning pitch of 42.3 μm (600 dpi), and an average exposure time per pixel was $1.7\times10^{-7}$ seconds. The temperature of the semiconductor laser was kept constant by using a Peltier device to prevent the quantity of light from being changed by temperature.

The density of developed cyan color of each of the samples after processed was measured, to obtain a characteristic curve. The sensitivity (S) was the antilogarithm of the inverse number of an exposure amount giving a developed color density higher by 1.0 than the minimum developed color density, and it is expressed as a relative value when the sensitivity of Sample 101 in Processing A is set to 100. The larger the value is, the higher the sensitivity is, which is preferable. The gradation (γ) is a difference between the sensitivity at density 0.5 and the sensitivity at density 1.5, and it is expressed as a relative value when the gradation of Sample 101 in Processing A is set to 100. The smaller the value is, the higher the gradation is, which is preferable. The fog density (Dmin) shows a value obtained by subtracting the density of the base from the cyan density of the unexposed portion. The smaller the value is, the clear and more attractive the white background is, which is preferable. The results of the sensitivity (S), gradation (γ) and fog density (Dmin) are shown in Table 3.

TABLE 3

| | Processing A | | | Processing B | | | |
|---|---|---|---|---|---|---|---|
| Sample | Sensitivity | Fog | Gradation | Sensitivity | Fog | Gradation | Remarks |
| 101 | 100 | 0.13 | 100 | 88 | 0.12 | 98 | Comparative example |
| 102 | 61 | 0.06 | 105 | 48 | 0.05 | 100 | Comparative example |
| 103 | 110 | 0.14 | 98 | 96 | 0.12 | 96 | Comparative example |
| 104 | 108 | 0.14 | 100 | 97 | 0.13 | 97 | Comparative example |
| 105 | 112 | 0.16 | 98 | 97 | 0.14 | 96 | Comparative example |
| 111 | 100 | 0.12 | 100 | 95 | 0.10 | 98 | This invention |
| 112 | 63 | 0.06 | 106 | 61 | 0.05 | 100 | Comparative example |
| 113 | 108 | 0.11 | 100 | 98 | 0.09 | 98 | This invention |
| 114 | 108 | 0.12 | 99 | 99 | 0.08 | 96 | This invention |
| 115 | 110 | 0.12 | 98 | 100 | 0.09 | 95 | This invention |
| 116 | 108 | 0.12 | 99 | 98 | 0.09 | 97 | This invention |
| 121 | 105 | 0.16 | 103 | 95 | 0.14 | 102 | Comparative example |
| 122 | 69 | 0.10 | 108 | 75 | 0.08 | 107 | Comparative example |
| 123 | 116 | 0.18 | 104 | 103 | 0.15 | 104 | Comparative example |
| 124 | 118 | 0.18 | 106 | 103 | 0.16 | 106 | Comparative example |
| 125 | 106 | 0.14 | 103 | 97 | 0.11 | 100 | This invention |
| 126 | 68 | 0.09 | 108 | 76 | 0.06 | 106 | Comparative example |
| 127 | 117 | 0.14 | 103 | 103 | 0.12 | 100 | This invention |
| 128 | 118 | 0.15 | 104 | 104 | 0.10 | 99 | This invention |

It was found from Table 3 that Samples 111 and 113 to 116 according to the present invention were preferable, because these samples had the same levels of sensitivity and gradation as and a lower fogging value than Samples 101 to 105 and 112 for comparison. When comparing the Processing A with the Processing B, the advantageous effects of the present invention are much larger in the Processing B, showing that the present invention is high in rapid processing suitability. Further, by comparing Samples 125, 127 and 128 according to the present invention with Samples 121 to 124 and 126 for comparison, which were different in the silver iodide amount per mol of the silver halide from the former samples, it can be understood that the advantageous effects of the present invention were quite larger in the case of using a silver halide emulsion of silver iodide content 0.3 mol % than in the case of using a silver halide emulsion of silver iodide content 0.05 mol %.

Example 2

Samples 201 to 205 and Samples 211 to 215 were prepared in the same manner as Samples 101 to 105 and Samples 111 to 115 in Example 1, respectively, except that the silver halide emulsion and the emulsified dispersion for the red-sensitive layer were mixed and dissolved, followed by allowing the resultant solution to stand for 6 hours, and then applied.

Each structure of the emulsion and the coupler are as shown in Table 4.

TABLE 4

| Sample | Emulsion | Coupler |
|---|---|---|
| 201 | RH-1 | ExC-1, ExC-2, ExC-3 |
| 202 | RH-2 | ExC-1, ExC-2, ExC-3 |
| 203 | RH-3 | ExC-1, ExC-2, ExC-3 |
| 204 | RH-4 | ExC-1, ExC-2, ExC-3 |
| 205 | RH-5 | ExC-1, ExC-2, ExC-3 |
| 211 | RH-1 | IC-22 |
| 212 | RH-2 | IC-6 |
| 213 | RH-3 | IC-29 |
| 214 | RH-4 | IC-30 |
| 215 | RH-5 | IC-23 |

Each sample was exposed to light and processed (Processing B) in the same manner as in Example 1, to compare variations in the characteristics of Samples 201 to 205 and 211 to 215 from those of Sample 101 to 105 and 111 to 115.

The density of developed cyan color of each sample after the sample was processed was measured, to obtain a characteristic curve. The sensitivity was the antilogarithm of the inverse number of an exposure amount giving a developed color density higher by 1.0 than the minimum developed color density, and it is expressed as a relative value when the sensitivity of Sample 101 in Processing B was set to 100. The difference in sensitivity of a sample from that of Sample 101 is defined as a difference in sensitivity, and as the value is closer to zero, the variation is smaller, which is preferable. A difference in fog density shows a difference obtained by subtracting the density of the base from the cyan density of the unexposed portion. The smaller the value is, the smaller the difference in fog density is, which is preferable. The results of the difference in sensitivity and the difference in fog density are shown in Table 5.

TABLE 5

| Sample | Sample to be compared | Difference in sensitivity | Difference in fog density | Remarks |
|---|---|---|---|---|
| 201 | 101 | −13 | +0.09 | Comparative example |
| 202 | 102 | −11 | +0.08 | Comparative example |
| 203 | 103 | −16 | +0.09 | Comparative example |
| 204 | 104 | −15 | +0.06 | Comparative example |
| 205 | 105 | −21 | +0.07 | Comparative example |
| 211 | 111 | −7 | 0.00 | This invention |
| 212 | 112 | −10 | +0.08 | Comparative example |
| 213 | 113 | −7 | +0.01 | This invention |
| 214 | 114 | −6 | 0.00 | This invention |
| 215 | 115 | −6 | 0.00 | This invention |

It can be understood from Table 5 that the samples according to the present invention were remarkably reduced in performance variation with the lapse of time after the materials for said samples were mixed and dissolved in the production step, showing that they were excellent in stability. It can be also understood that when comparing Samples 211 and 213 to 215 according to the present invention with Sample 212 for comparison, larger effects were obtained when the specific selenium sensitizers that can be preferably used in the present invention were used, and, in particular, further higher effects were obtained when the selenium sensitizers represented by any of formulae (PF1) to (PF6) were used (Samples 214 and 215).

INDUSTRIAL APPLICABILITY

The present invention is preferable as a silver halide color photographic light-sensitive material that can provide a silver halide emulsion high in sensitivity, low in fogging, aid high in contrast, and that is reduced in the variation of performance with the lapse of time after the materials therefor are mixed and dissolved in its production process.

Having described our invention as related to the present embodiments, it is our intention that the invention not be limited by any of the details of the description, unless otherwise specified, but rather be construed broadly within its spirit and scope as set out in the accompanying claims.

The invention claimed is:

1. A silver halide color photographic light-sensitive material, comprising, on a support, at least one silver halide emulsion layer containing a cyan dye forming coupler, at least one silver halide emulsion layer containing a magenta dye forming coupler, and at least one silver halide emulsion layer containing a yellow dye forming coupler, wherein at least one layer of said at least one silver halide emulsion layer containing a cyan dye forming coupler contains high-silver chloride emulsion grains, which are selenium-sensitized and have a silver chloride content of 90 mol % or more, and contains at least one coupler represented by the following formula (I):

Formula (I)

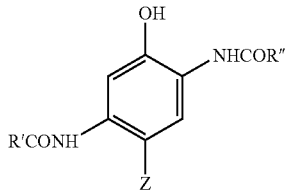

wherein R' and R" each independently represent a substituent; and Z represents a hydrogen atom, or a group capable of being split-off upon a coupling reaction with an oxidized product of an aromatic primary amine color-developing agent.

2. The silver halide color photographic light-sensitive material according to claim 1, wherein the high-silver chloride emulsion grains are chemically sensitized by a selenium sensitizer represented by the following formula (SE1):

Formula (SE1)

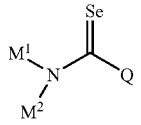

wherein $M^1$ and $M^2$ each independently represent a hydrogen atom, an alkyl group, an alkenyl group, an alkynyl group, an aryl group, a heterocyclic group, an acyl group, an amino group, an alkoxy group, a hydroxy group, or a carbamoyl group; Q represents an alkyl group, an alkenyl group, an alkynyl group, an aryl group, a heterocyclic group, —$OM^3$, or —$NM^4M^5$, in which $M^3$, $M^4$, and $M^5$ each independently represent a hydrogen atom, an alkyl group, an alkenyl group, an alkynyl group, an aryl group, or a heterocyclic group; and any two groups of $M^1$, $M^2$, and Q may bond together, to form a ring structure.

3. The silver halide color photographic light-sensitive material according to claim 1, wherein the high-silver chloride emulsion grains are chemically sensitized by a selenium sensitizer represented by the following formula (SE2):

Formula (SE2)

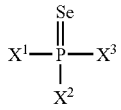

wherein $X^1$, $X^2$, and $X^3$ each independently represent an alkyl group, an alkenyl group, an alkynyl group, an aryl group, a heterocyclic group, —$OJ^1$, or —$NJ^2J^3$, in which $J^1$, $J^2$, and $J^3$ each independently represent a hydrogen atom, an alkyl group, an alkenyl group, an alkynyl group, an aryl group, or a heterocyclic group.

4. The silver halide color photographic light-sensitive material according to claim 1, wherein the high-silver chloride emulsion grains are chemically sensitized by a selenium sensitizer represented by the following formula (SE3):

$E^1$-Se-$E^2$ Formula (SE3)

wherein $E^1$ and $E^2$, which are the same or different from each other, each independently represent an alkyl group, an alkenyl group, an alkynyl group, an aryl group, a heterocyclic group, an acyl group, an alkoxycarbonyl group, an aryloxycarbonyl group, or a carbamoyl group.

5. The silver halide color photographic light-sensitive material according to claim 1, wherein the high-silver chloride emulsion grains are chemically sensitized by at least one selenium sensitizer represented by any of the following formulae (PF1) to (PF6):

Formula (PF1)

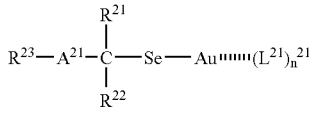

Formula (PF2)

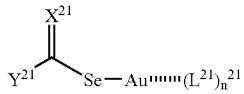

Formula (PF3)

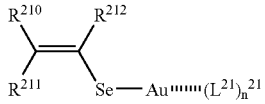

Formula (PF4)

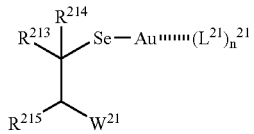

Formula (PF5)

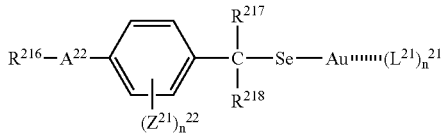

Formula (PF6)

$[Q^{21}$——$Au$——$(Q^{22})_n^{23}]$ $J^{21}$ wherein $L^{21}$ represents a compound capable of coordinating with gold via an N atom, an S atom, an Se atom, a Te atom, or a P atom; $n^{21}$ represents 0 or 1; $A^{21}$ represents —O—, —S—, or —$NR^{24}$—; $R^{21}$, $R^{22}$, $R^{23}$, and $R^{24}$ each independently represent a hydrogen atom or a substituent; $R^{23}$ may form a 5- to 7-membered ring together with $R^{21}$ or $R^{22}$; $X^{21}$ represents =O, =S, or =$NR^{25}$; $Y^{21}$ represents an alkyl group, an alkenyl group, an alkynyl group, an aryl group, a heterocyclic group, —$OR^{26}$, —$SR^{27}$, or —$N(R^{28})R^{29}$; $R^{25}$, $R^{26}$, $R^{27}$, $R^{28}$, and $R^{29}$ each independently represent a hydrogen atom, an alkyl group, an alkenyl group, an alkynyl group, an aryl group, or a heterocyclic group; $X^{21}$ and $Y^{21}$ may bond together, to form a ring; $R^{210}$, $R^{211}$ and $R^{212}$ each independently represent a hydrogen atom or a substituent, and at least one of $R^{210}$ and $R^{211}$ represents an electron attractive group; $W^{21}$ represents an electron attractive group; $R^{213}$, $R^{214}$, and $R^{215}$ each independently represent a hydrogen atom or a substituent; $W^{21}$ and $R^{213}$ may bond together, to form a cyclic structure; $A^{22}$ represents —O—, —S—, —Se—, —Te—, or —$NR^{219}$—; $R^{216}$ represents a hydrogen atom, an alkyl group, an alkenyl group, an alkynyl group, an aryl group, a heterocyclic group, or an acyl group; $R^{212}$, $R^{218}$, and $R^{219}$ each independently represent a hydrogen atom, an alkyl group, an alkenyl group, an alkynyl group, an aryl group, or a heterocyclic group; $Z^{21}$ represents a substituent; $n^{22}$ represents an integer of from 0 to 4; when $n^{22}$ is 2 or more, $Z^{21}$s may be the same or different, or may bond together to form a ring; $Q^{21}$ and $Q^{22}$ each represent a compound selected from those represented by any of formulae (SE1) to (SE3); the Se atoms in $Q^{21}$ and $Q^{22}$ each are coordinated with the Au; $n^{23}$ represents 0 or 1; $J^{21}$ represents a counter anion; when $n^{23}$ is 1, $Q^{21}$ and $Q^{22}$ may be the same or different; and the compound represented by formula (PF6) does not include the compounds represented by any of formulae (PF1) to (PF5).

6. The silver halide color photographic light-sensitive material according to claim 1, wherein the average side length of the high-silver chloride emulsion grains is 0.1 μm or more and 0.35 μm or less.

7. The silver halide color photographic light-sensitive material according to claim 1, wherein the high-silver chloride emulsion grains have a silver iodide content of 0.1 mol % or more and 1 mol % or less, and a silver iodide-containing phase is formed at a part or all of the position ranging from 80% or outer of the grain volume measured from the inside.

8. The silver halide color photographic light-sensitive material according to claim 1, wherein an amount of said coupler contained in the red-sensitive silver halide emulsion layer, which is chemically synthesized by a selenium sensitizer, is 0.6 equivalents to 1 equivalent, to 1 mol of silver.

9. The silver halide color photographic light-sensitive material according to claim 1, which is a silver halide color photographic light-sensitive material for rapid processing, in which a color development processing is started within 9 seconds after imagewise exposure, and said color development processing is finished in a period time within 28 seconds, to form an image.

10. The silver halide color photographic light-sensitive material according to claim 1, which is a silver halide color photographic light-sensitive material for digital exposure, in which the exposure is imagewise exposure carried out by laser scanning.

11. The silver halide color photographic light-sensitive material according to claim 1, wherein in formula (I), R' is an alkyl group or an arylsulfonyl group, and R" is an aryl group substituted with a halogen atom.

12. The silver halide color photographic light-sensitive material according to claim 1, wherein the high-silver chloride emulsion grains are chemically sensitized by a selenium sensitizer represented by any one of formulae (SE1) to (SE3):

Formula (SE1)

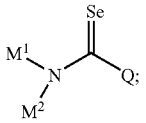

wherein $M^1$ and $M^2$ each independently represent a hydrogen atom, an alkyl group, an alkenyl group, an alkynyl group, an aryl group, a heterocyclic group, an acyl group, an amino group, an alkoxy group, a hydroxy group, or a carbamoyl group; Q represents an alkyl group, an alkenyl group, an alkynyl group, an aryl group, a heterocyclic group, —$OM^3$, or —$NM^4M^5$, in which $M^3$, $M^4$, and $M^5$ each independently represent a hydrogen atom, an alkyl group, an alkenyl group, an alkynyl group, an aryl group, or a heterocyclic group; and any two groups of $M^1$, $M^2$, and Q may bond together, to form a ring structure;

Formula (SE2)

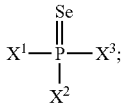

wherein $X^1$, $X^2$, and $X^3$ each independently represent an alkyl group, an alkenyl group, an alkynyl group, an aryl group, a heterocyclic group, —$OJ^1$, or —$NJ^2J^3$, in which $J^1$, $J^2$, and $J^3$ each independently represent a hydrogen atom, an alkyl group, an alkenyl group, an alkynyl group, an aryl group, or a heterocyclic group;

$E^1$-Se-$E^2$ Formula (SE3)

wherein $E^1$ and $E^2$, which are the same or different from each other, each independently represent an alkyl group, an alkenyl group, an alkynyl group, an aryl group, a heterocyclic group, an acyl group, an alkoxycarbonyl group, an aryloxycarbonyl group, or a carbamoyl group.

13. The silver halide color photographic light-sensitive material according to claim 1, wherein the silver halide emulsion in the silver halide emulsion layer containing a cyan dye forming coupler contains an iridium complex represented by formula (II)':

$[IrX^1nL^1_{(6-n)}]^m$ Formula (II)' wherein $X^1$ represents a halogen ion or a pseudohalogen ion other than a cyanate ion; $L^1$ represents water or a heterocyclic compound; n is 3, 4 or 5; and m is 5−, 4−, 3−, 2−, 1−, 0 or 1+, which represents an electric charge of the metal complex.

14. The silver halide color photographic light-sensitive material according to claim 1, wherein any one of the at least one silver halide emulsion layer containing a yellow dye forming coupler, the at least one silver halide emulsion layer containing a magenta dye forming coupler and the at least one silver halide emulsion layer containing a cyan dye forming coupler is composed of two or three layers.

15. The silver halide color photographic light-sensitive material according to claim 1, wherein the at least one silver halide emulsion layer containing a magenta dye forming coupler is arranged further from the support than any of the other silver halide emulsion layers.

* * * * *